US011519113B2

(12) United States Patent
Eriksson et al.

(10) Patent No.: US 11,519,113 B2
(45) Date of Patent: Dec. 6, 2022

(54) EMBROIDERY ACCESSORY WITH INTERCHANGEABLE GUIDE

(71) Applicant: Singer Sourcing Limited LLC, Lavergne, TN (US)

(72) Inventors: Roberth Eriksson, Jönköping (SE); Barbara Brindzik, Jönköping (SE)

(73) Assignee: Singer Sourcing Limited LLC, Laverne (TN)

( * ) Notice: Subject to any disclaimer, the term of this patent is extended or adjusted under 35 U.S.C. 154(b) by 98 days.

(21) Appl. No.: 16/843,556

(22) Filed: Apr. 8, 2020

(65) Prior Publication Data

US 2021/0317603 A1 Oct. 14, 2021

(51) Int. Cl.

| | |
|---|---|
| ***D05B 35/10*** | (2006.01) |
| ***D05B 43/00*** | (2006.01) |
| ***D05C 3/02*** | (2006.01) |

(52) U.S. Cl.

CPC ..... *D05B 35/10* (2013.01); *D05B 43/00* (2013.01); *D05C 3/02* (2013.01)

(58) Field of Classification Search

CPC ..... D05C 7/08; D05C 11/18; D05C 9/04; D05B 35/06; D05B 57/14; D05B 57/143; D05B 57/146; D05B 33/00

USPC ..... 112/99

See application file for complete search history.

(56) References Cited

U.S. PATENT DOCUMENTS

| | | | | |
|---|---|---|---|---|
| 2,725,837 | A * | 12/1955 | Seaman | D05C 7/08 112/101 |
| 6,957,615 | B1 | 10/2005 | Landoni | |
| 8,671,861 | B2 | 3/2014 | Konig et al. | |
| 9,631,306 | B2 | 4/2017 | Shomura | |
| 9,631,307 | B2 | 4/2017 | Shomura | |
| 9,834,878 | B2 | 12/2017 | Egami et al. | |
| 9,863,074 | B2 | 1/2018 | Nakajima | |
| 2008/0264316 | A1 | 10/2008 | Tajima et al. | |
| 2011/0192332 | A1* | 8/2011 | Suzuki | D05C 7/08 112/113 |
| 2015/0240401 | A1* | 8/2015 | Kobayashi | D05B 35/06 112/102.5 |
| 2016/0230323 | A1* | 8/2016 | Nakajima | D05B 29/10 |

FOREIGN PATENT DOCUMENTS

| | | |
|---|---|---|
| CN | 1432316 | 7/2003 |
| CN | 1223714 | 10/2005 |
| CN | 202450256 | 9/2012 |
| CN | 202898763 | 4/2013 |
| CN | 202968976 | 6/2013 |

(Continued)

*Primary Examiner* — Nathan E Durham

(74) *Attorney, Agent, or Firm* — Calfee, Halter & Griswold LLP

(57) ABSTRACT

An exemplary embroidery accessory for a sewing machine includes a stationary support attached to the sewing machine and a rotating support rotatably attached to the stationary support. A drive mechanism rotates the rotating support relative to the stationary support and a spool supported by the rotating support receives and dispenses a length of embroidery material. The removable guide is removably attached to the rotating support and includes a sewing guide with a needle opening for receiving a needle of the sewing machine, and at least one guide for guiding the length of embroidery material from the spool to the sewing guide.

36 Claims, 35 Drawing Sheets

(56) References Cited

FOREIGN PATENT DOCUMENTS

| | | | | |
|---|---|---|---|---|
| CN | 204509677 | | | 7/2015 |
| CN | 205099902 | | | 3/2016 |
| CN | 106048914 | | | 10/2016 |
| CN | 107653580 | | | 2/2018 |
| DE | 19960904 | | | 6/2003 |
| JP | 10212655 | A | * | 8/1998 |
| TW | M543886 | | | 6/2017 |

* cited by examiner

EMBROIDERY ACCESSORY WITH INTERCHANGEABLE GUIDE

TECHNICAL FIELD

The present invention relates generally to sewing machines, and in particular to accessories thereof.

BACKGROUND OF THE INVENTION

Sewing machines can sew an embroidery pattern on a workpiece that is mounted in an embroidery frame. The embroidery frame is moved relative to the sewing head to sew an embroidery pattern onto the cloth workpiece using a needle and thread.

These sewing machines can include an optional spool of material—such as ribbon or cord—that is dispensed ahead of the needle as the needle follows the embroidery pattern so that the stitching attaches the ribbon or cord to the cloth workpiece.

SUMMARY

Exemplary embodiments of sewing machine accessories, sewing machines for performing embroidery, and methods of using the same are disclosed herein.

An exemplary embroidery accessory for a sewing machine includes a stationary support attached to the sewing machine and a rotating support rotatably attached to the stationary support. A drive mechanism rotates the rotating support relative to the stationary support and a spool supported by the rotating support receives and dispenses a length of embroidery material. The removable guide is removably attached to the rotating support and includes a sewing guide with a needle opening for receiving a needle of the sewing machine, and at least one guide for guiding the length of embroidery material from the spool to the sewing guide.

An exemplary sewing machine includes a bed, an embroidery frame for holding a workpiece, an actuator that movably attaches the embroidery frame to the bed, an arm disposed above the bed, a needle bar for holding a needle, and an accessory. The arm is arranged above the bed and a bottom surface of the arm is spaced apart from a top surface of the bed by an arm height. The needle bar and accessory mount extend below the arm toward the bed. An exemplary embroidery accessory for a sewing machine includes a stationary support attached to the sewing machine and a rotating support rotatably attached to the stationary support. A drive mechanism rotates the rotating support relative to the stationary support and a spool supported by the rotating support receives and dispenses a length of embroidery material. The removable guide is removably attached to the rotating support and includes a sewing guide with a needle opening for receiving a needle of the sewing machine, and at least one guide for guiding the length of embroidery material from the spool to the sewing guide.

An exemplary method of operating an accessory for a sewing machine to attach a length of embroidery material to a workpiece includes the steps of: providing the sewing machine and accessory for receiving and dispensing the length of embroidery material, selecting a removable guide for the accessory based on the type of embroidery material, removably attaching the removable guide to the accessory, moving the workpiece so that the needle of the sewing machine follows a predetermined sewing path, rotating the rotating support so that the embroidery material opening leads the needle along the predetermined sewing path, dispensing at least a portion of the length of embroidery through the embroidery material opening of the guide, and sewing at least a portion of the length of the embroidery material to the workpiece with the needle. The accessory includes a stationary support attached to the sewing machine and a rotating support rotatably attached to the stationary support. A drive mechanism rotates the rotating support relative to the stationary support and a spool supported by the rotating support receives and dispenses a length of embroidery material. The removable guide is removably attached to the rotating support and includes a sewing guide with a needle opening for receiving a needle of the sewing machine and at least one guide for guiding the length of embroidery material from the spool to the sewing guide.

A further understanding of the nature and advantages of the present invention are set forth in the following description and claims, particularly when considered in conjunction with the accompanying drawings in which like parts bear like reference numerals.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which.

DETAILED DESCRIPTION

The following description refers to the accompanying drawings, which illustrate specific embodiments of the present disclosure. Other embodiments having different structures and operation do not depart from the scope of the present disclosure.

Exemplary embodiments of the present disclosure are directed to sewing machines for sewing embroidery patterns and accessories for use with the same. It should be noted that various embodiments of sewing machines and accessories are disclosed herein, and any combination of these options can be made unless specifically excluded. In other words, individual components or portions of the disclosed devices can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1:
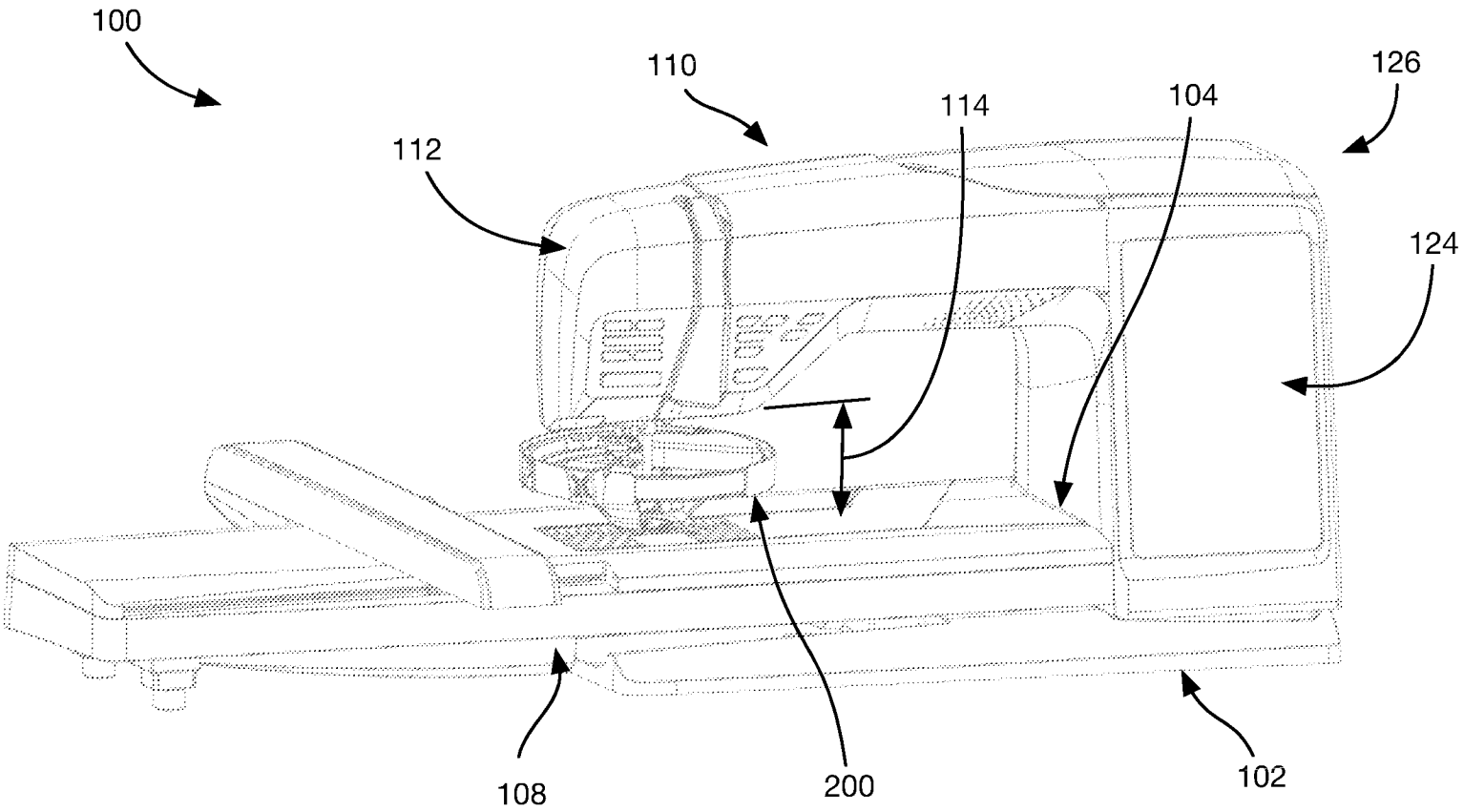
FIG. 1 is a perspective rendering of exemplary embodiments of an accessory and a sewing machine.
Figure 2:
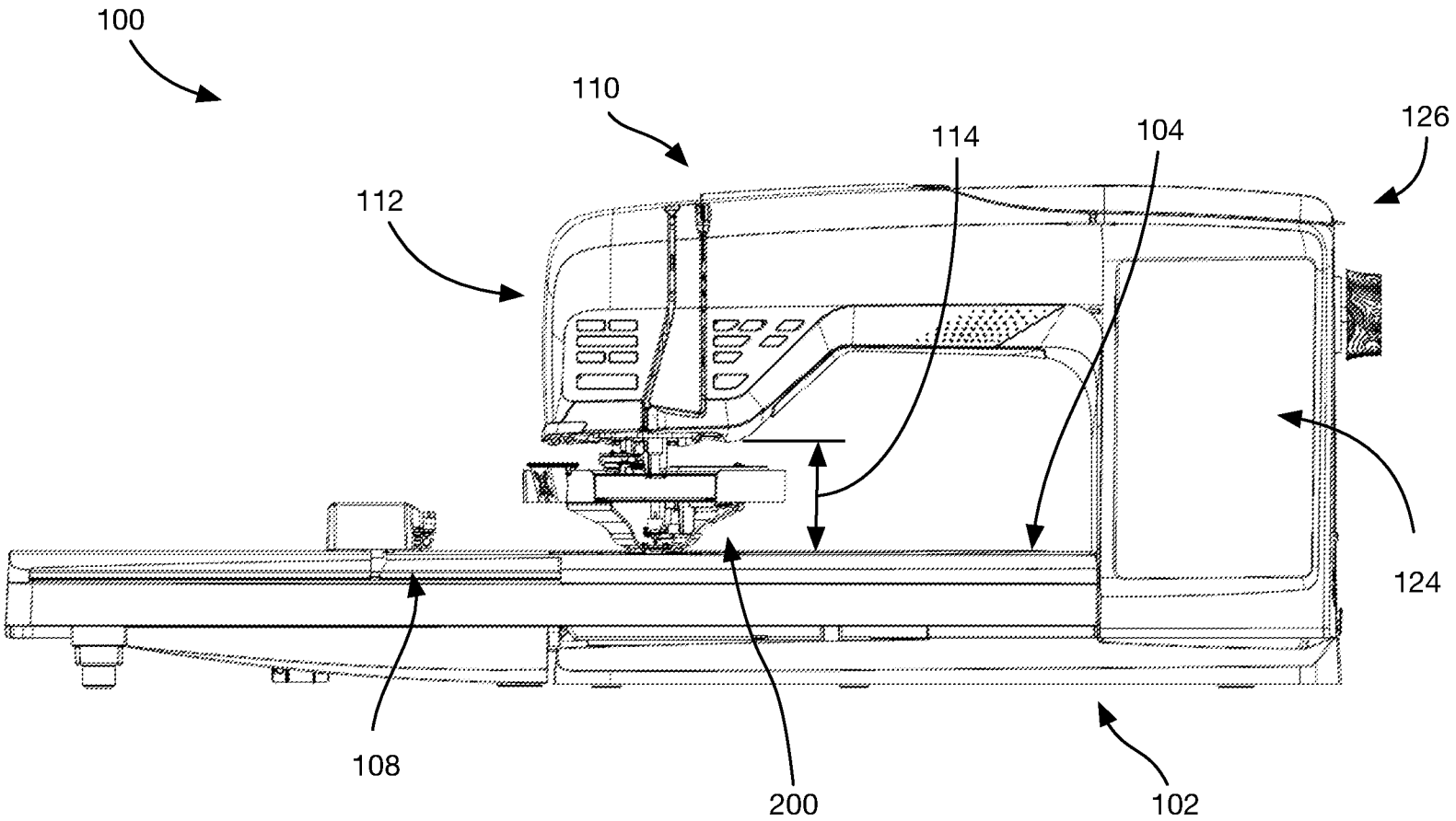
FIG. 2 is a front view rendering of the embodiments of FIG. 1.
Figure 3:
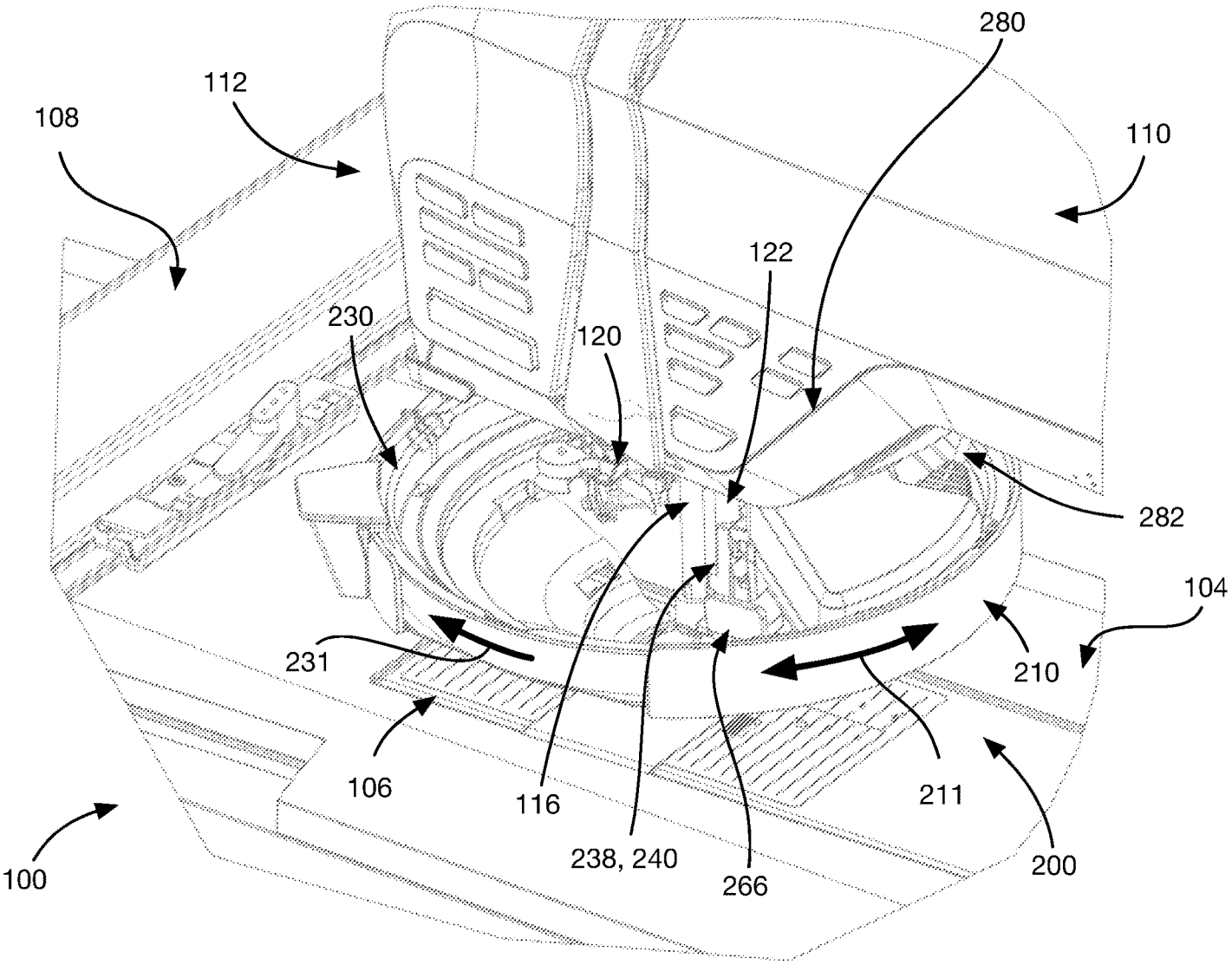
FIG. 3 is a close-up perspective view rendering of the embodiments of FIG. 1.
Figure 4:
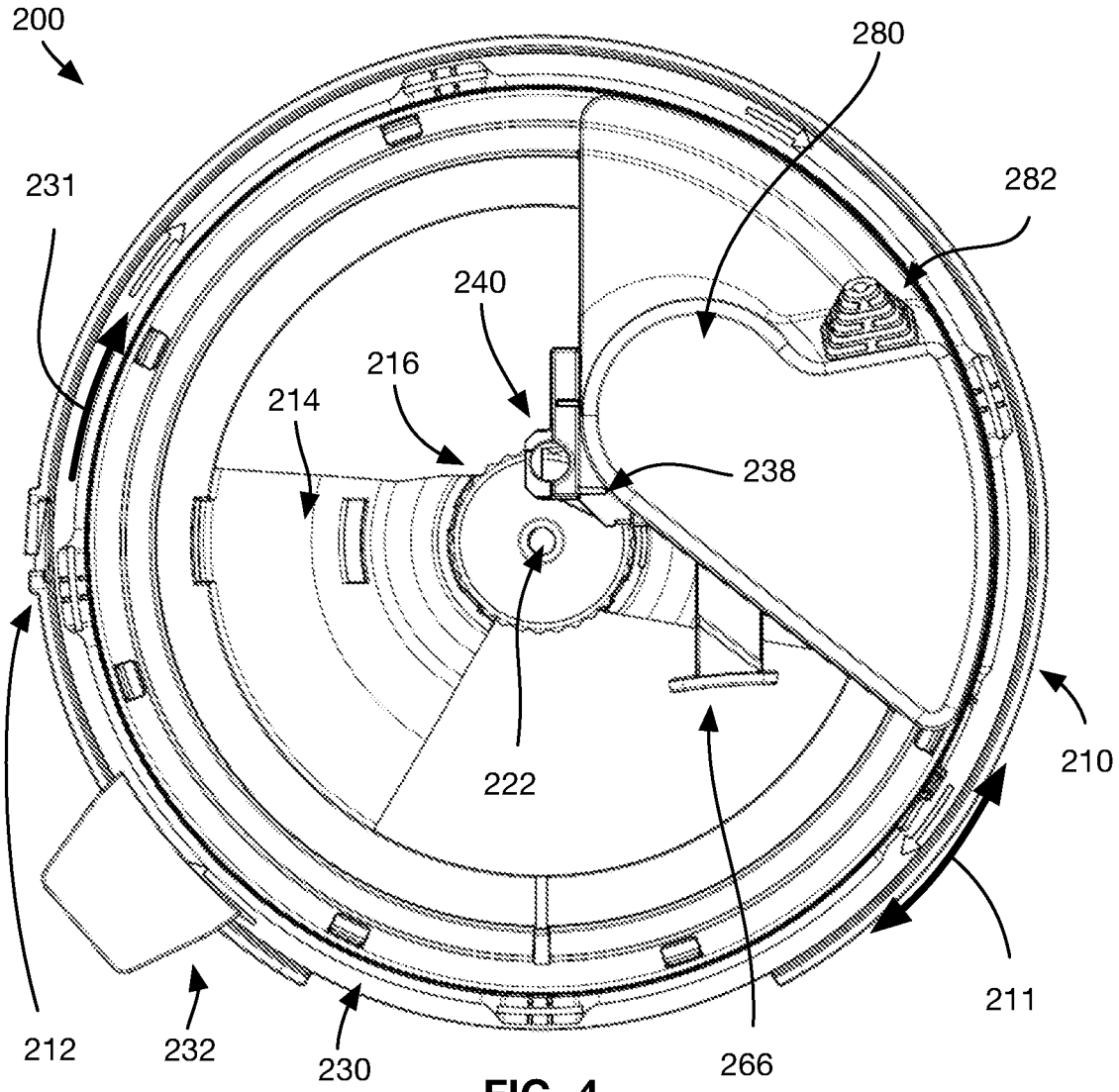
FIG. 4 is a top view rendering of the accessory of FIG. 1.
Figure 5:
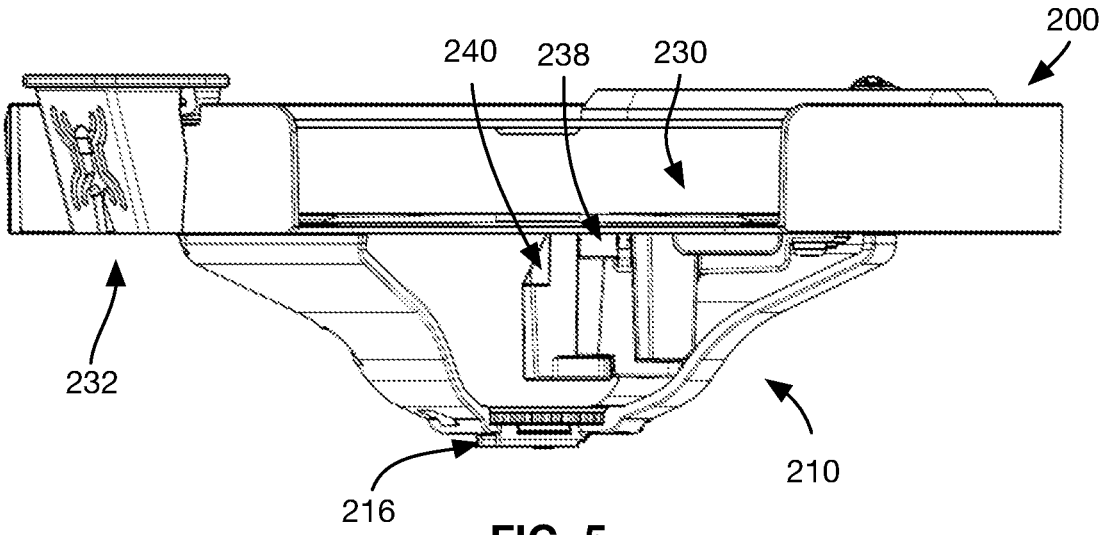
FIG. 5 is a front view rendering of the accessory of FIG. 1.

Referring now to FIGS. 1-3, an exemplary accessory 200 is shown attached to an exemplary sewing machine 100. The sewing machine 100 includes a base 102, a sewing bed 104, and an arm 110 extending horizontally above the base 102 and sewing bed 104. A touch screen and display 124 are provided on a tower 126 that supports the arm 110 above the base 102. The touch screen 124 provides an interface to a computer (not shown) that controls the sewing machine 100 and attached accessory 200 to create embroidery patterns on a cloth workpiece (not shown). During operation the cloth workpiece is attached to an embroidery frame (not shown) that is attached to an embroidery frame mount 108. The embroidery frame mount 108 is attached to the sewing machine base 102 by at least one actuator that can move the embroidery frame mount 108 from left-to-right and back-to-front to provide two-axis control of the position of the embroidery frame.

A sewing head 112 of the machine is provided at a distal end of the arm 110. The sewing head 112 is spaced apart from the sewing bed 104 by a minimum arm height 114. A needle bar 116 (FIG. 3) holding a needle (not shown) extends downward from the sewing head 112 toward a needle plate 106 in the sewing bed 104. Thread is provided to the needle from spools (not shown) supported by the arm 110 and a bobbin (not shown) below the needle plate 106 so that stitches can be formed in the workpiece.

Referring now to FIG. 3, the accessory 200 includes an attachment portion 238 that engages an attachment holder 240 to attach the accessory 200 to the sewing machine 100. The accessory 200 fits within the minimum arm height 114, which can range from about 3 inches to about 6 inches. The accessory 200 provides sufficient room around the needle bar 116 and needle so that normal sewing functions of the sewing machine 100 are not disrupted by the accessory 200. For example, sufficient space is provided for a needle threader 120 to thread the needle attached to the needle bar 116 without removing the accessory 200.

The attachment holder 240 attaches to an accessory mount 122 that extends below the sewing head 112. In some embodiments the accessory mount 122 is a presser bar typically used for a presser foot (not shown) of the sewing machine with the presser foot removed and replaced with the attachment holder 240 to provide a mounting point for the accessory 200. The accessory mount 122 is received in an opening 244 of the attachment holder 240 and can be secured in the opening 244 by, for example, a set screw or other suitable attachment means. An attachment release 266 can be depressed to disengage the attachment portion 238 from the attachment holder 240 so that the accessory 200 can be attached to or removed from the sewing machine 100. The interaction of the attachment portion and holder 238, 240 is shown in FIGS. 20-34 and described in greater detail below.

Referring now to FIGS. 3-8, the accessory 200 includes a spool 230 for receiving and dispensing a length of embroidery material 202 (FIGS. 9-13), such as, for example, ribbon, cord, strings of beads or sequins, or the like. The spool 230 is supported by a support 210 such that the spool 230 is rotatable about a first axis of rotation 204. The spool 230 and accessory 200 can hold and dispense a wide variety of embroidery materials, such as, for example, ribbon, cord, strings of beads, or strings of sequins. The spool 230 can have any suitable inner diameter for holding embroidery material. In the illustrated embodiment, the spool 230 has an inner diameter of at least 6.5 inches and can hold more than 20 feet of embroidery material. Loading the spool with embroidery material can take place while the spool 230 is attached to the support 210 or may be done while the spool 230 is removed from the support 210. Loading of the spool 230 and routing of the embroidery material through the accessory 200 is shown in FIGS. 9-13 and described in greater detail below.

The support 210 is rotatably attached to the attachment portion 238 and, as noted above, to the spool 230. The support 210 has a roughly conical shape extending from a wider top or first end to a narrower bottom or second end. The spool 230 rests in a circular channel in the support 210 near or at the top end of the conical shape. A spool retainer 232 for holding the spool 230 within the circular channel of the support 210 is provide at an outer diameter of the support 210. The spool retainer 232 is moved vertically to permit removal of the spool 230 from the channel for loading with embroidery material 202. The spool 230 can be retained within the channel in a wide variety of ways, such as with protrusions that allow the spool to snap into the channel while prohibiting the spool 230 from popping out of the open top of the channel. A cover can also be provided that attaches to the support 210 and covers the open channel so as to completely enclose the spool 230.

The support 210 includes a sewing guide 216 and a dispensing guide 212 for guiding the embroidery material 202 from the spool 230 along the dispensing path 236 and into the path of the needle 118 (FIGS. 18 and 19) for sewing to the workpiece. The sewing guide 216 has a needle opening 222 that receives the needle 118 of the sewing machine 100 and an embroidery material opening 218 (FIG. 16) for receiving the length of embroidery material from the spool 230. The sewing guide 216 includes an adjustment knob 224 that adjusts the positions of two guide members 228 to accommodate embroidery material with different widths. Alternatively, the sewing guide 216 can be removable from the support 210 so that other sewing guides with different sized embroidery material openings for different sized embroidery materials can be installed. The mechanism for adjusting the width of the path between the guide members 228 is shown in FIGS. 14-17 and is described in greater detail below.

Figure 6:
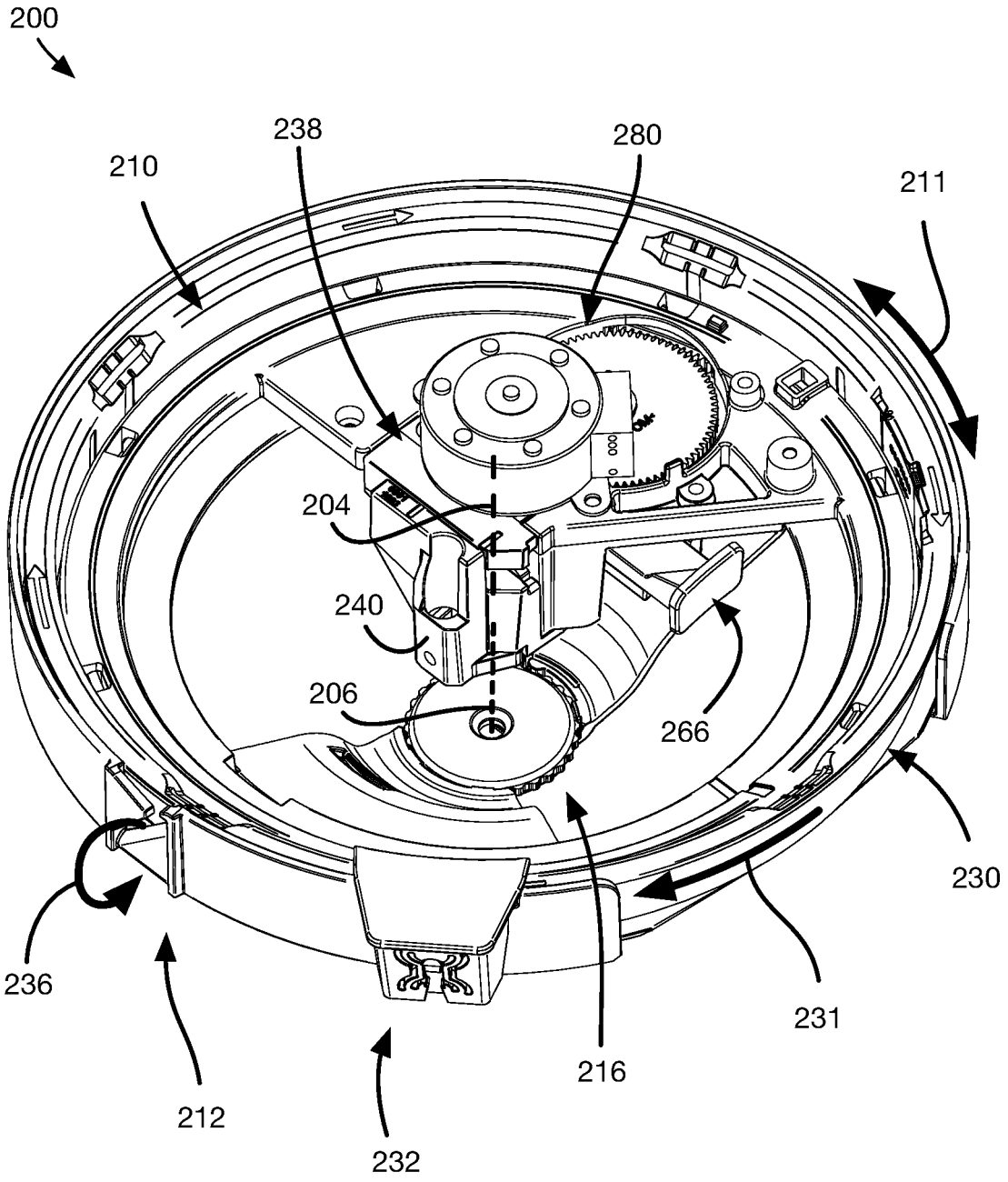
FIG. 6 is a top perspective view of an exemplary accessory for a sewing machine.
Figure 7:
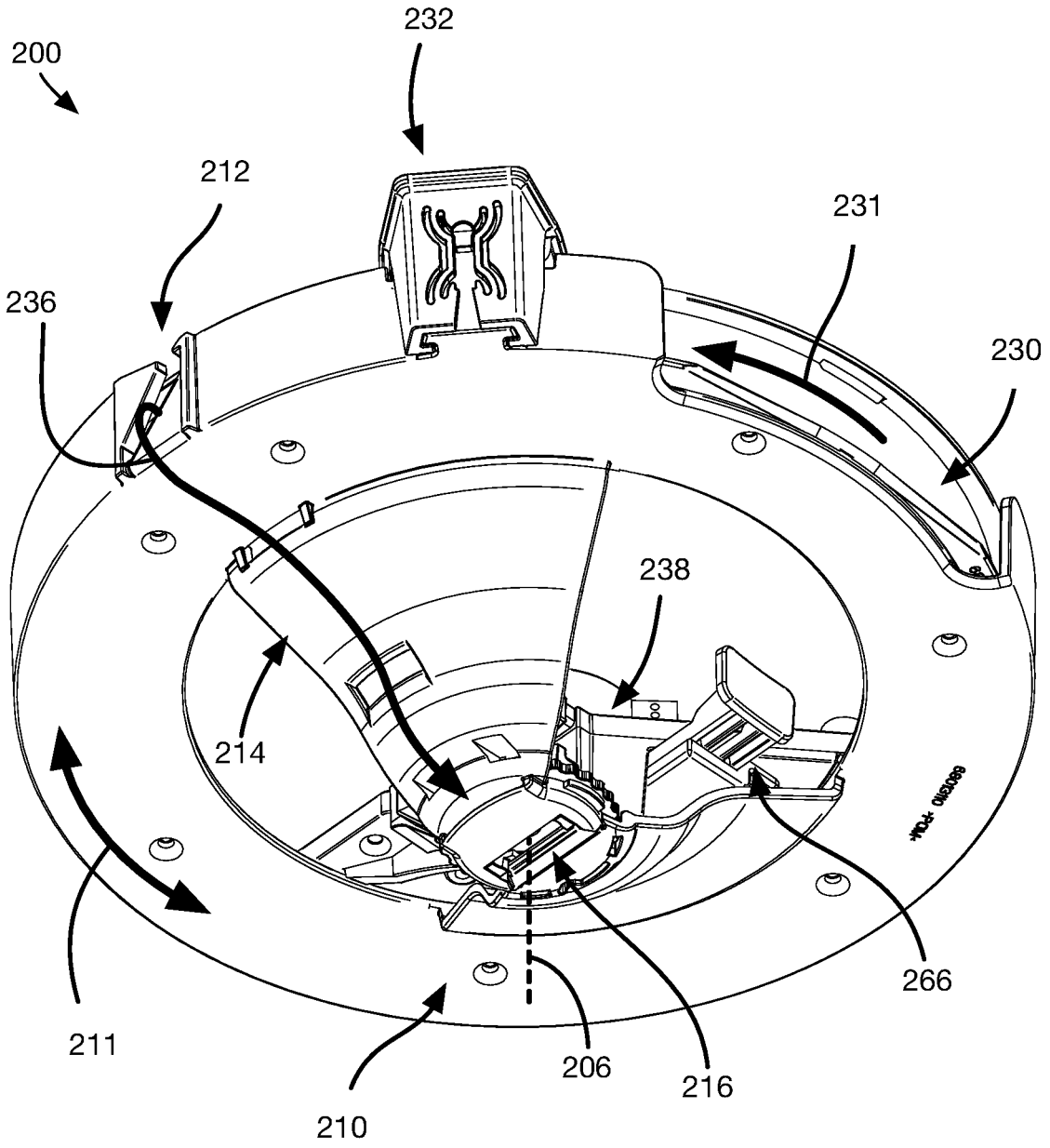
FIG. 7 is a bottom perspective view of an exemplary accessory for a sewing machine.
Figure 8:
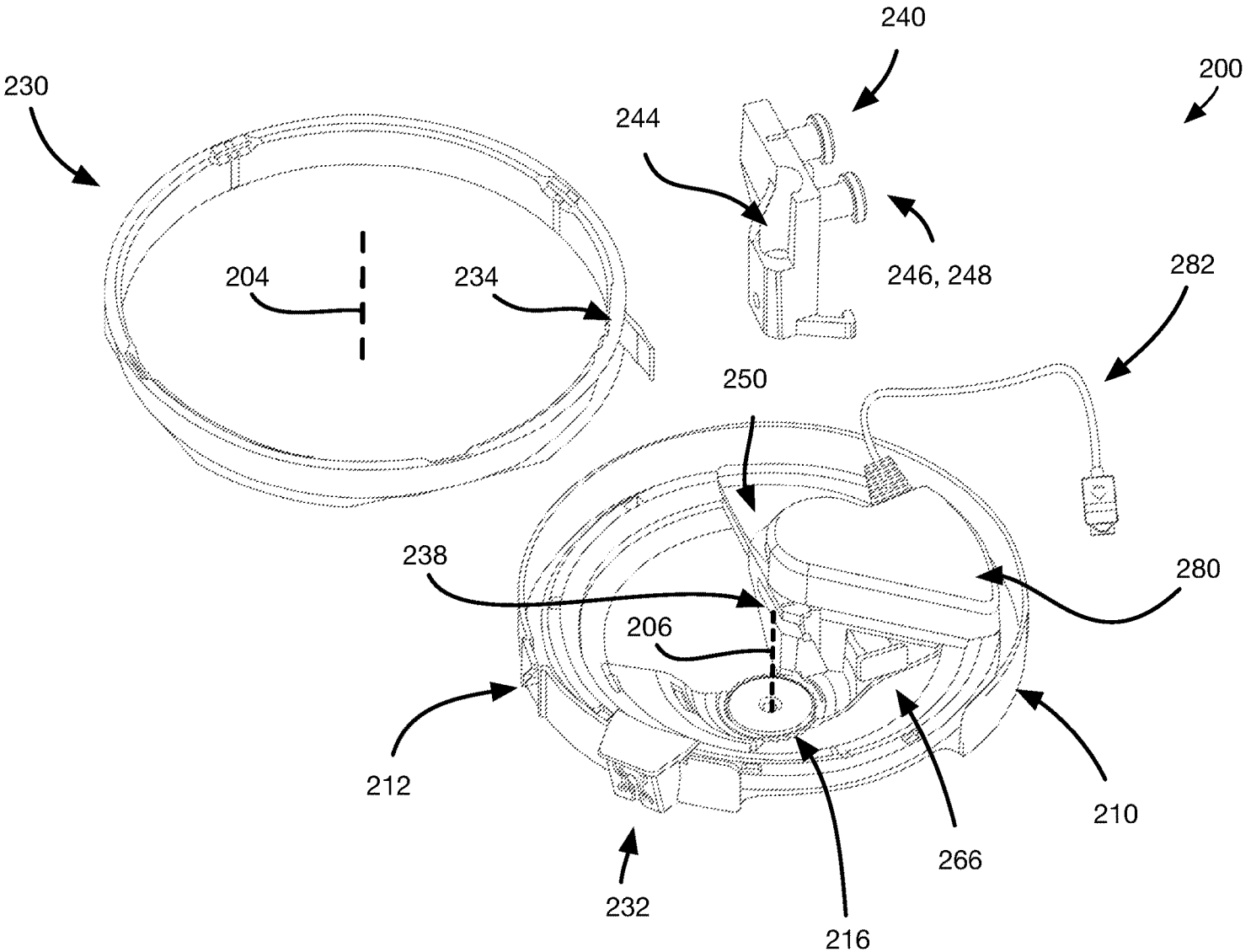
FIG. 8 shows an exploded view of an exemplary accessory for a sewing machine.

The dispensing guide 212 is positioned near the spool 230 and smoothly guides the length of embroidery material from the spool 230 to the embroidery material opening 218 in the sewing guide 216 along a dispensing path 236 (FIGS. 6 and 7). At least a portion of the embroidery material extends along the outer surface of the support 210 as the embroidery material is dispensed through the dispensing guide 212 and the sewing guide 216. A guide surface of the dispensing guide is arranged at about 45 degrees off of the axis of rotation of the spool 230. The angled guide surface twists the embroidery material as it is dispensed down the outer surface of the support 210 so that an outer surface of the embroidery material on the spool becomes a top surface of the embroidery material when the embroidery material is sewn onto a workpiece.

The support 210 can also include additional or auxiliary guides 214 (FIGS. 4 and 7) between the dispensing and sewing guides 212, 216 to support the embroidery material as it is dispensed from the spool 230 so that any slack in the embroidery material does not interfere with the workpiece.

A mechanism 280 rotates the support 210 relative to the stationary attachment portion 238 about a second axis of rotation 206 that is aligned with—i.e., parallel to—the first axis of rotation 204. The second axis of rotation 206 is colinear with a longitudinal axis of the needle bar 116 and needle 118 (FIGS. 18 and 19) of the sewing machine. In some embodiments, the first axis of rotation 206 is colinear with the second axis of rotation 204. The mechanism 280 can include a motor and a transmission and is capable of rotating the support 210 clockwise and counterclockwise. To save vertical space, the mechanism 280 is arranged in an interior of the support 210 and spool 230 so that at least a portion of the mechanism is arranged between a top surface and a bottom surface of the spool 230.

The transmission can include one or more gears, belts, or the like arranged to transfer rotational motion from the motor to the support 210. For example, the transmission can include a ring gear (FIGS. 6 and 18-19) attached to an inner diameter of a portion of the support 210.

The motor of the mechanism 280 receives power and control signals from the sewing machine via an electrical connection. The connection can be provided by a wire 282 that attaches between the accessory 200 and another portion of the sewing machine 100, such as the sewing arm 110. In some embodiments, power and data connections can be integrated into the attachment portion 238, attachment holder 240, and accessory mount 122 so that attaching the accessory 200 to the sewing machine 100 also provides an avenue for the transmission of power and control signals from the sewing machine 100 to the accessory 200.

Figure 10:
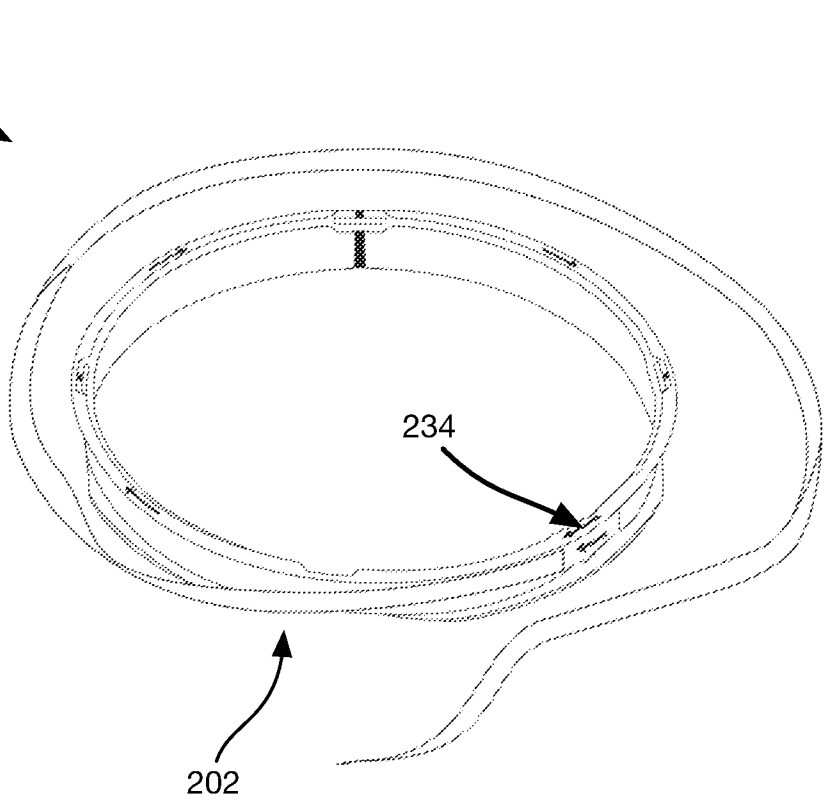
FIGS. 9 and 10 show the steps of winding ribbon on a spool for an exemplary accessory for a sewing machine.
Figure 9:
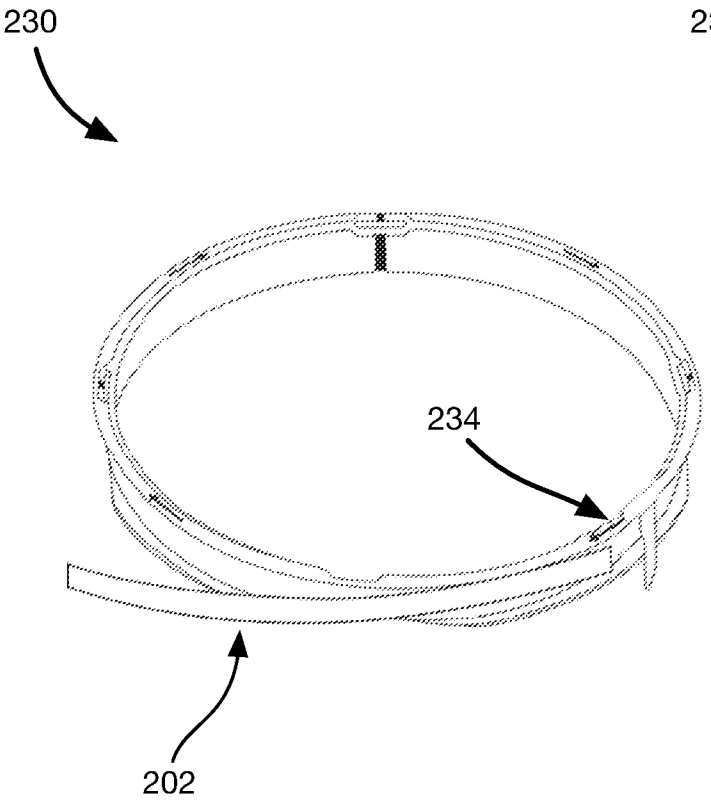

Referring now to FIGS. 9 and 10, the steps for loading embroidery material 202, such as the ribbon shown, onto the spool 230 are shown. First, an end of the embroidery material 202 is inserted into a retaining or ribbon clip 234 that is closed to firmly attach the embroidery material 202 to the spool 230. The embroidery material 202 is then wound around the spool 230. Once the spool 230 has been filled with material 202, the spool retainer 232 (e.g., FIG. 8) is raised, the spool 230 is inserted into the support 210, and the spool retainer 232 is lowered into the retaining position.

Figure 11:
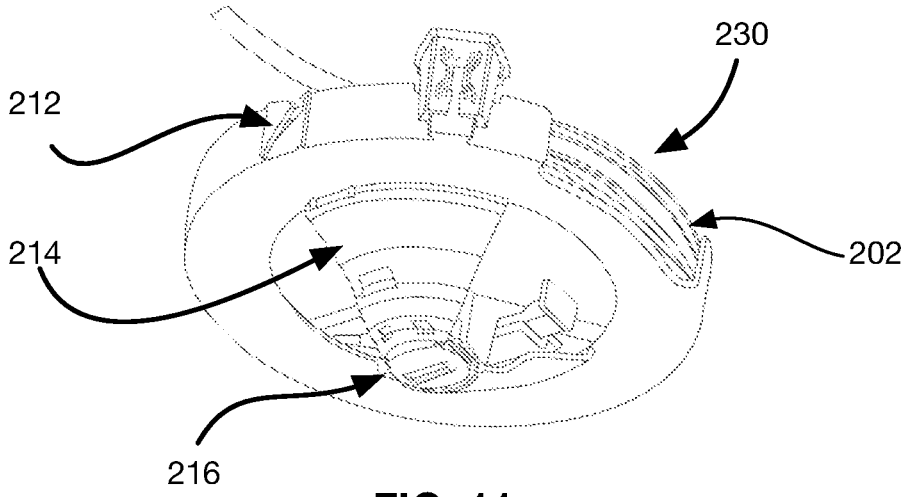
FIGS. 11-13 show the steps of threading ribbon through guides of an exemplary accessory for a sewing machine.
Figure 12:
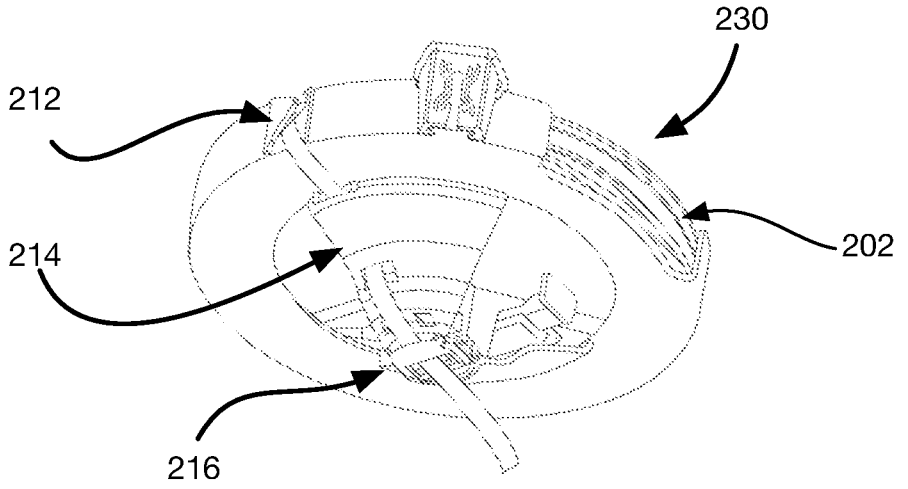
Figure 13:
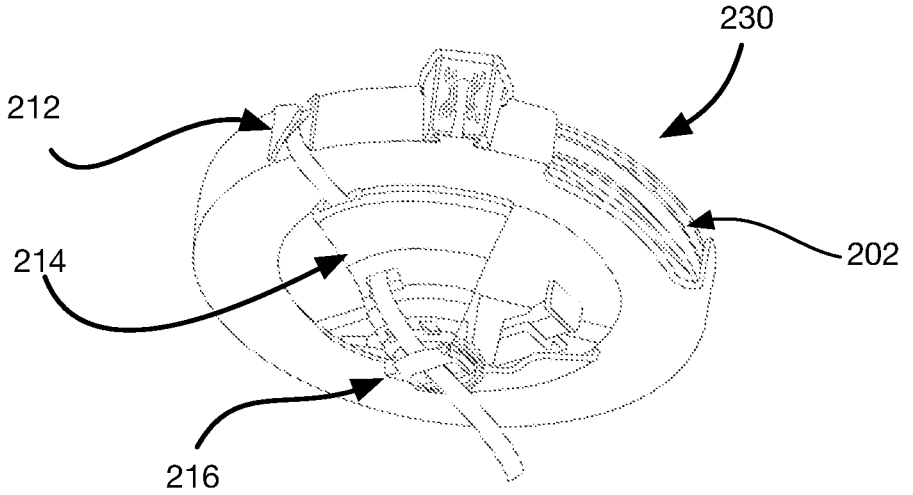
Figure 15:
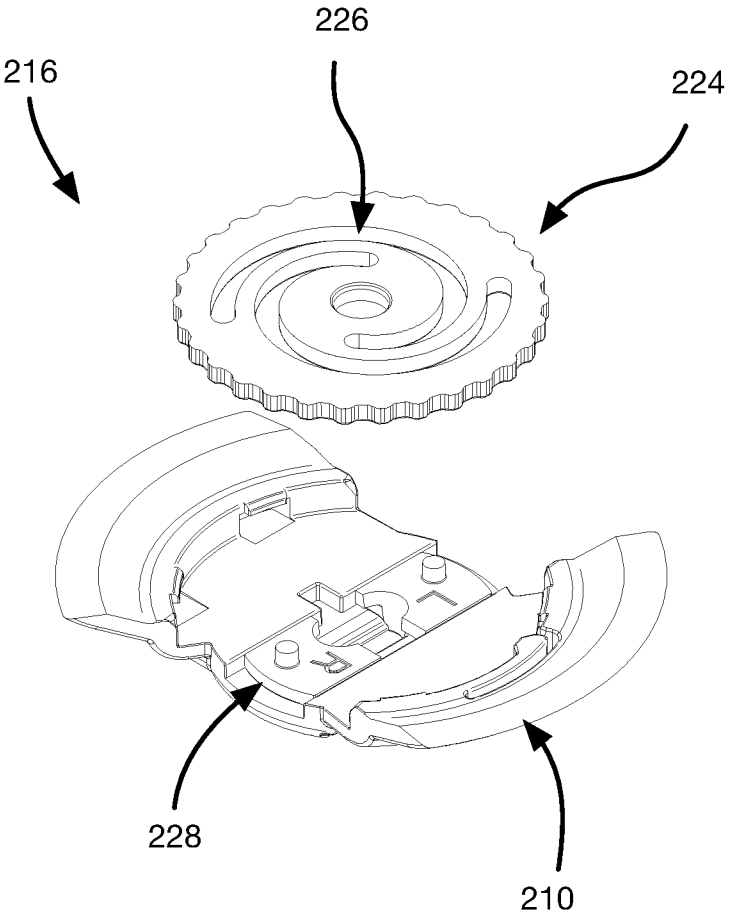
FIG. 15 shows a top perspective exploded view of the sewing guide of FIG. 15.
Figure 14:
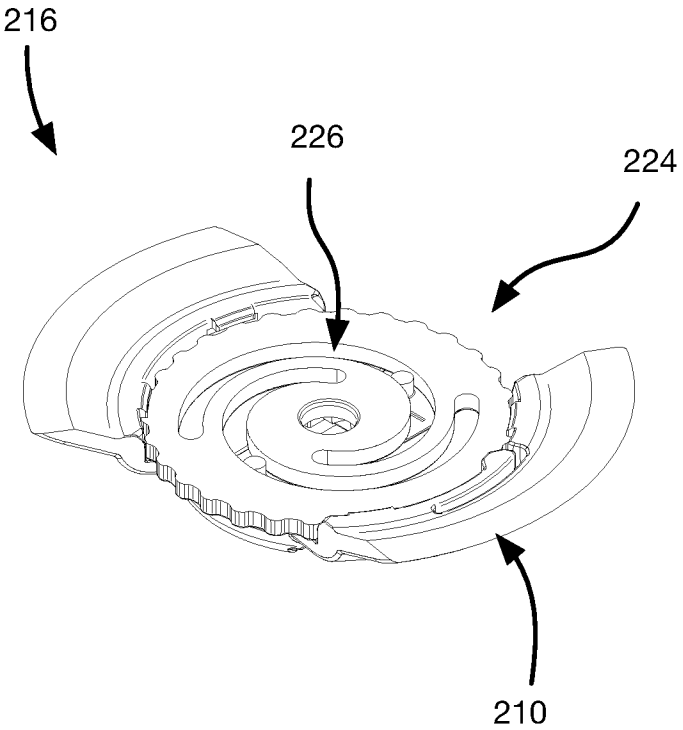
FIG. 14 shows an enlarged perspective view of a sewing guide for an exemplary accessory for a sewing machine with a portion of the adjusting knob cut away.
Figure 17:
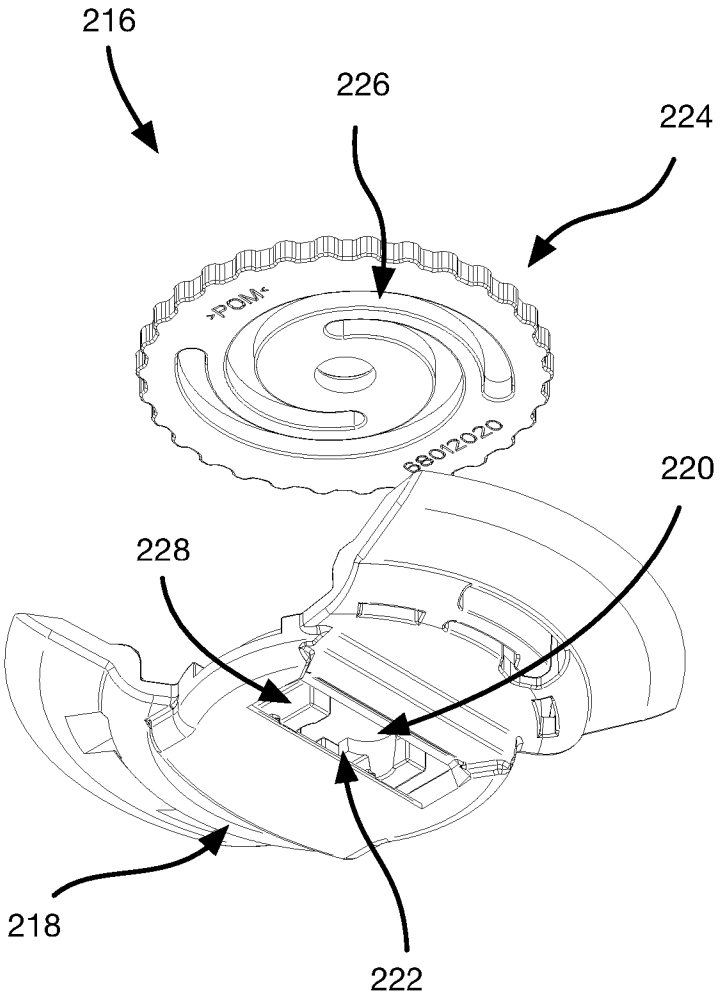
FIGS. 16-17 show bottom perspective exploded views of the sewing guide of FIG. 15.
Figure 16:
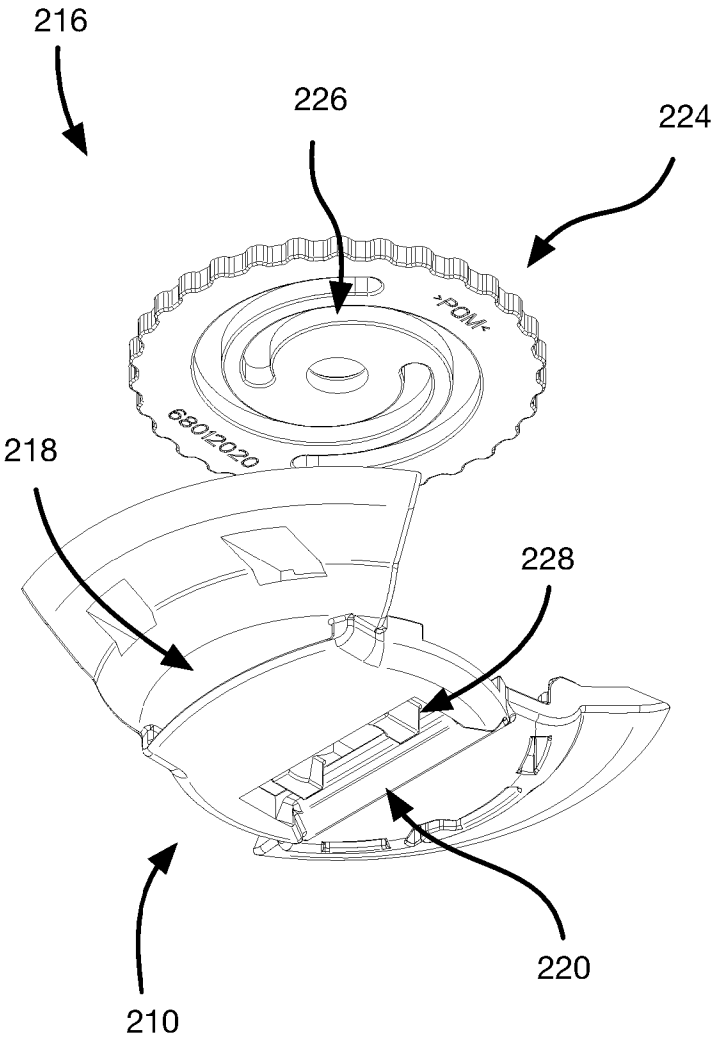

Once the full spool 230 has been installed in the accessory 200, the embroidery material 202 can be routed or threaded through the dispensing, auxiliary, and sewing guides 212, 214, 216 to prepare the accessory 200 for use, as is shown in FIGS. 11-13. The embroidery material 202 is first fed through the dispensing guide 212, then through any additional or auxiliary guides 214, and then through the sewing guide 216. In an embodiment with an adjustable sewing guide, the sewing guide 216 is also adjusted to match the width of the embroidery material 202.

Referring now to FIGS. 14-17, the mechanism for adjusting the width of the path between the ribbon guides or guide members 228 of the sewing guide 216 is shown. The sewing guide 216 includes an adjusting knob 224 that is shown in FIGS. 14-17 without a top portion to reveal guide grooves 226 that engage with protrusions extending from the guide members 228. The guide members 228 are inserted in a groove in the support 210 that extends transverse to the path of the embroidery material. The guide grooves 226 are spiral shaped so that rotating the adjusting knob 224 causes the protrusions of the guide members 228 to move the guide members 228 laterally within the transverse groove, thereby increasing or decreasing a distance between the guide members 228 to accommodate different sized embroidery material. Each of the guide members 228 includes a semi-circle cutout that together form a needle opening 222. The needle opening 222 provides clearance for the needle so that the sewing guide 216 does not interfere with the sewing needle when the sewing guide 216 is in a fully closed condition. Embroidery material enters the sewing guide 216 at an entrance 218 on one side and exits the sewing guide from an exit 220 on another side. The exit 220 of the sewing guide 216 is open on the bottom so that the sewing guide 216 does not interfere with the embroidery material that is attached to the workpiece after sewing.

Figure 18:
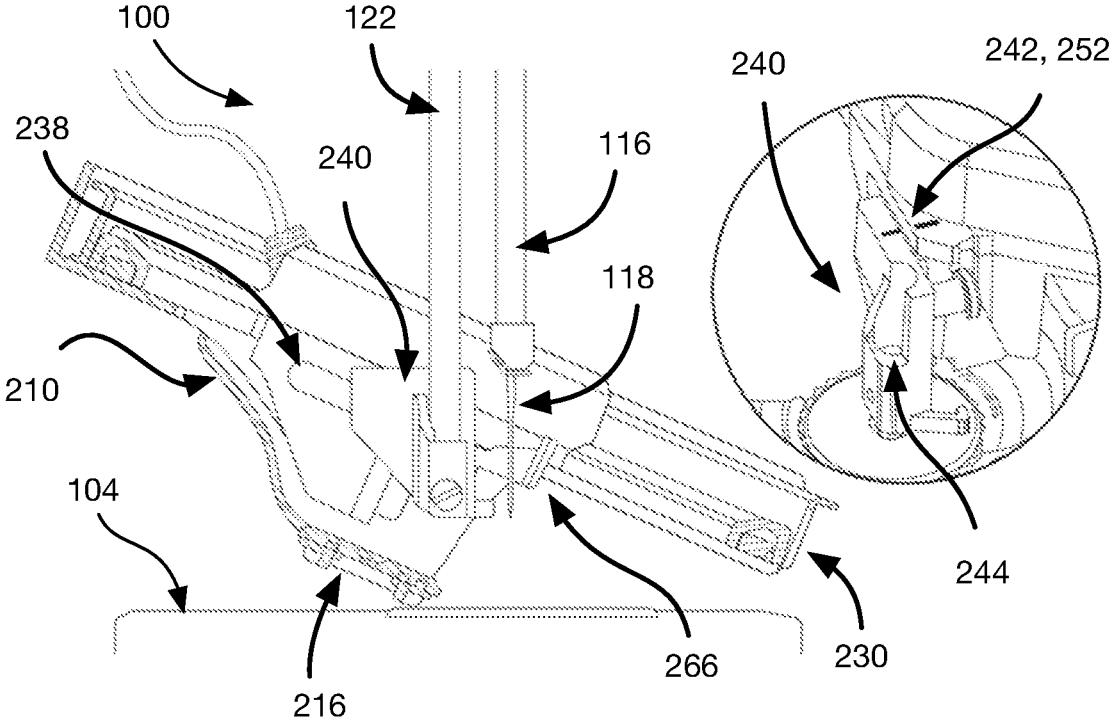
FIG. 18 shows a side cutaway view of an exemplary accessory for a sewing machine being tilted.
Figure 19:
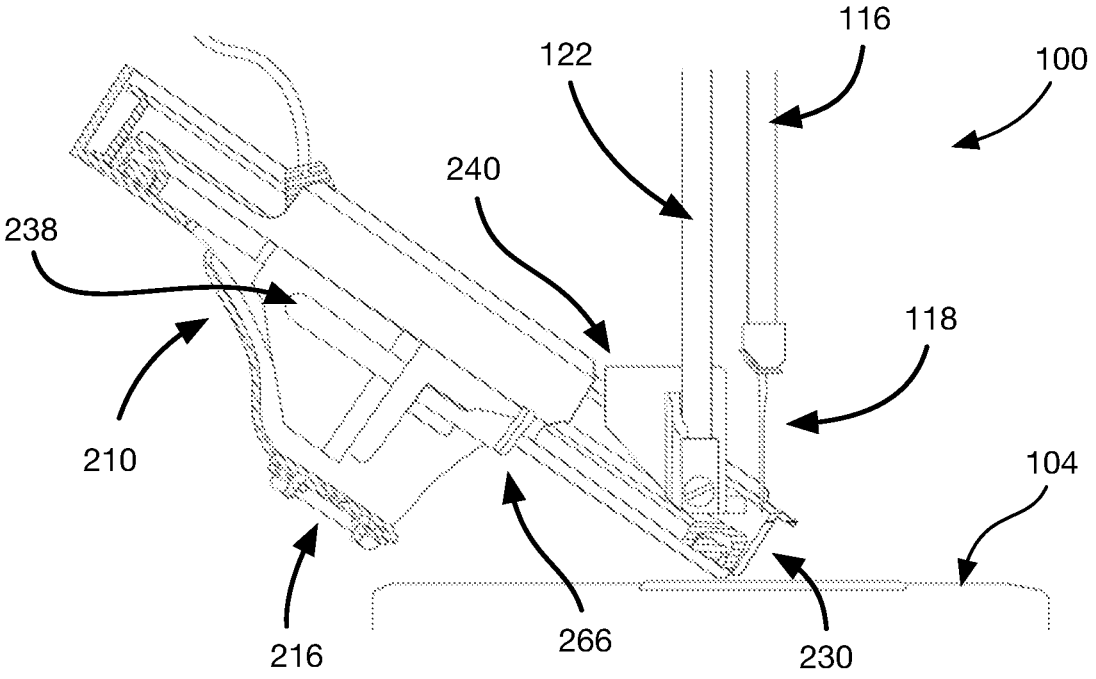
FIG. 19 shows a side cutaway view of an exemplary accessory for a sewing machine being tilted and removed.
Figure 21:
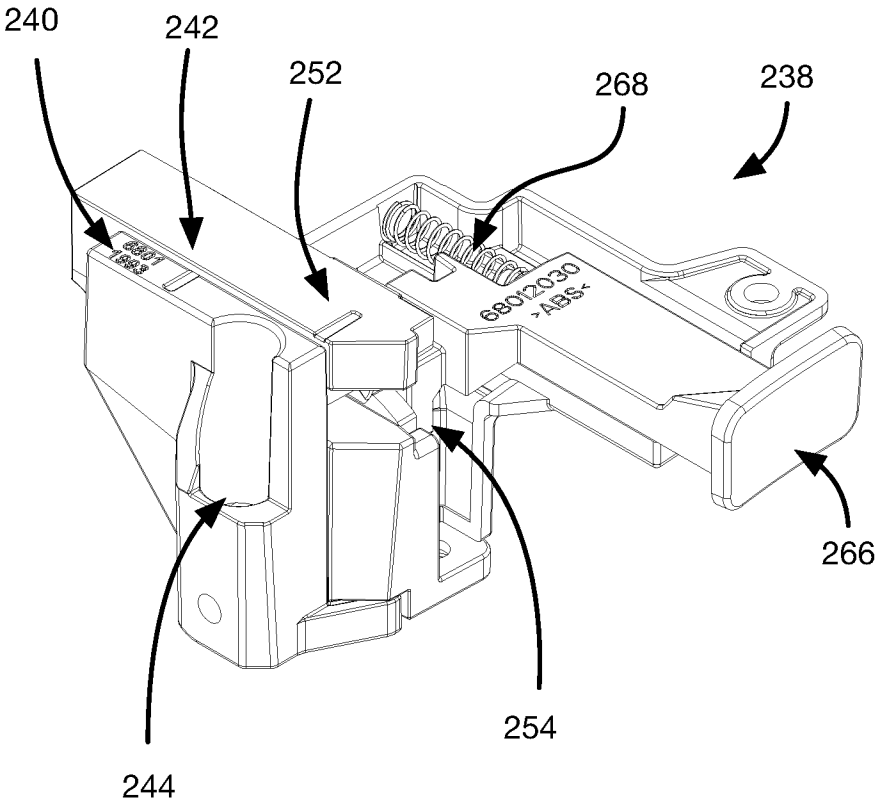
FIG. 21 shows a rear perspective view of the attachment mechanism of FIG. 20.
Figure 20:
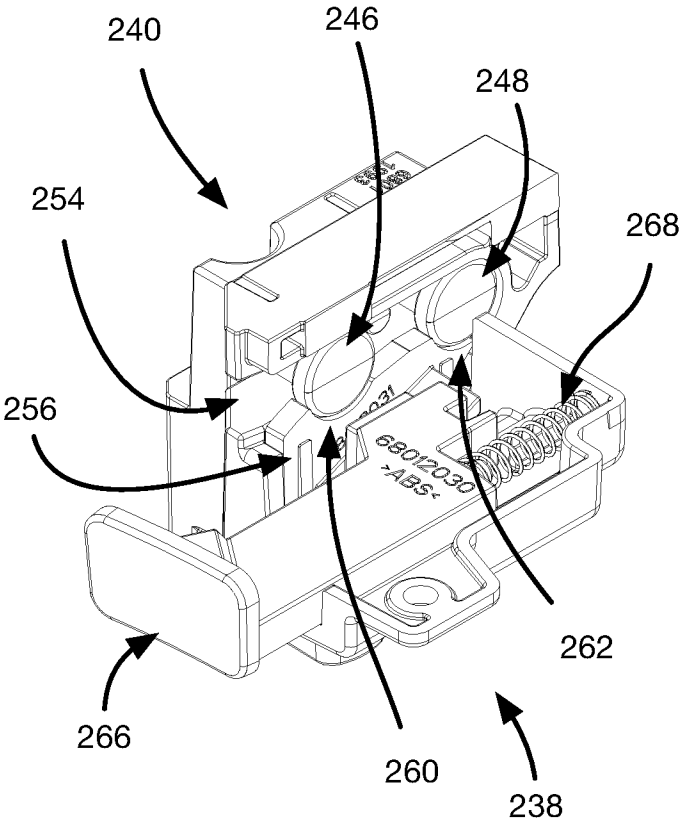
FIG. 20 shows a front perspective view of an attachment mechanism for attaching an exemplary accessory to a sewing machine.
Figure 23:
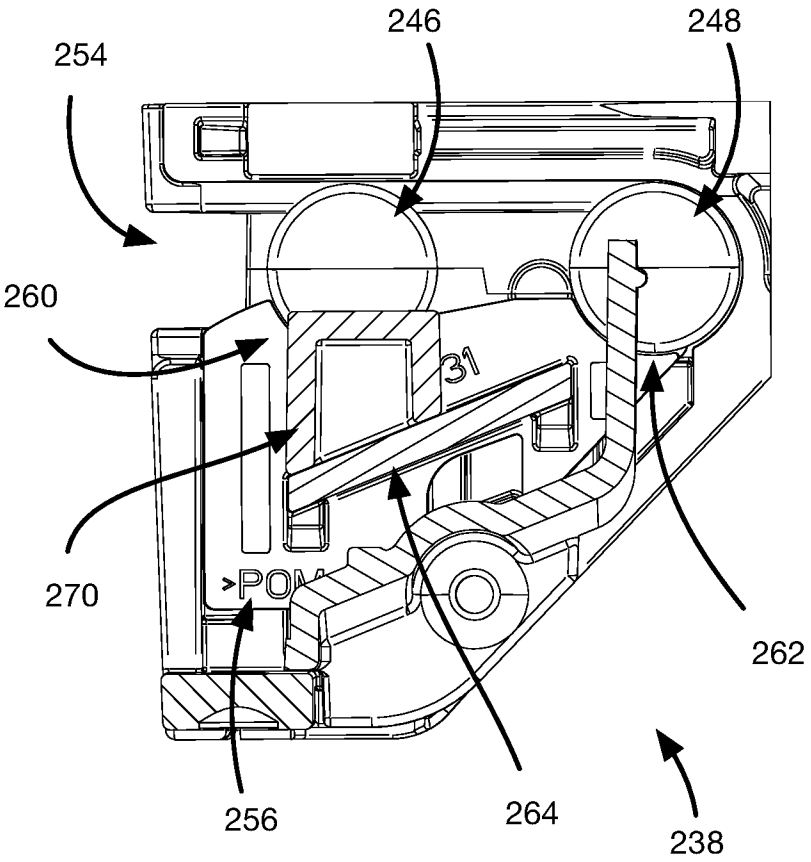
FIG. 23 shows a cross-sectional view of the attachment mechanism of FIG. 20 taken along the line 23-23 in FIG. 22.
Figure 22:
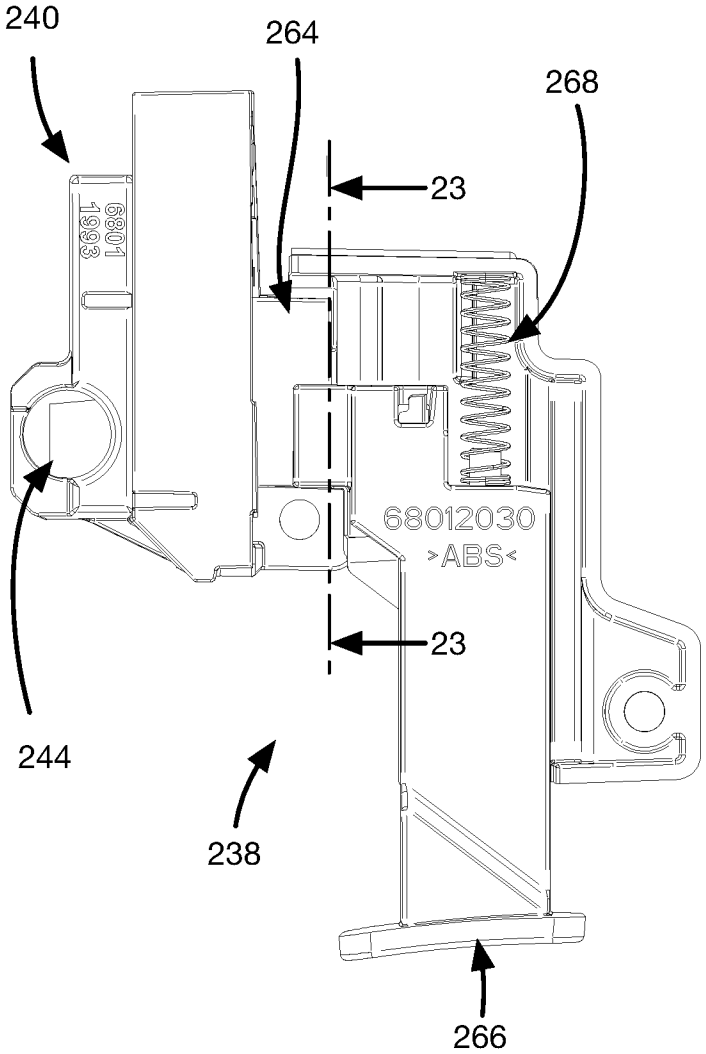
FIG. 22 shows a top view of the attachment mechanism of FIG. 20.
Figure 24:
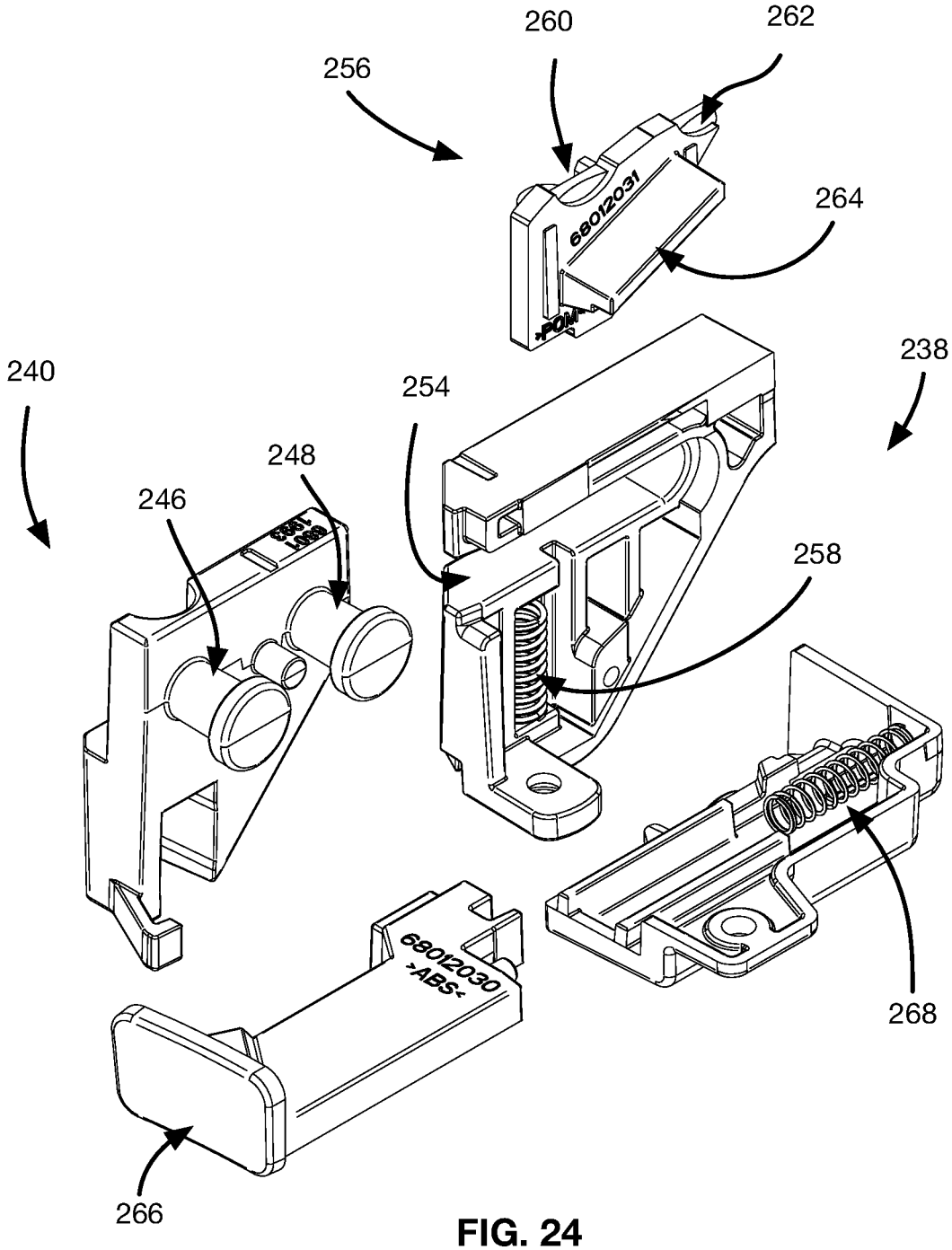
FIG. 24 shows a perspective exploded view of the attachment mechanism of FIG. 20.
Figure 25:
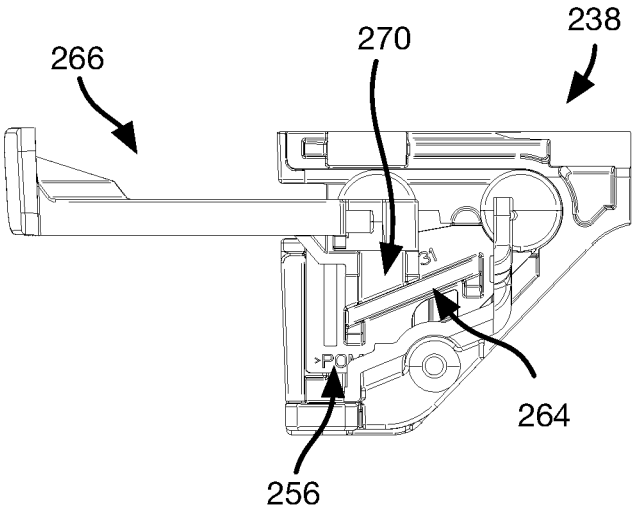
FIGS. 25-34 show views of the attachment mechanism of FIG. 20 being articulated from latched to tilted and to released conditions.
Figure 26:
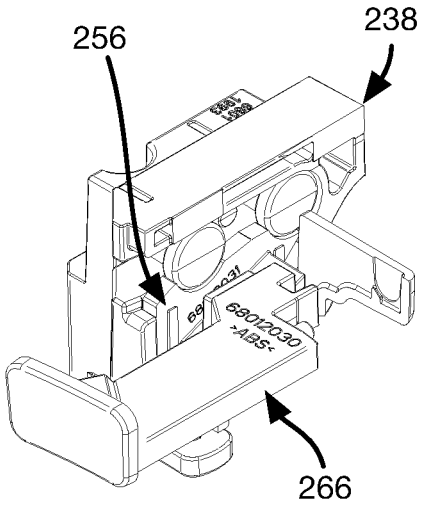

Referring now to FIGS. 18 and 19, partial cutaway views of the accessory 200 are shown in tilted and removed conditions, respectively. The accessory 200 is moved into the tilted condition to enable the user to remove and replace the needle 118 of the sewing machine 100 without fully removing the accessory 200 from the sewing machine 100. To tilt the accessory 200, the release 266 of the attachment portion 238 is pressed and the accessory 200 is moved rearward until the tilt alignment mark 252 on the attachment portion 238 and the tilt alignment mark 242 on the attachment holder 240 are aligned. The accessory 200 can then be tilted forward to provide access to the needle bar 116 and needle 118. To return the accessory 200 to the installed position, the user tilts the accessory 200 back until the accessory 200 is level and then pulls the accessory 200 forward until the attachment portion 238 clicks back into place.

Removing the accessory 200 from the sewing machine 100 is similar. The release 266 is pressed to disengage the latch 256 of the attachment portion 238 and the accessory 200 is moved backward until the attachment portion 238 is entirely separated from the attachment holder 240 that is attached to the accessory mount 122 of the sewing machine 100. The accessory 200 is then tilted forward so that the front edge of the support 210 and spool 230 can pass beneath the needle 118.

Referring now to FIGS. 20-34, the mechanism that attaches the accessory 200 to the sewing machine 100 and also enables the tilting and removal of the accessory 200 is shown. The attachment portion 238 attaches to the attachment holder 240 and includes the latch 256 and the release 266. The attachment holder 240 includes first and second posts 246, 248 that are received in an attachment interface slot 254 of the attachment portion 238. The latch 256 includes first and second latch recesses 260, 262 for receiving the first and second posts 246, 248. In a fully installed condition, both the first and second posts 246, 248 are secured within the attachment interface slot 254 by the latch 256. In a tilted position, only the second post 248 is secured within the attachment interface slot 254 by the latch 256. Inclined portions of the latch 256 lead up to the first recess 260 and between the first and second recesses 260, 262 to enable the first and second posts 246, 248 to push the latch 256 out of the way when the first and second posts 246, 248 are inserted into the attachment interface slot 254 so that the release 266 does not need to be pressed to attach the accessory 200 to the attachment holder 240.

Figure 27:
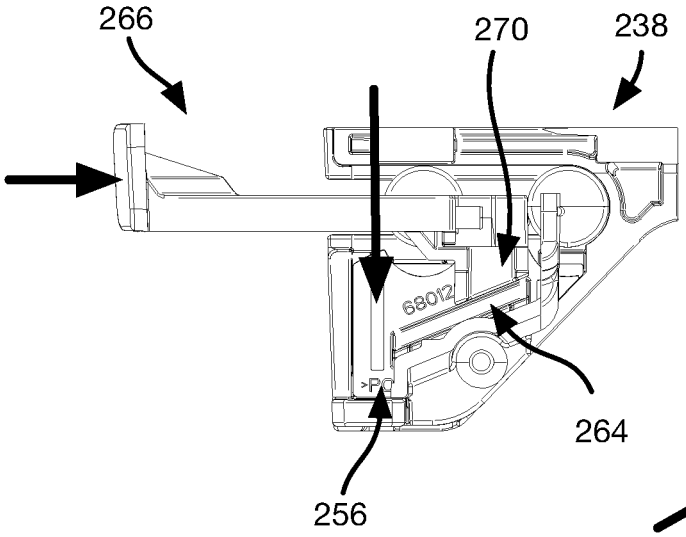
Figure 28:
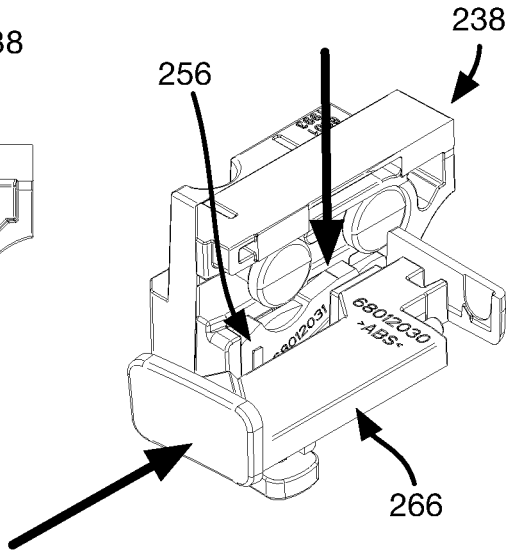
Figure 29:
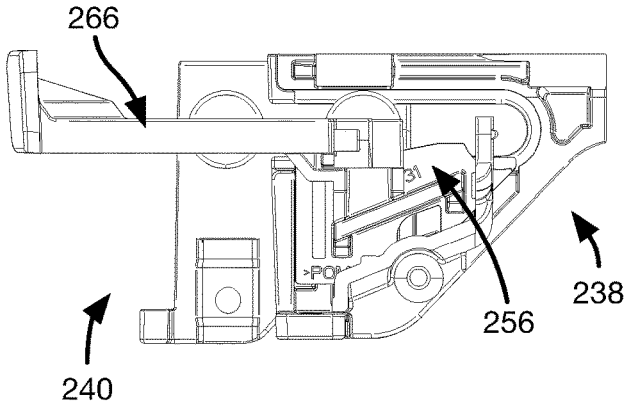
Figure 30:
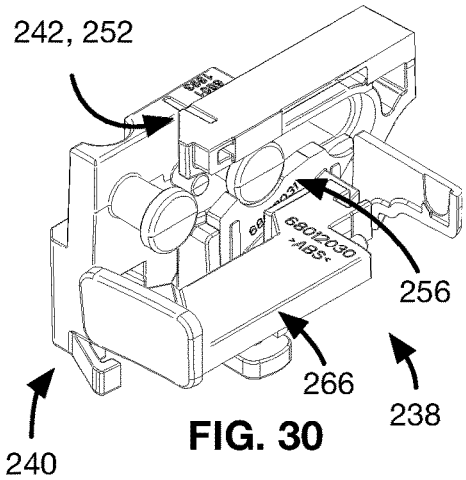
Figure 31:
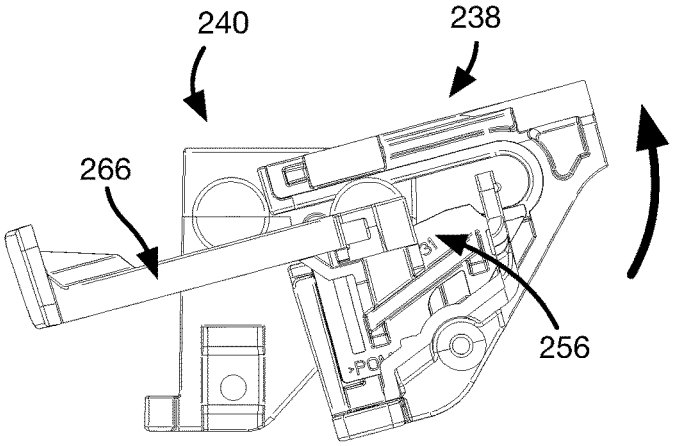
Figure 32:
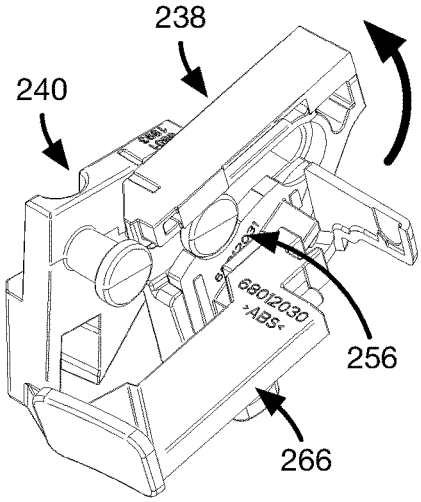
Figure 33:
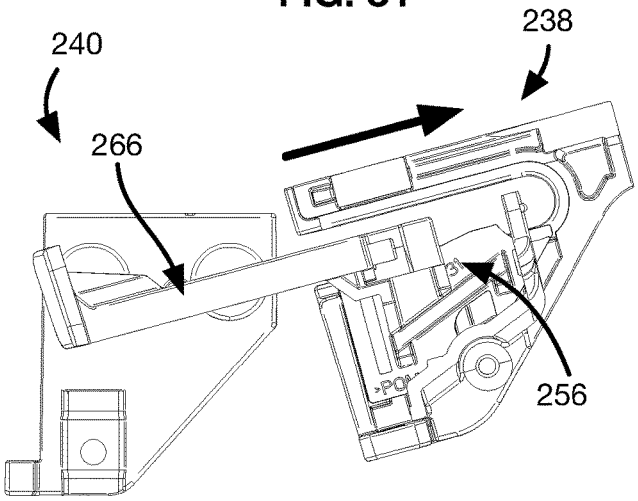
Figure 34:
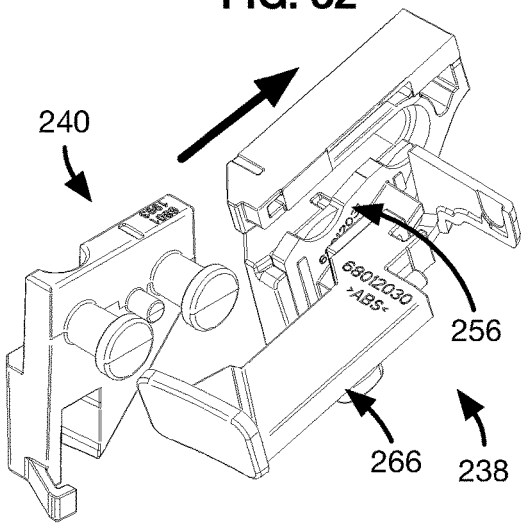

The latch 256 moves vertically within a groove of the attachment portion 238 and is biased toward a closed position by a latch spring 258 that lifts the latch 258 upward toward the attachment interface slot 254. The release 266 is moveable horizontally within a groove of the attachment portion 238 and is biased outward to a disengaged position by a release spring 268. The cross-sectional view of the attachment portion 238 shown in FIG. 23 reveals that the release 266 includes a ramp 270 that engages a ramp 264 of the latch 256 to facilitate opening of the latch 256. Pressing the release 266 inward, as shown in FIGS. 27 and 28, moves the release ramp 270 horizontally against the latch ramp 264, thereby causing the latch 256 to move vertically away from the attachment interface slot 254 and the first and second posts 246, 248 of the attachment holder 240 to release the attachment portion 238 from the attachment holder 240. The accessory 200 can then be moved backward and tilted into the tilted position by pivoting the accessory around the second post 248 (FIGS. 31-32) or fully removed by maintaining the latch 256 in an open position and moving the accessory 200 backward (FIGS. 33-34).

The compact size of the accessory 200 is achieved by arranging the spool 230, support 210, and mechanism 280 for rotating the support 210 in a vertically overlapping manner. For example, the first axis of rotation 204 is parallel to the second axis of rotation 206 and the top surface of the spool 230 is below a top surface of the support 210 and a bottom surface of the spool 230 is above a bottom surface of the support 210. Similarly, the mechanism 280 can be arranged entirely between the top and bottom surfaces of the support 210 or can be positioned so that most or nearly all of the motor of the mechanism 280 is between the top and bottom surfaces of the support 210. Thus, the accessory 200 can be used with a home sewing machine that has an arm height 114 that can be as low as 3 to 6 inches above the sewing bed 104.

During operation of the accessory 200, embroidery material is supplied from the spool 230 that is supported by the support 210. The spool 230 is not fixed to the rotating support 210 so that the spool 230 can rotate freely with respect to the support 210. As embroidery material is dispensed and sewn onto a sewing article (not shown), tension between the embroidery material attached to the cloth workpiece and the embroidery material remaining in the spool 230 causes the spool 230 to rotate in a dispensing direction 231 (FIGS. 3 and 6-7) to dispense more embroidery material for sewing. Because the spool 230 is supported by the support 210, tension forces along the embroidery material are not transmitted to the attachment portion 238 and therefore do not act against or in favor of the rotation of the support 210 nor can these forces push the sewing guide 216 out of alignment with the needle 118.

The sewing machine 100 includes a controller (not shown) that sends signals to the one or more actuators to move the embroidery frame and also that sends signals to the mechanism 280 to control the rotation of the support 210 of the accessory 200 to rotate the support 210 in either a clockwise or counterclockwise direction so that the embroidery material opening 218 of the sewing guide 216 leads the needle opening 222 along the sewing path of the embroidery pattern being sewn by the sewing machine 100. That is, the embroidery frame moves the workpiece relative to the needle 118 so that, while the needle 118 and the accessory 200 are stationary relative to the sewing machine 100, the needle 118 and accessory 200 are moving relative to the workpiece. Thus, relative to the workpiece, the needle 118 traces out a sewing path along the workpiece and the sewing guide 216 is rotated to be in front of the needle 118 along the path traced out by the needle 118. In other words, the support 210 and sewing guide 216 leads embroidery material to the workpiece and under the needle or needles 118, while the embroidery frame mount is moved by the sewing machine 100 to ensure that the embroidery design is followed correctly. While the support 210 can be rotated in either direction, as indicated by the double ended arrow 211, the spool 230 only rotates in the dispensing direction 231 as embroidery material is dispensed.

An exemplary method of operating an accessory 200 for a sewing machine to attach a length of embroidery material to a workpiece includes the steps of: providing the sewing machine and accessory, moving the workpiece so that the needle of the sewing machine follows a predetermined sewing path, rotating the support so that the embroidery material opening leads the needle along the predetermined sewing path, dispensing at least a portion of the length of embroidery through the embroidery material opening of the guide, and sewing at least a portion of the length of the embroidery material to the workpiece with the needle. The accessory includes a support that can be rotatably attached to the sewing machine, a guide attached to the support, a spool rotatably attached to the support and that is rotatable about a first axis of rotation, and a mechanism that rotates the support about a second axis of rotation. The mechanism can be controlled by the sewing machine. The second axis of rotation is parallel to the first axis of rotation. The guide includes a needle opening for a needle of the sewing machine to pass through and an embroidery material opening spaced apart from the needle opening.

Figure 36:
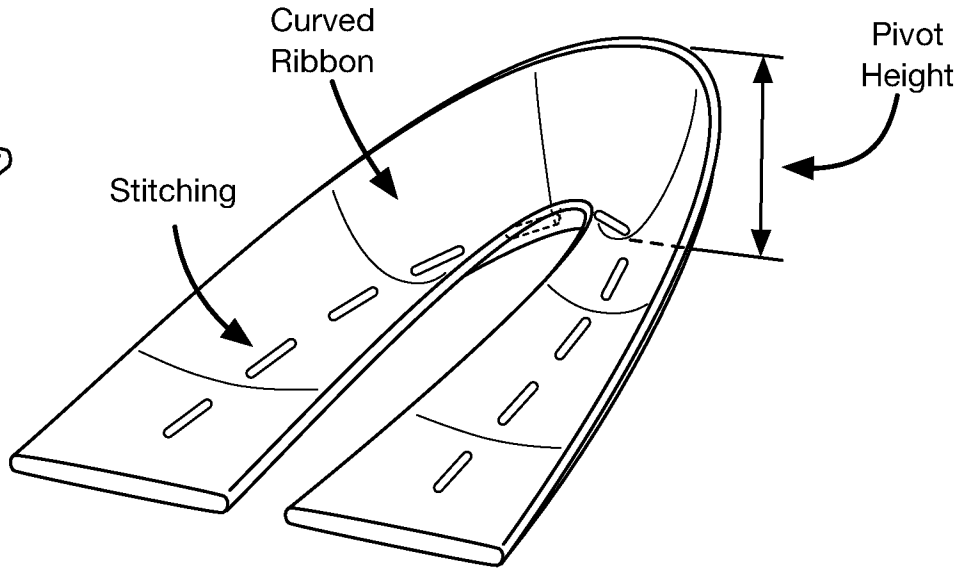
FIGS. 35 and 36 show perspective views of ribbons sewn on straight and curved paths.
Figure 35:
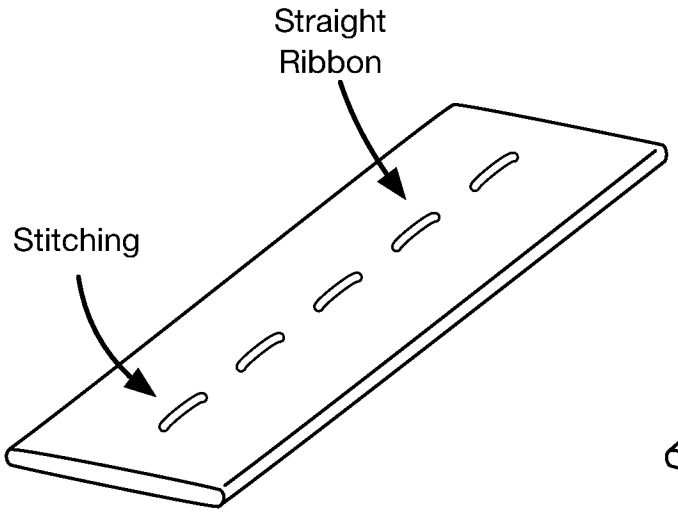
Figure 37:
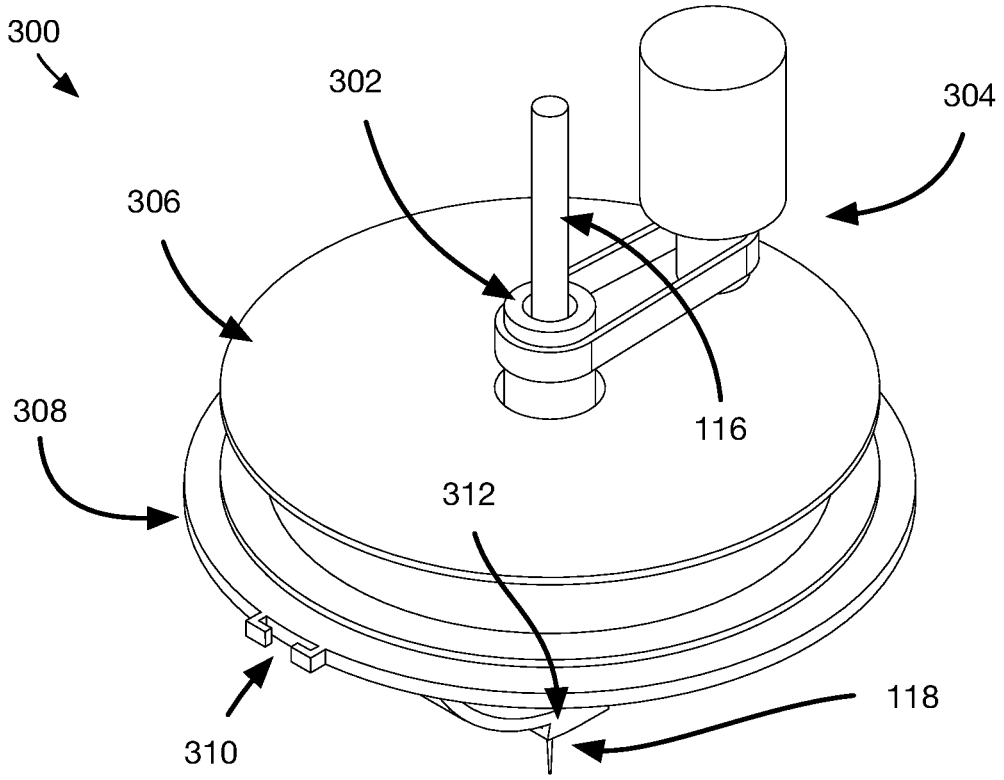
FIG. 37 is a top perspective view of an exemplary embodiment of an accessory for a sewing machine.
Figure 38:
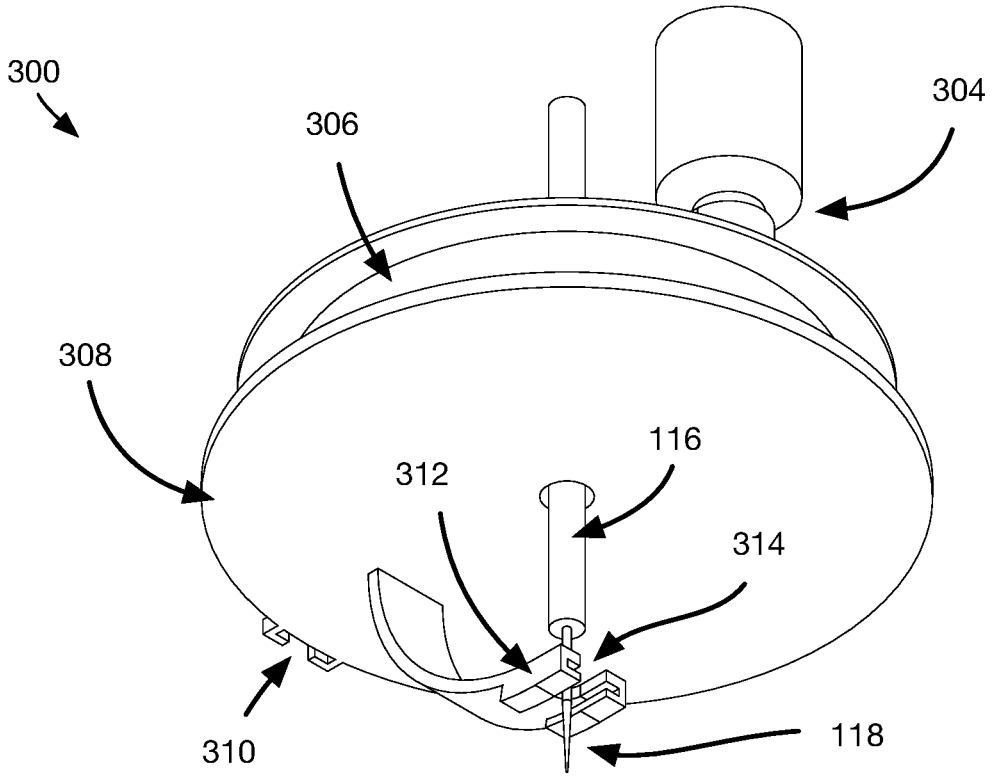
FIG. 38 is a bottom perspective view of the accessory of FIG. 37.
Figure 41:
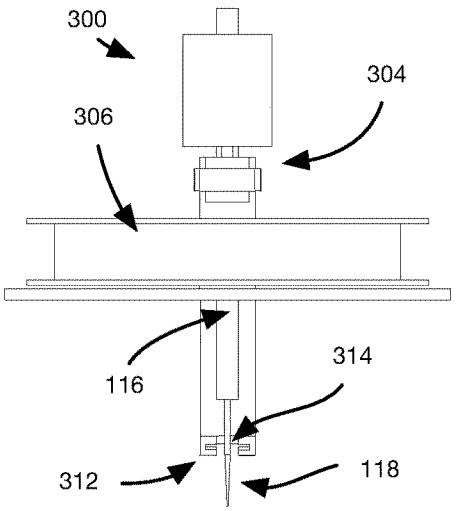
FIG. 41 is a right side view of the accessory of FIG. 37.
Figure 39:
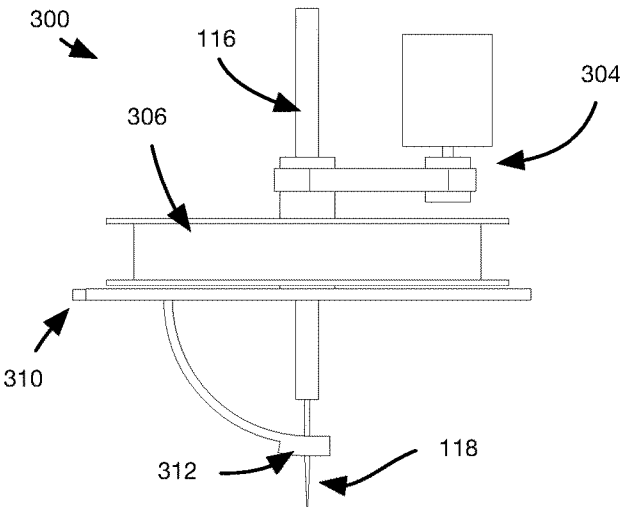
FIG. 39 is a front view of the accessory of FIG. 37.
Figure 40:
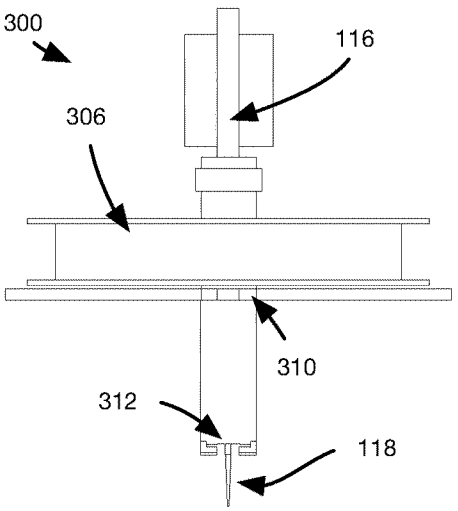
FIG. 40 is a left side view of the accessory of FIG. 37.
Figure 43:
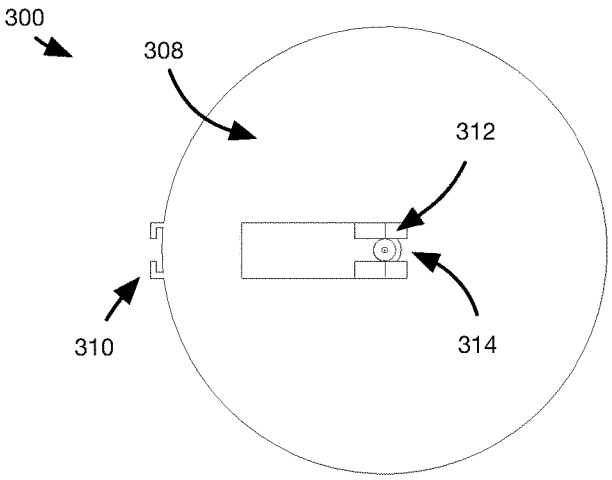
FIG. 43 is a bottom view of the accessory of FIG. 37.
Figure 42:
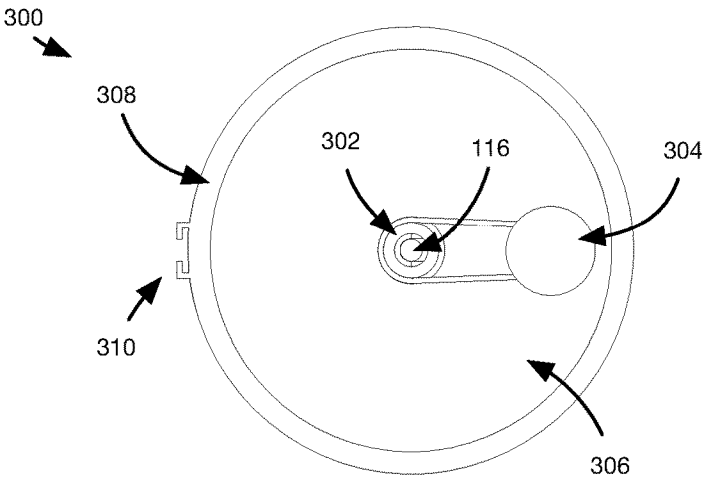
FIG. 42 is a top view of the accessory of FIG. 37.

Referring now to FIGS. 35 and 36, embroidery material—in this case, ribbon—is shown attached to a cloth workpiece along straight and curved paths. When sewn on a straight path, the embroidery material tends to lay flat against the cloth while the embroidery material sewn along the curved path tends to kink or pucker so that the edges of the embroidery material pivot away from the cloth and give the embroidery material a three-dimensional visual effect. The extent of this pivoting can be controlled to produce a wide variety of visual effect by changing the radius of the curved path and the width of the embroidery material. To accommodate various heights of the curved embroidery material, the accessory 200 is spaced apart from the cloth workpiece. In particular, the accessory 200 is spaced apart from the cloth by a pivot height that is greater for wider embroidery materials. The pivot height is set by lowering the accessory 200 to touch the cloth to establish a zero position and then raising the accessory 200 to the desired position. The zero position calibration operation is performed only when the sewing machine is not sewing so that the accessory 200 does not interfere with the movement of the workpiece and embroidery material.

Referring now to FIGS. 37-43, an exemplary accessory 300 for a sewing machine 100 is shown. The accessory 300 is similar in function to the accessory 200 described above and enables dispensing and attachment of an embroidery material to a cloth workpiece during a sewing or embroidery operation. The accessory 300 includes a support 308 that is rotatably attached to the sewing machine (not shown) via an attachment portion 302. The support 308 has a tubular center portion that fits around the needle bar 116 of the sewing machine so that the support 308 rotates around the needle bar 116 during operation. The support 308 is rotated by a rotation mechanism 304 that includes a belt or gear or other suitable means for rotating the support 308 relative to the sewing machine. A spool 306 rests on and rotates relative to the support 308. In some embodiments the rotation mechanism 304 is attached to and rotates with the support and can be arranged above, below, or within a central opening of the spool 306. Embroidery material is drawn from the spool 306, through a dispensing guide 310 and a sewing guide 312 that are each attached to the support 308. The sewing guide 312 includes a needle opening 314 so that the needle 118 can attach the embroidery material to the workpiece.

Referring now to FIGS. 44-65, an exemplary accessory 400 with interchangeable guides for use with a sewing machine, such as the sewing machine 100, is shown. The accessory 400 differs from the accessories 200, 300 described above in that various guides can be removed from the rotating support to facilitate the embroidery of various materials, such as, for example, ribbon, cord, yarn, or strings of beads, pearls, or the like. Two guides are described in detail below: a ribbon guide for dispensing wider and/or flatter materials; and a cord guide for dispensing narrower and/or thicker materials, such as strings of beads, pearls, or the like, or cylindrical materials like yarn. While ribbon and cord guides are shown herein, the accessory 400 is capable of receiving a wide variety of guides and/or spools for dispensing lengths of material for embroidery onto a workpiece. Additionally, a wide variety of other devices can be attached to the accessory to facilitate rotation of the attached device in combination with the translation of a workpiece via an embroidery frame or other holder that is moved by the embroidery frame mount 108. For example, a holder for pens, markers, brushes, or other marking implements could be attached to the accessory to enable drawing or painting on paper or on fabric.

Figure 44:
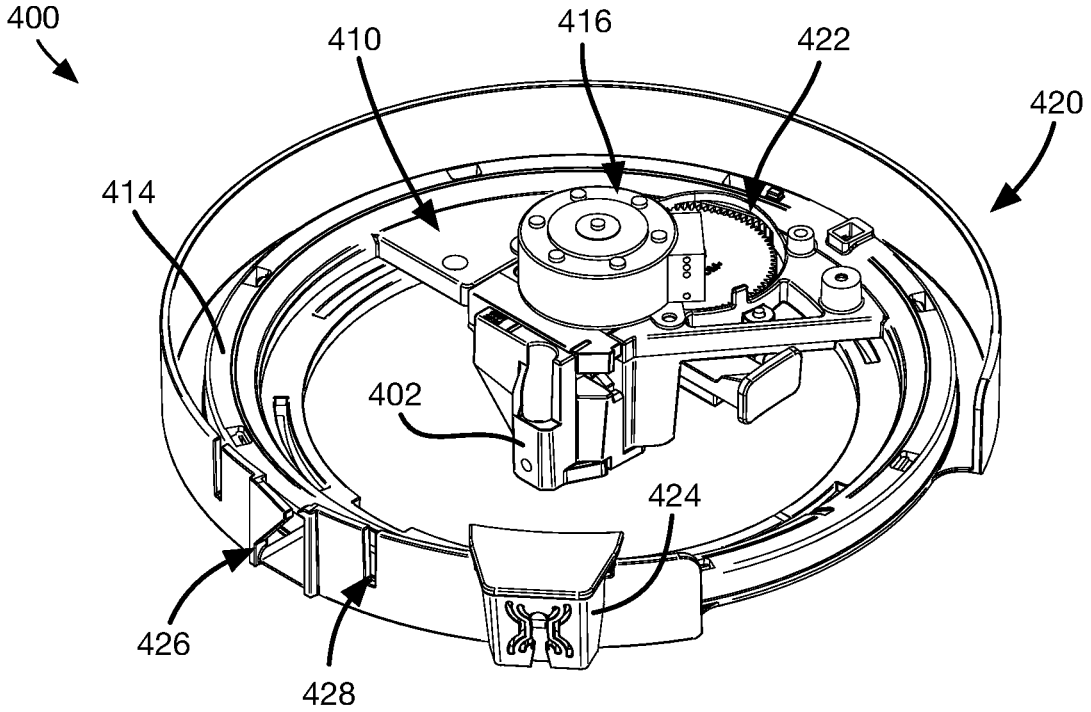
FIG. 44 is a top perspective view of an accessory of an exemplary embodiment of an accessory for a sewing machine.
Figure 45:
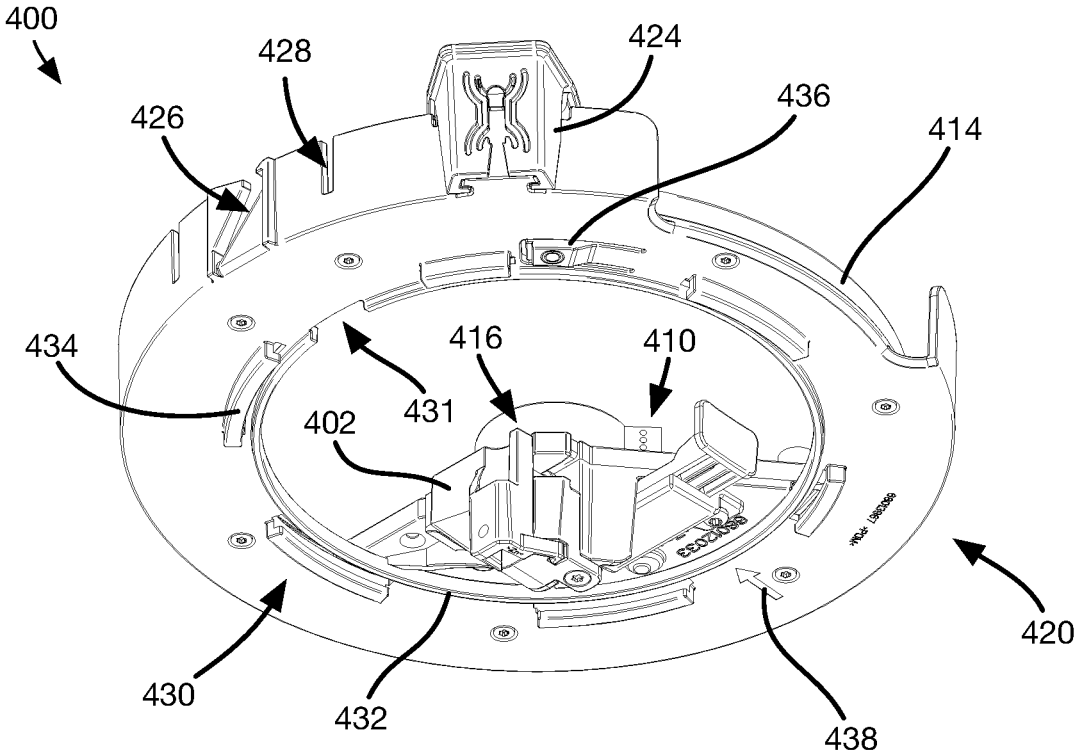
FIG. 45 is a bottom perspective view of the accessory of FIG. 44.

Referring now to FIGS. 44 and 45, the accessory 400 capable of receiving various interchangeable guides is shown. The accessory 400 includes a stationary support 410 and a rotating support 420. The stationary support 410 attaches the accessory 400 to the accessory mount 122 of the sewing machine 100. The rotating support 420 includes an interface portion 430 for receiving and attaching to interchangeable guides, such as a ribbon guide 440 and a cord guide 460. The rotating support 420 can also receive a ribbon spool 450 and a cord spool 470 for holding and dispensing lengths of ribbon and cord, respectively.

The stationary support 410 includes an attachment portion 412 that engages an attachment holder 402 that is attached to the accessory mount 122 of the sewing machine 100, like the attachment portion 238 and attachment holder 240 described above. The attachment portion 412 and attachment holder 402 are like the attachment portion 238 and attachment holder 240 described above and function in the same way to attach the accessory 400 to the sewing machine 100, respectively. For example, the attachment holder 402 can also include latch and release mechanisms that enable the accessory 400 to be tilted without releasing the accessory 400. Thus, the interaction of the attachment portion and holder 238, 240 shown in FIGS. 20-34 and described in greater detail above applies likewise for the attachment portion and holder 412, 402, respectively.

Like the accessory 200, the accessory 400 fits within the minimum arm height 114, which can range from about 3 inches to about 6 inches. The accessory 400 provides sufficient room around the needle bar 116 and needle so that normal sewing functions of the sewing machine 100 are not disrupted by the accessory 400. For example, sufficient space is provided for a needle threader 120 to thread the needle attached to the needle bar 116 without removing the accessory 400.

The stationary support 410 also includes a perimeter portion 414 and a drive mechanism 416. The rotating support 420 is attached to the stationary support 410 at the perimeter portion 414 and the rotating support 420 is caused to rotate by the drive mechanism 416 around a guide axis of rotation 404. The drive mechanism 416 can include a motor and a transmission and is capable of rotating the rotating support 420 clockwise and counterclockwise. The transmission can include one or more gears, belts, or the like arranged to transfer rotational motion from a motor to the rotating support 420. For example, the transmission can include a gear that engages a transmission portion of the rotating support 420, such as a ring gear 422 (see, e.g., FIGS. 44 and 48) attached to the rotating support 420. To save vertical space, the drive mechanism 416 is arranged in an interior of the stationary support 410 (and, if installed, the ribbon spool 450) so that at least a portion of the mechanism is arranged between a top surface and a bottom surface of the stationary support 410 (and, if installed, the ribbon spool 450).

The motor of the drive mechanism 416 receives power and control signals from the sewing machine via an electrical connection. The connection can be provided by a wire (not shown), like the wire 282 described above, that attaches between the accessory 400 and another portion of the sewing machine 100, such as the sewing arm 110. In some embodiments, power and data connections can be integrated into the attachment portion 402, attachment holder 412, and accessory mount 122 so that attaching the accessory 400 to the sewing machine 100 also provides an avenue for the transmission of power and control signals from the sewing machine 100 to the accessory 400.

The rotating support 420 includes the ring gear 422, a ribbon spool retainer 424, a ribbon dispensing guide 426, cord spool attachment portions 428, and a guide interface portion 430. The ring gear 422 is rotatably attached to the stationary support 410 and is configured to engage the transmission of the drive mechanism 416 to enable the drive mechanism to cause the rotatable support 420 to rotate. In particular, the rotating support 420 is suspended from the stationary support 410 by way of the engagement between the ring gear 422 and the stationary support 410.

The guide interface portion 430 is formed on the bottom surface of the rotating support 420 and is configured to receive the ribbon and cord guides 440, 460 that, when assembled to the rotating support 420, are suspended from the rotating support 420 and above the workpiece. The guide interface portion 430 surrounds a central opening of the rotating support 420, that is, the components of the interface portion 430 are arranged around the circumference of the central opening of the rotating support 420. The guide interface portion 430 can incorporate any suitable means for removably attaching the ribbon and cord guides 440, 460 to the rotating support 420, such as, for example, using threaded fasteners, quarter turn fasteners, magnets, re-usable adhesive, snaps, hook and loop fasteners, and the like.

The guide interface portion 430 includes an alignment portion 432, a plurality of retaining slots 434, a latch 436, and an alignment indicator 438. The alignment portion 432 is formed from a lip extending downward from and around the circumference of the central opening of the rotating guide 420. An opening 431 is provided in the alignment portion 432 to allow ribbon dispensed from the ribbon spool 450 and cord dispensed from the cord spool 470 to pass through the interface portion 430 that forms the connection between the rotating support 420 and the ribbon and cord guides 440, 460. The retaining slots 434 receive corresponding tabs 442, 462 of the ribbon and cord guides 440, 460, respectively, and the latch 436 captures a locking tab 444, 464 of the ribbon and cord guides 440, 460, respectively, against one of the retaining slots 434 to prohibit the rotation of the ribbon guide 440 or cord guide 460 relative to the rotating support 420. The alignment indicator 438 has an arrow shape and identifies an initial assembly orientation of the ribbon and cord guides 440, 460 relative to the rotating support 420. The steps to attach the ribbon guide 440 or the cord guide 460 to the rotating support 420 are described in further detail below.

Figure 46:
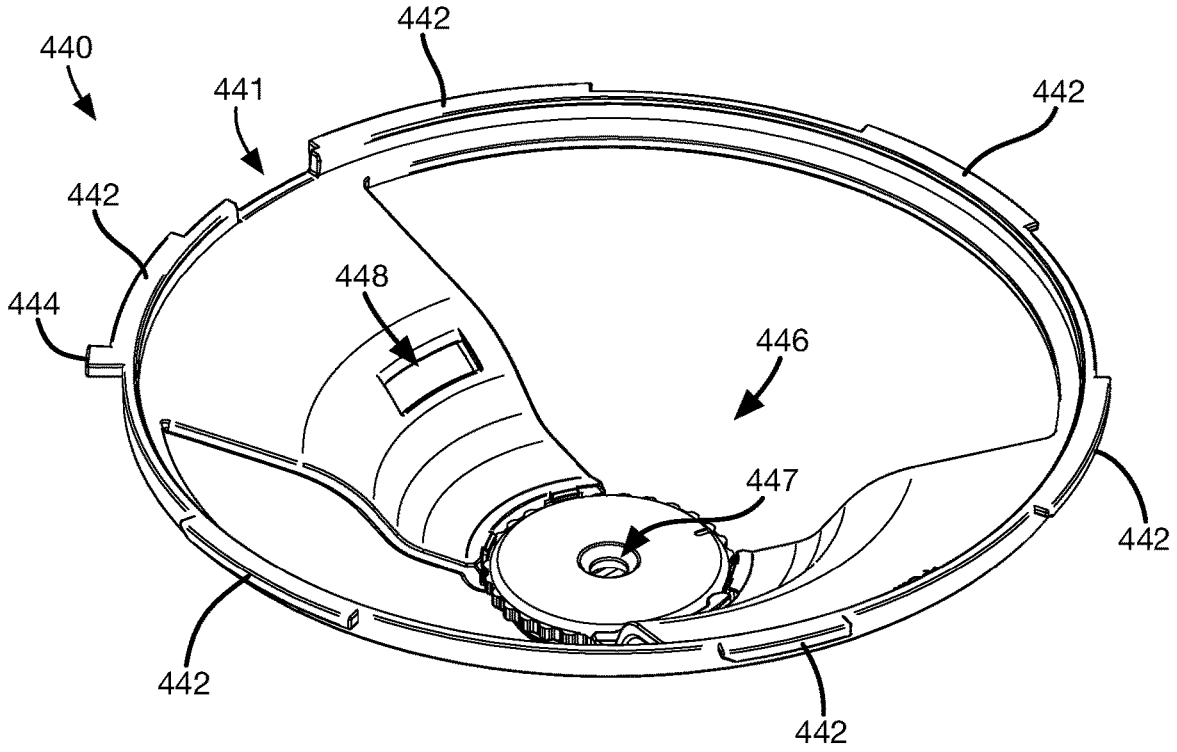
FIG. 46 is a top perspective view of the ribbon guide disassembled from the accessory of FIG. 44.
Figure 47:
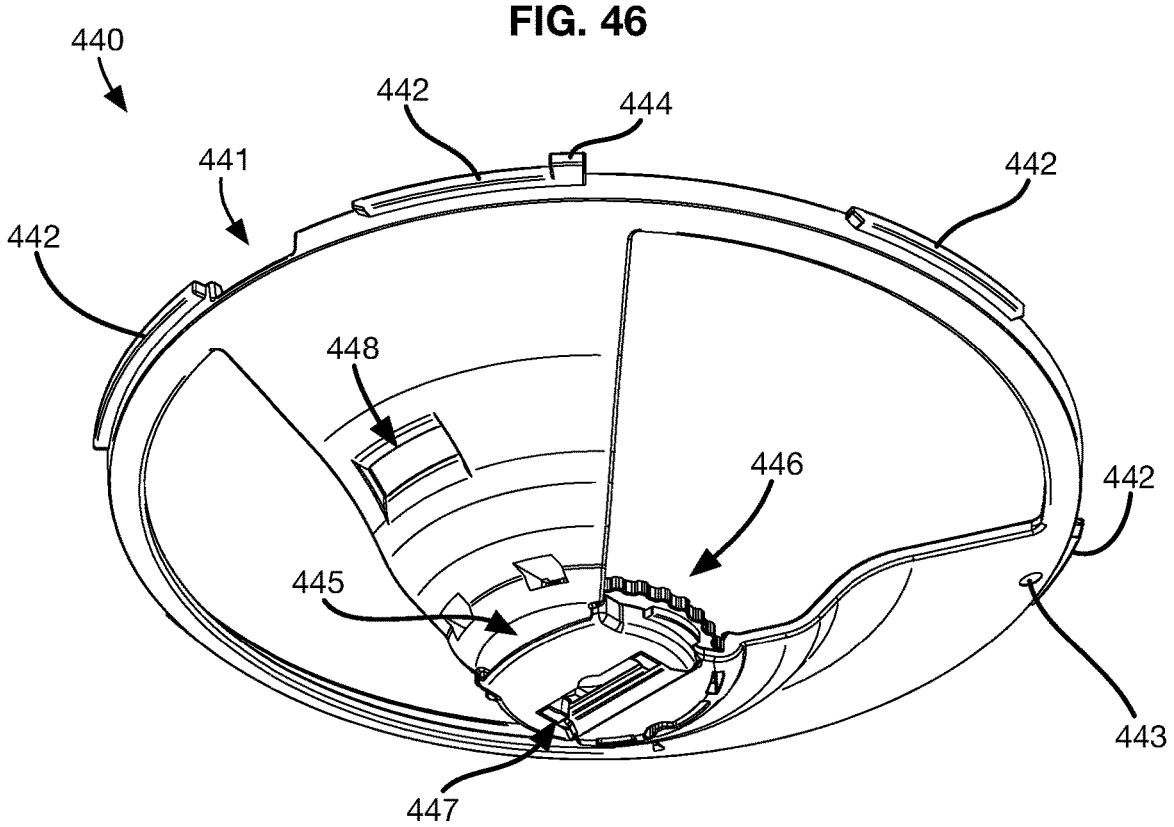
FIG. 47 is a bottom perspective view of the ribbon guide of FIG. 46.

Referring now to FIGS. 46 and 47, the ribbon guide 440 is shown disassembled from the accessory 400. Like the support 210 of the accessory 200 described above, the ribbon guide 440 has a roughly conical shape extending from a wider top or first end to a narrower bottom or second end. The ribbon guide 440 attaches to the interface portion 430 of the rotating support 420 via a plurality of retaining tabs 442 and is secured in an assembled condition by the locking tab 444 that engages the latch 436.

Figure 49:
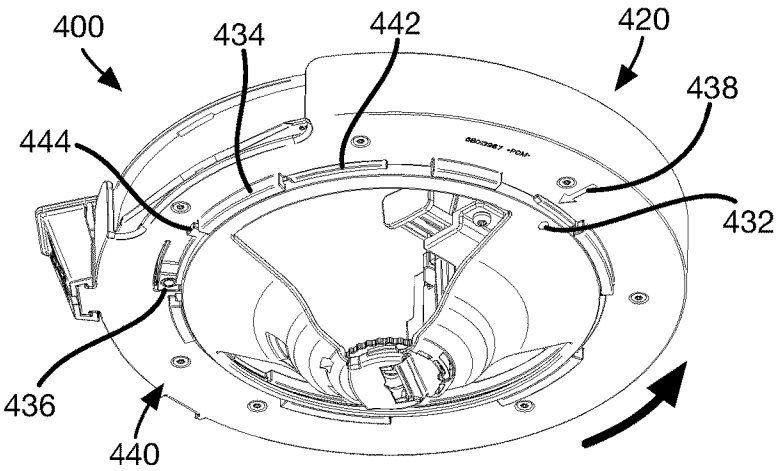
FIGS. 48-50 show the assembly of the ribbon guide of FIG. 48 with the accessory of FIG. 44 from a bottom perspective view.
Figure 50:
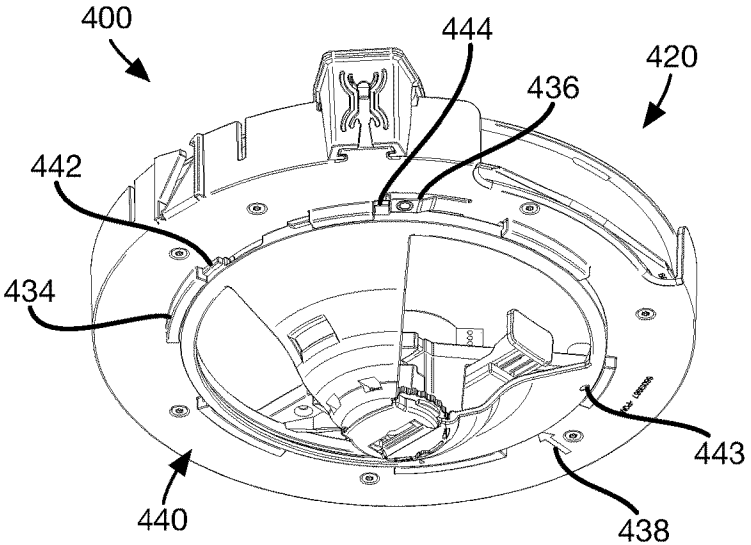
Figure 48:
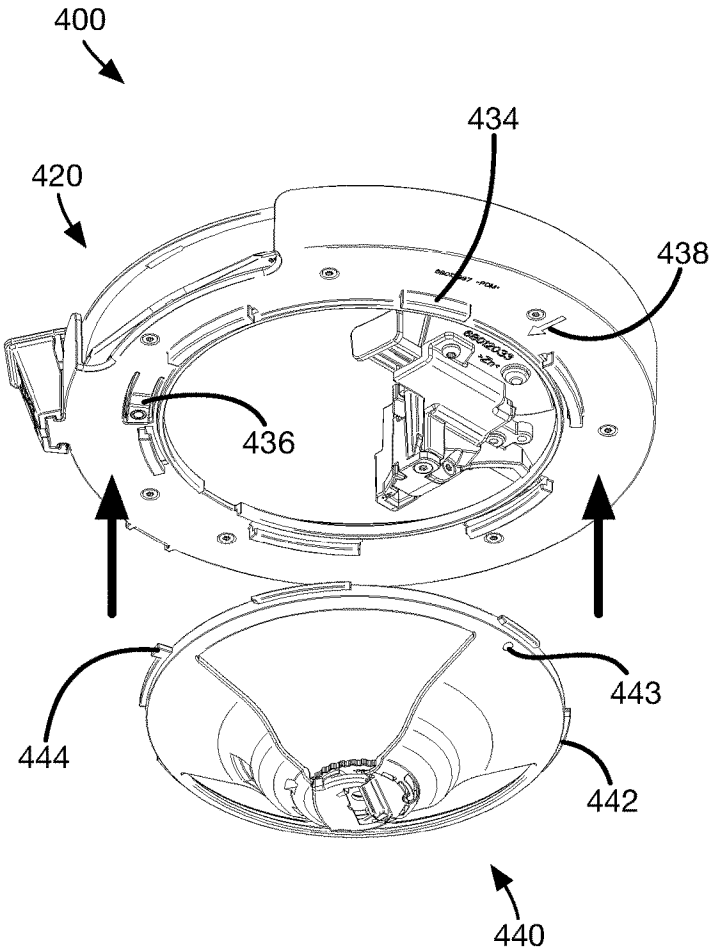

The retaining tabs 442 extend radially from the perimeter of the wider top end of the ribbon guide 440 to engage with the retaining slots 434 of the interface portion 430 of the rotating support 420, as shown in FIGS. 48-50. The locking tab 444 also extends from the perimeter of the top end. The locking tab 444 extends radially beyond the retaining tabs 442 and can be arranged near or at the end of one of the retaining tabs 442 or can be spaced apart from adjacent retaining tabs 442.

The bottom end of the ribbon guide 440 includes a sewing guide 446 for guiding the ribbon into the path of the needle 118 to be sewn to the workpiece. The sewing guide 446 has a needle opening 447 that receives the needle 118 of the sewing machine 100 and an embroidery material opening 445 for receiving the length of embroidery material from the ribbon spool 450. The sewing guide 446 includes an adjustment knob that adjusts the positions of two guide members to accommodate embroidery material with different widths. Alternatively, the sewing guide 446 can be removable from the support 410 so that other sewing guides with different sized embroidery material openings for different sized embroidery materials can be installed. The sewing guide 446 shown in FIGS. 46-49 is like the sewing guide 216 described above and functions in the same way to accommodate ribbon embroidery materials having different widths. Thus, the operation of the sewing guide 216 shown in FIGS. 14-17 and described in greater detail above applies likewise for the sewing guide 446 of the ribbon guide 440.

Referring now to FIGS. 48-50, the steps of assembling the ribbon guide 440 to the interface portion 430 of the rotating support 420 are shown. Referring first to FIG. 48, the ribbon guide 440 is arranged below the rotating support 420 and oriented such that a dot-shaped alignment indicator 443 of the ribbon guide 440 aligns with the arrow-shaped alignment indicator 438 of the rotating support 420. Referring next to FIG. 49, the ribbon guide 440 is lifted until the top of the ribbon guide 440 engages the bottom of the rotating support 420. Maintaining alignment between the alignment indicators 438, 443 of the rotating support 420 and the ribbon guide 440, respectively, ensures that the retaining tabs 442 of the ribbon guide 440 are disposed between neighboring retaining slots 434 of the interface portion 430 so that the ribbon guide 440 can fully engage the interface portion 430 without interference between the retaining tabs 442 and retaining slots 434. Proper alignment of the alignment indicators 438, 443 also ensures that the locking tab 444 is properly positioned for engagement with the latch 436. The ribbon guide 440 is held against the rotating support 420 in the initial assembly position of FIG. 49 and rotated counter-clockwise to the position shown in FIG. 50 to complete assembly of the ribbon guide 440 to the rotating support 420.

During rotation of the ribbon guide 440 from the initial assembly position shown in FIG. 49 to the final assembly position shown in FIG. 50, the retaining tabs 442 of the ribbon guide 440 slide into the retaining slots 434 of the interface portion 430. The locking tab 444 also engages a sloped surface of the latch 436 so that the latch 436 is pushed upward by the locking tab 444. As the ribbon guide 440 is further rotated counter-clockwise, the locking tab 444 eventually moves beyond the latch 436 and the latch 436 springs back into a neutral or resting position so that the locking tab 444 is captured between the latch 436 and a neighboring retaining slot 434. The latch 436 is shown as a flexible tab of material that is integrally formed with the rotating support 420 such that the elasticity of the material forming the rotating support 420 biases the latch 436 toward the closed position. Other latch mechanisms or other fastening devices can be used, however, such as, for example, one or more set screws, ball detents, clamps, ties, pins, or the like.

To detach the ribbon guide 440 from the rotating support 420, the latch 436 is depressed until the locking tab 444 is free to pass by the latch 436 as the ribbon guide 440 is rotated clockwise. Once the ribbon guide 440 is sufficiently rotated in the clockwise direction, the retaining tabs 442 are freed from the retaining slots 434 and the ribbon guide 440 can be removed. After removing ribbon embroidery material from the ribbon guide 440, the ribbon spool 450 can also be removed from the rotating support 420 so that the accessory 400 is ready to be used with a different embroidery material guide.

Figure 51:
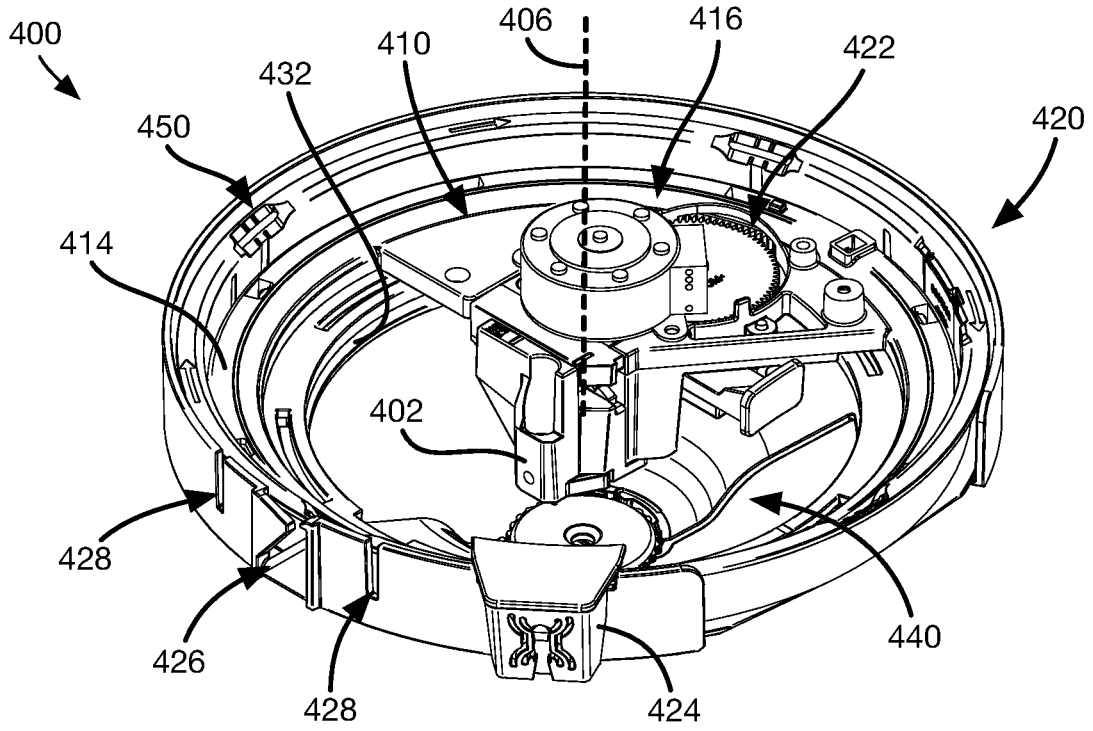
FIG. 51 is a top perspective view of a ribbon guide and spool assembled with the accessory of FIG. 44.
Figure 52:
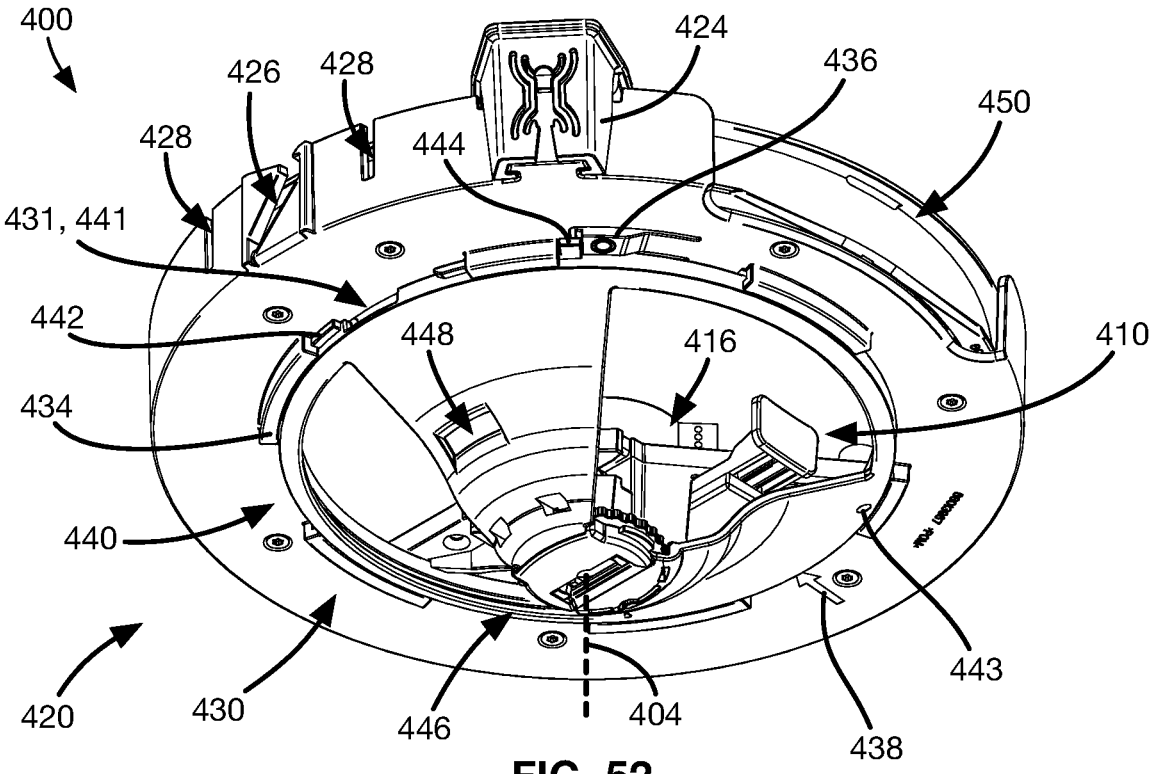
FIG. 52 is a bottom perspective view of the ribbon guide and spool assembled with the accessory shown in FIG. 51.

Referring now to FIGS. 51-52, the ribbon guide 440 and ribbon spool 450 are shown assembled with the accessory 400. When the ribbon guide 440 is assembled to the rotating support 420 the accessory 400 has similar features and operates in a similar manner as the accessory 200 shown in FIGS. 1-19 and described in detail above. That is, embroidery material, such as ribbon, can be loaded into the ribbon spool 450 for dispensing as the ribbon is attached to a workpiece via stitching performed by the needle. The ribbon spool 450 is rotatably installed in the rotating support 420 and is held in place by the ribbon spool retainer 424 so that the ribbon spool 450 is rotatable around a ribbon spool axis of rotation 406.

Loading ribbon from the ribbon spool 450 and through the ribbon guide 440 is also similar to the loading and routing of the spool 230 shown in FIGS. 8-13 and described in detail above. That is, once the full ribbon spool 450 has been installed in the accessory 400, the embroidery material or ribbon can be routed or threaded through the dispensing guide 426, openings 431, 441, the auxiliary guide 448, and the sewing guide 446 to prepare the accessory 400 for use. The embroidery material or ribbon is first fed through the dispensing guide 426, then through the aligned openings 431, 441 in the guide interface portion 430 and the ribbon guide 440, respectively, any additional or auxiliary guides 448, and then through the sewing guide 446. In an embodiment with an adjustable sewing guide, the sewing guide 446 is also adjusted to match the width of the embroidery material or ribbon.

At least a portion of the embroidery material or ribbon extends along the outer surface of the ribbon guide 440 as the embroidery material is dispensed through the dispensing guide 426 and the sewing guide 446. As is also described above, a guide surface of the dispensing guide 426 is arranged at about 45 degrees off of the axis of rotation of the spool 450. The angled guide surface twists the embroidery material as it is dispensed down the outer surface of the ribbon guide 440 so that an outer surface of the embroidery material on the spool becomes a top surface of the embroidery material when the embroidery material is sewn onto a workpiece.

Figure 53:
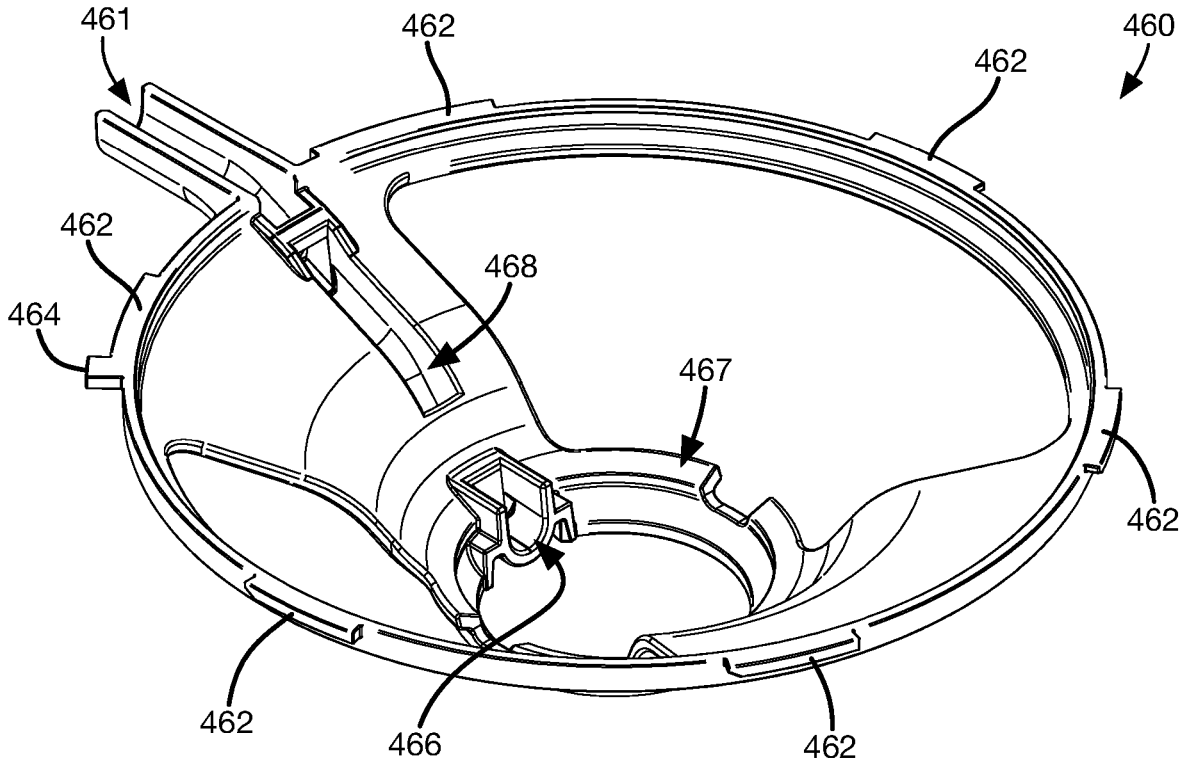
FIG. 53 is a top perspective view of the cord guide disassembled from the accessory of FIG. 44.
Figure 54:
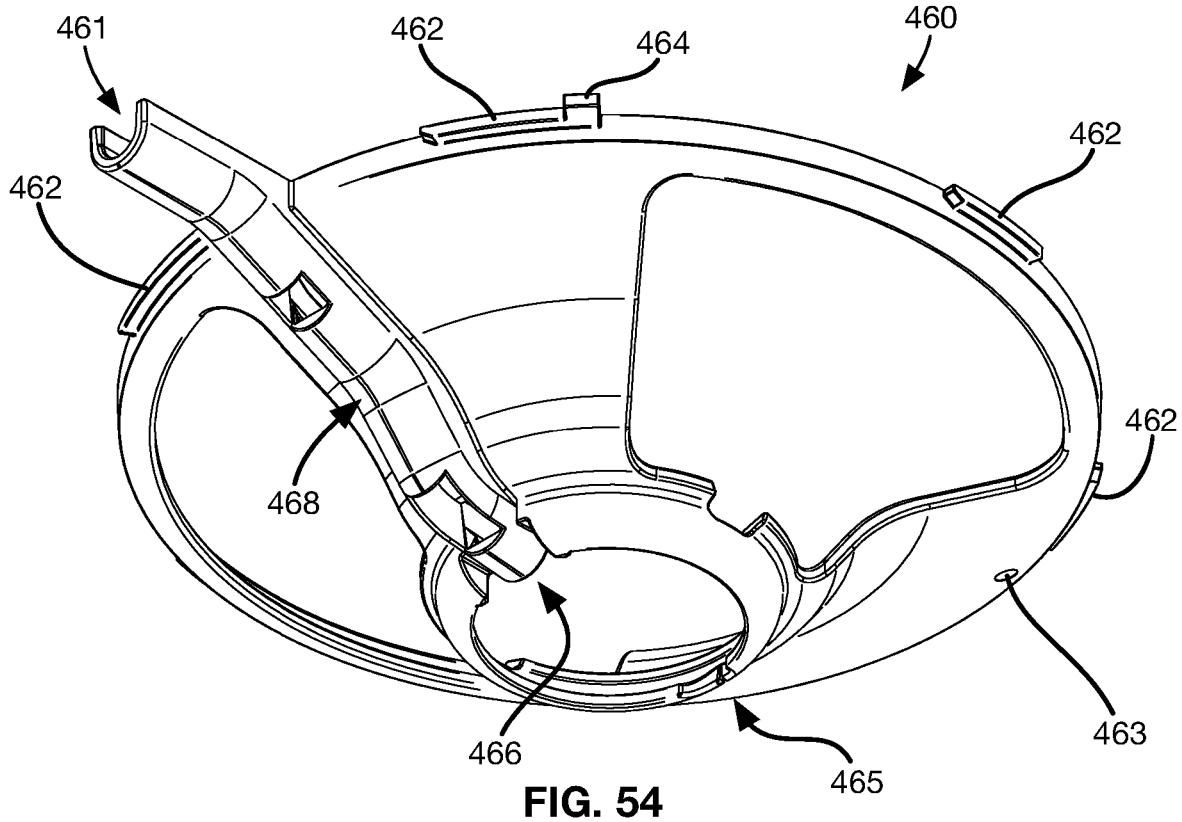
FIG. 54 is a bottom perspective view of the cord guide of FIG. 53.

Referring now to FIGS. 53 and 54, the cord guide 460 is shown disassembled from the accessory 400. Like the support 210 of the accessory 200 and the ribbon guide 440 described above, the cord guide 460 has a roughly conical shape extending from a wider top or first end to a narrower bottom or second end. The cord guide 460 attaches to the interface portion 430 of the rotating support 420 via a plurality of retaining tabs 462 and is secured in an assembled condition by the locking tab 464 that engages the latch 436.

Figure 56:
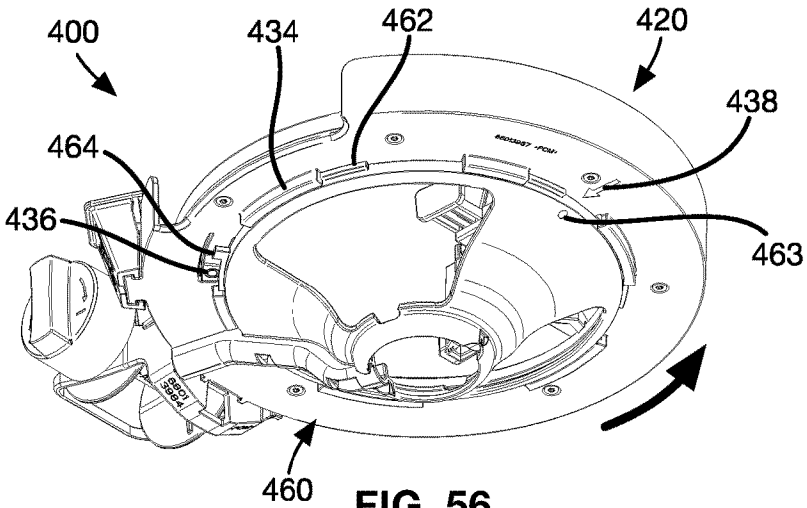
FIGS. 55-57 show the assembly of the cord guide of FIG. 55 with the accessory of FIG. 44 from a bottom perspective view.
Figure 57:
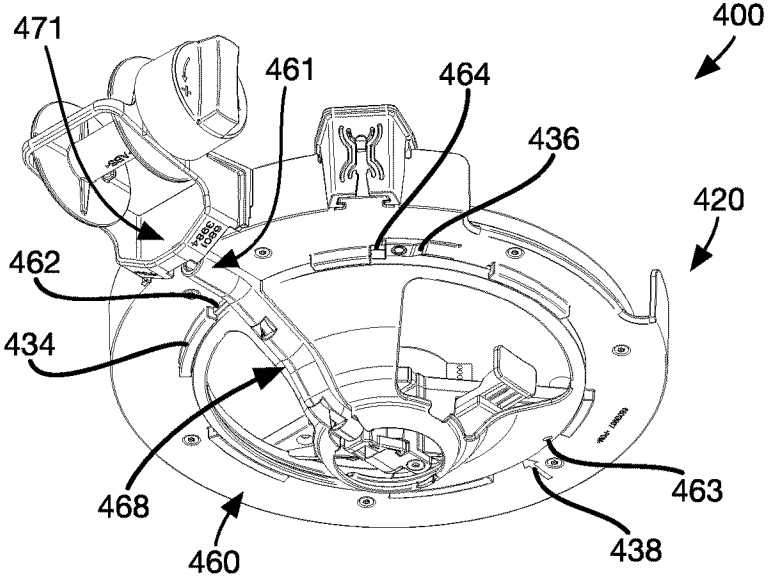
Figure 55:
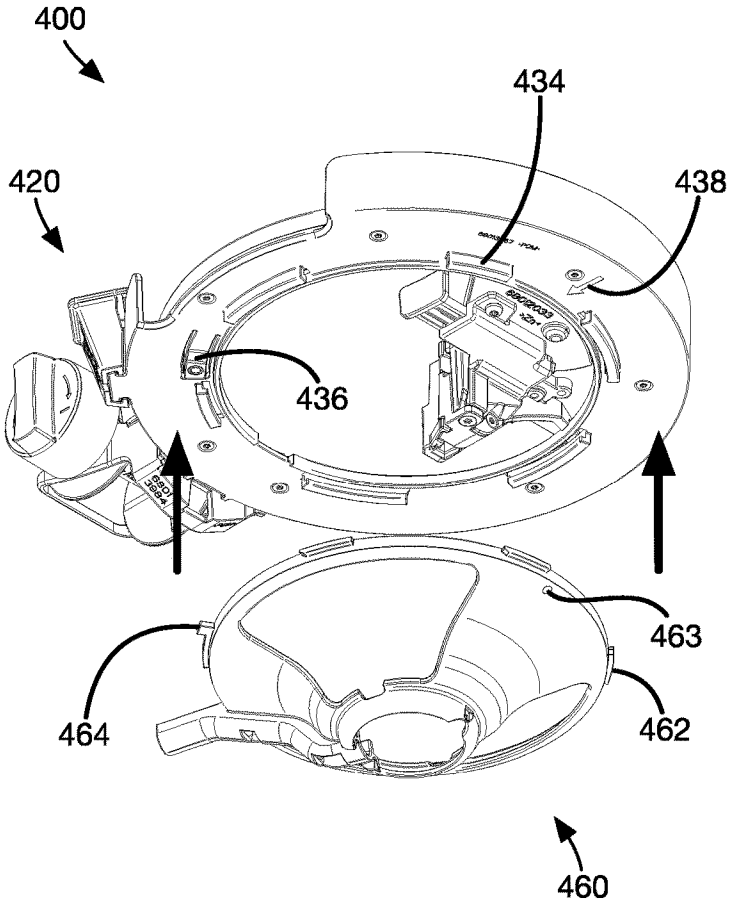

The retaining tabs 462 extend radially from the perimeter of the wider top end of the cord guide 460 to engage with the retaining slots 434 of the interface portion 430 of the rotating support 420, as shown in FIGS. 55-57. The locking tab 464 also extends from the perimeter of the top end. The locking tab 464 extends radially beyond the retaining tabs 462 and can be arranged near or at the end of one of the retaining tabs 462 or can be spaced apart from adjacent retaining tabs 462.

A guide channel 468 extends from a guide opening 461 at the top end of the cord guide 460 to a sewing guide 466 that opens up to a needle opening 467 at the bottom of the cord guide 460. The sewing guide 466 at the bottom end of the cord guide 460 guides a cord of embroidery material 401 (see FIGS. 64-65) into the path of the needle 118 to be sewn to the workpiece with a thread 403 (see FIGS. 64-65). A starting holder 465 (FIG. 54) is arranged opposite the sewing guide 466 around the needle opening 467 for holding the cord of embroidery material 401 to start sewing the cord of embroidery material 401 to the workpiece.

Referring now to FIGS. 55-57, the steps of assembling the cord guide 460 to the interface portion 430 of the rotating support 420 are shown. Referring first to FIG. 55, the cord guide 460 is arranged below the rotating support 420 and oriented such that a dot-shaped alignment indicator 463 of the cord guide 460 aligns with the arrow-shaped alignment indicator 438 of the rotating support 420. Referring next to FIG. 56, the cord guide 460 is lifted until the top of the cord guide 460 engages the bottom of the rotating support 420. Maintaining alignment between the alignment indicators 438, 463 of the rotating support 420 and the cord guide 460, respectively, ensures that the retaining tabs 462 of the cord guide 460 are disposed between neighboring retaining slots 434 of the interface portion 430 so that the cord guide 460 can fully engage the interface portion 430 without interference between the retaining tabs 462 or the guide channel 468 and the retaining slots 434. Proper alignment of the alignment indicators 438, 463 also ensures that the locking tab 464 is properly positioned for engagement with the latch 436. The cord guide 460 is held against the rotating support 420 in the initial assembly position of FIG. 56 and rotated counter-clockwise to the position shown in FIG. 57 to complete assembly of the cord guide 460 to the rotating support 420.

During rotation of the cord guide 460 from the initial assembly position shown in FIG. 56 to the final assembly position shown in FIG. 57, the retaining tabs 462 of the cord guide 460 slide into the retaining slots 434 of the interface portion 430. The locking tab 464 also engages a sloped surface of the latch 436 so that the latch 436 is pushed upward by the locking tab 464. As the cord guide 460 is further rotated counter-clockwise, the locking tab 464 eventually moves beyond the latch 436 and the latch 436 springs back into a neutral or resting position so that the locking tab 464 is captured between the latch 436 and a neighboring retaining slot 434. The latch 436 is shown as a flexible tab of material that is integrally formed with the rotating support 420 such that the elasticity of the material forming the rotating support 420 biases the latch 436 toward the closed position. Other latch mechanisms or other fastening devices can be used, however, such as, for example, one or more set screws, ball detents, clamps, ties, pins, or the like.

Figure 60:
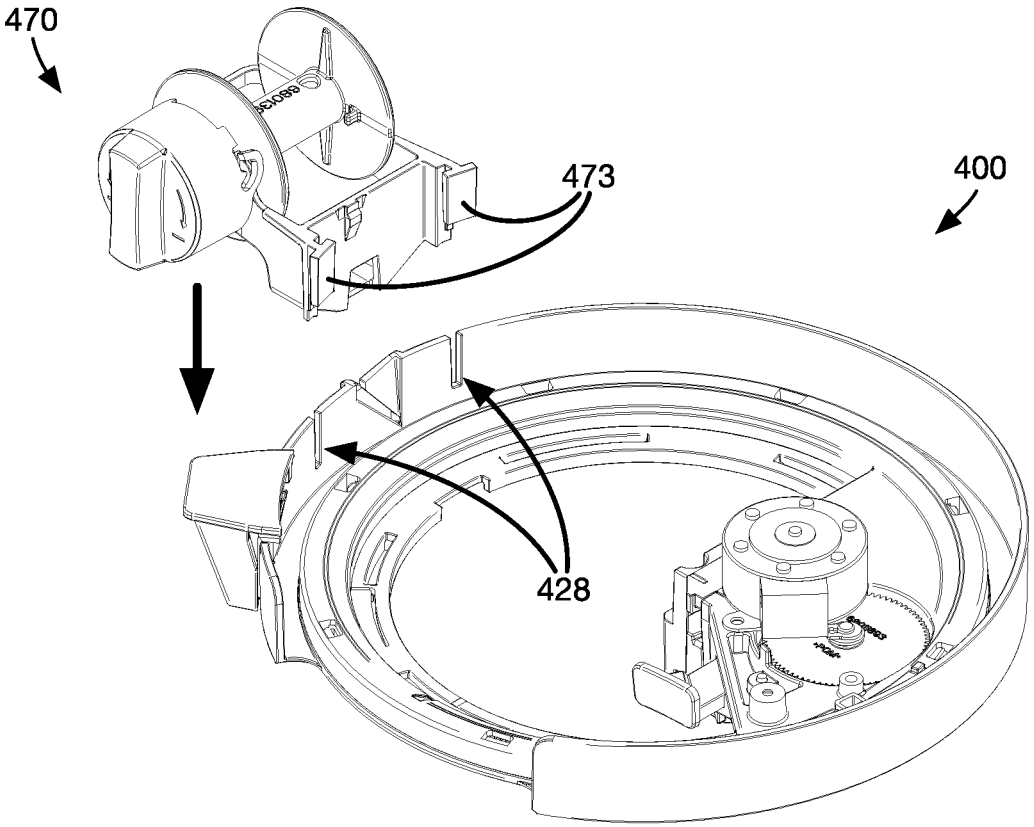
FIGS. 60 and 61 show the assembly of the cord spool of FIG. 58 to the accessory of FIG. 44 from a top perspective view.
Figure 61:
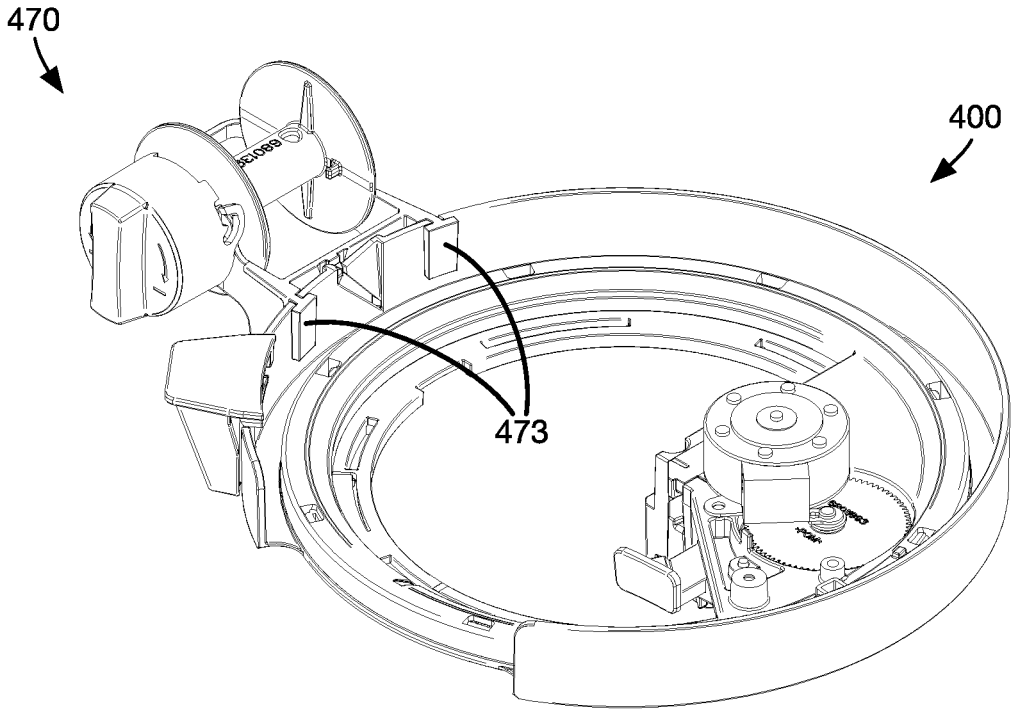

To detach the cord guide 460 from the rotating support 420, the latch 436 is depressed until the locking tab 464 is free to pass by the latch 436 as the cord guide 460 is rotated clockwise. Once the cord guide 460 is sufficiently rotated in the clockwise direction, the retaining tabs 462 are freed from the retaining slots 434 and the cord guide 460 can be removed. After removing the cord of embroidery material 401 from the cord guide 460, the cord spool 470 can also be removed from the rotating support 420 (as shown in FIGS. 60 and 61) so that the accessory 400 is ready to be used with a different embroidery material guide.

Figure 58:
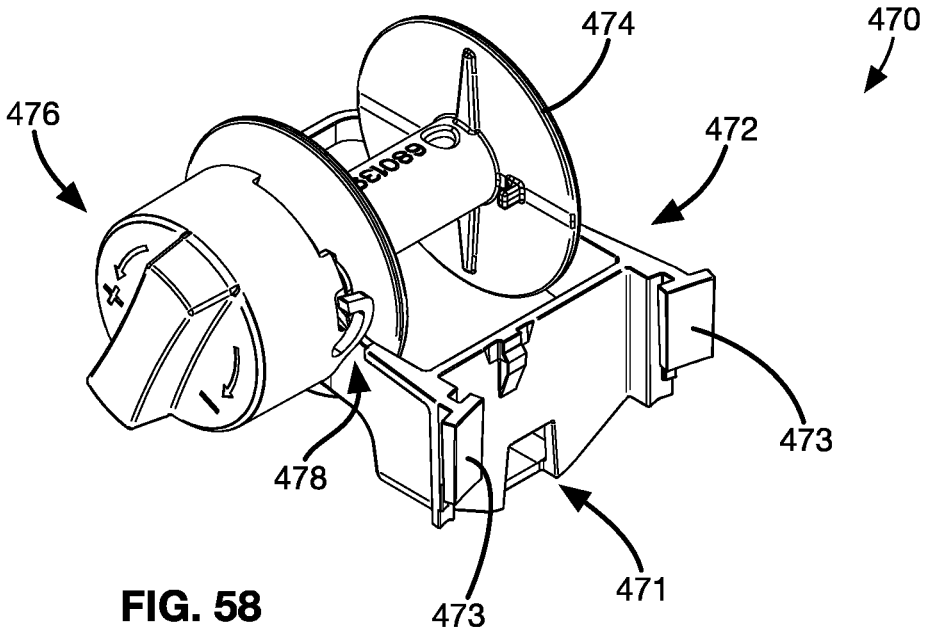
FIG. 58 shows a top perspective view of the cord spool disassembled from the accessory of FIG. 44.
Figure 59:
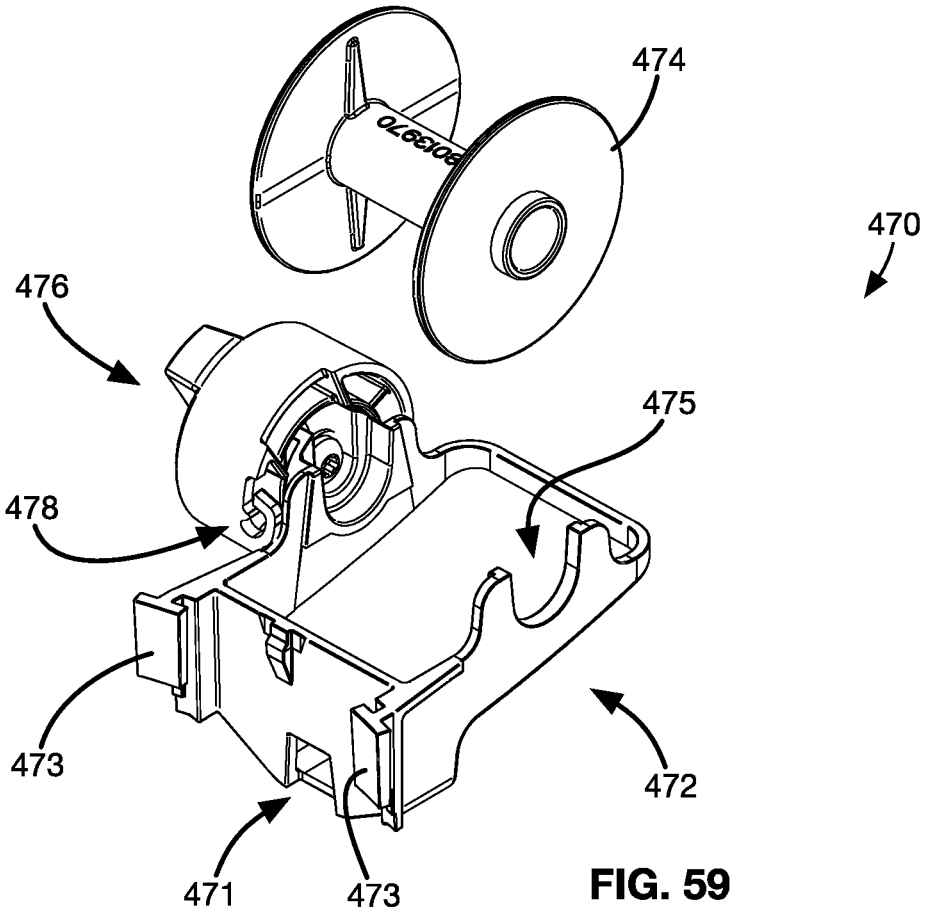
FIG. 59 shows a top perspective view of the cord spool assembly of FIG. 58 with the bobbin removed.

Referring now to FIGS. 58 and 59, the cord spool 470 is shown disassembled from the accessory 400. The cord spool 470 includes the cord opening 471 a bracket or frame 472, attachment portions 473, a bobbin 474, a bobbin holding portion 475, a tension knob 476, and a tension spring 478. When the cord spool 470 is assembled to the rotating support 420 the cord opening 471 aligns with the opening 431 of the guide interface portion 430 and the guide opening 461 of the cord guide 460 so that a cord of embroidery material 401 dispensed from the bobbin 474 of the cord spool 470 has a clear path from the cord spool 470, through the cord guide channel 468, to the sewing guide 466.

To load the cord spool 470 with a cord of embroidery material 401, the bobbin 474 is removed from the bobbin holding portion 475 of the frame 472 (FIG. 59). The embroidery material is inserted into a hole in the center of the bobbin 474 and then wrapped around the bobbin 474. The full bobbin 474 is then installed on the cord spool 470 so that the embroidery material can be routed or threaded through the cord opening 471 of the cord spool 470, openings 431, 461, the guide channel 468, and the sewing guide 466 to prepare the accessory 400 for use. The embroidery material or ribbon is first fed from the bobbin 474, through the cord opening 471, then through the aligned openings 431, 461 in the guide interface portion 430 and the cord guide 460, respectively, the guide channel 468, and then through the sewing guide 466.

The bobbin 474 is free to rotate in the bobbin holding portion 475 so that the cord of embroidery material 401 can be dispensed for sewing. Tension is maintained between the cord that has already been sewn to the workpiece and the cord remaining on the bobbin 474 by way of the tension knob 476 that resists the rotation of the bobbin 474 to reduce unwanted slack in the cord that could lead to jams or other errors. The tension knob 476 includes a resilient tension member 478 that presses and flexes against the side of the bobbin 474. Turning the tension knob 476 causes the force applied by the tension member 478 to the bobbin 474 to increase and decrease. The tension knob 476 can be rotated in a counter-clockwise direction—indicated with an arrow and a plus sign on the side of the tension knob 476—to increase the resistive forces applied to the bobbin 474 and can be rotated in a clockwise direction—indicated with an arrow and a minus sign on the side of the tension knob 476—to decrease the resistive forces applied to the bobbin 474. The tension required varies by the embroidery material used. That is, materials that experience greater amounts of friction during dispensing through the guide channel require less tension, and vice versa.

Referring now to FIGS. 60 and 61, the cord spool 470 is shown being assembled to the rotating support 420. To attach the cord spool 470, the attachment portions 473 of the frame are aligned with and inserted into the cord spool attachment portions or slots 428, as indicated by the arrow in FIG. 60. The bobbin 474 can be removed from the cord spool 470 while the cord spool 470 remains attached to the rotating support 420 to permit easy loading of the bobbin 474 or the use of multiple bobbins preloaded with a variety of materials.

Figure 62:
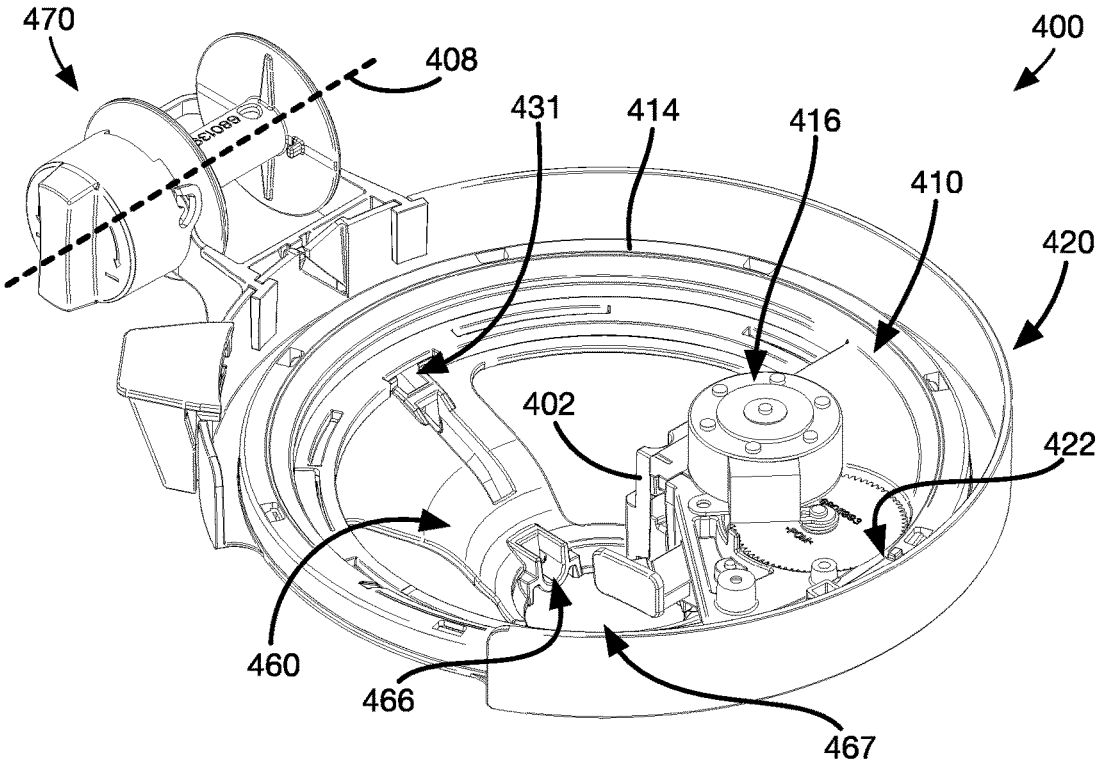
FIG. 62 is a top perspective view of a cord guide and spool assembled with the accessory of FIG. 44.
Figure 63:
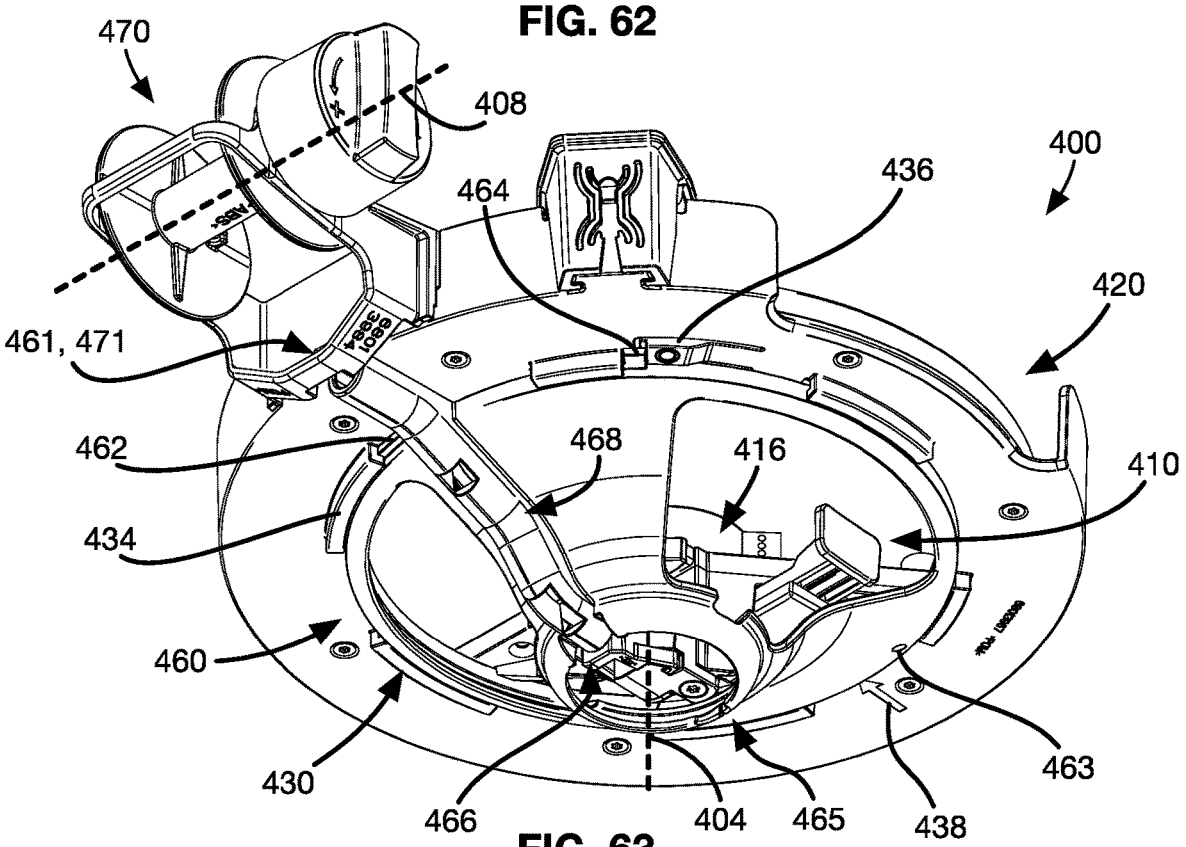
FIG. 63 is a bottom perspective view of the cord guide and spool assembled with the accessory shown in 62.

Referring now to FIGS. 62 and 63, the cord guide 460 and cord spool 470 are shown assembled to the accessory 400. During operation of the accessory 400, the cord of embroidery material 401 is supplied from the cord spool 470 that is supported by the rotating support 420. As is described above, the bobbin 474 can rotate freely with respect to the cord spool 470 to facilitate dispensing of the cord of embroidery material. As the cord of embroidery material is dispensed and sewn onto a sewing article (see FIGS. 64-65 and discussion below), tension between the embroidery material attached to the cloth workpiece and the embroidery material remaining in the cord spool 470 causes the bobbin 474 to rotate in a dispensing direction around a cord spool axis of rotation 408 to dispense more embroidery material for sewing. Because the cord spool 470 is supported by the rotating support 420, tension forces along the embroidery material are not transmitted to the stationary support 410 and therefore do not act against or in favor of the rotation of the rotating support 420 nor can these forces push the sewing guide 466 out of alignment with the needle 118.

As was discussed above, a wide variety of embroidery materials can be dispensed from the cord spool 470 for sewing to a workpiece via the cord guide 460. For example, a ribbon or ribbon-like material can be sewn using the ribbon guide 440, as described above, and can also be sewn using the cord guide 460. When a length of ribbon is used with the cord guide 460, the accessory operates as described above with respect to the accessory 200 and the accessory 400 with the ribbon guide 440. That is, stitches can be placed roughly along the center of the ribbon material as the length of ribbon is dispensed. Some materials, however, are not capable of being attached in this way.

Cords, thick yarn, strings, twisted ribbons, or the like, may be too thick for the needle to penetrate, thereby necessitating a different sewing technique. Similarly, strings of beads or pearls might not capable of being sewn like a ribbon of material as impacts between the needle and pearls or beads could damage the needle, the beads or pearls, or both. More importantly, unless the string of beads or pearls is moved across the sewing path, the stitches may miss the string entirely.

Figure 64:
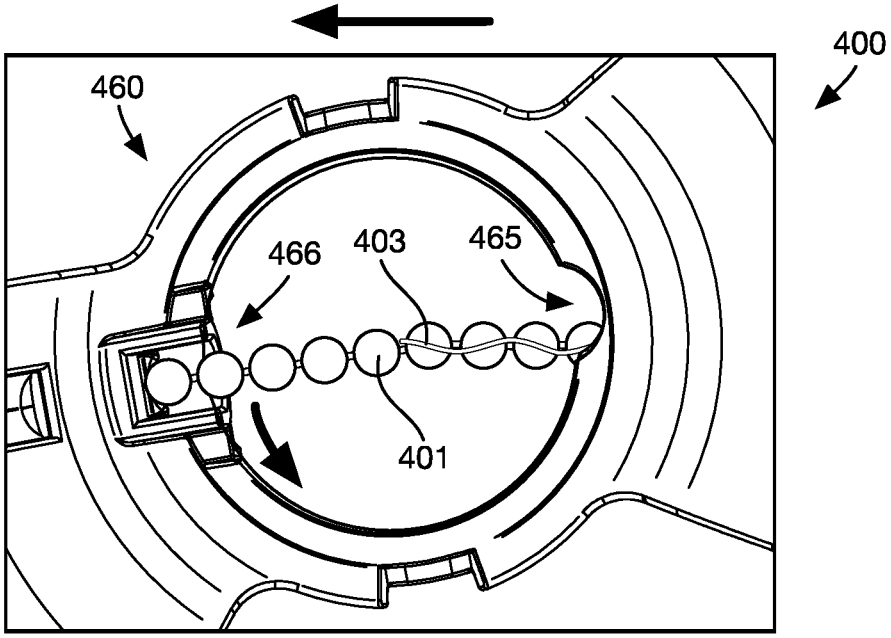
FIGS. 64 and 65 show enlarged top views of the sewing guide of the cord guide with a string of embroidery material during stitching.
Figure 65:
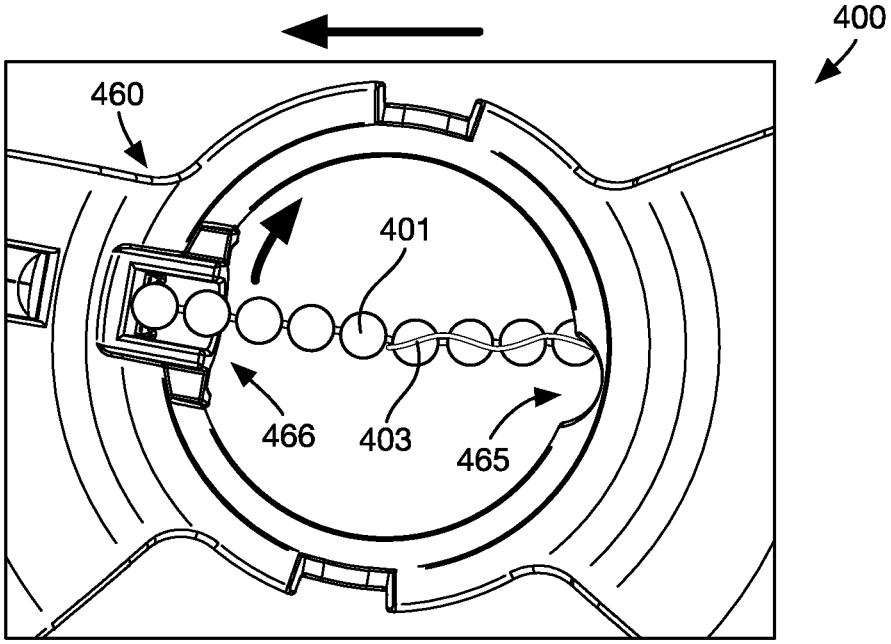

Referring now to FIGS. 64 and 65, a technique for attaching cords or strings of embroidery materials to a workpiece using the cord guide 460 is shown. A string of beads or pearls as the embroidery material 401 is shown being dispensed from the sewing guide 466 along a sewing path indicated by the right-to-left arrow. As the embroidery material 401 is dispensed, the cord guide 460 is rotated back-and-forth across the sewing path so that a thread 403 being sewn to the workpiece by the needle (not shown) passes on one side of the embroidery material 401 and then the other side. This back-and-forth motion of the cord guide 460 moves the embroidery material 401 out of the way of the needle and results in a pattern that may have a zig-zag appearance after sewing. The thicker the embroidery material, the more prominent the zig-zag appearance will be. The back-and-forth rotations of the cord guide 460 are made relative to the sewing path, so that when the sewing path is curved, the cord guide 460 may rotate further in one direction than in the other to facilitate the sewing of the embroidery material 401 to the workpiece along the curved path. It should be noted that the sewing pitch or stitch length can also be adjusted to accommodate different embroidery materials with different thicknesses.

The sewing machine 100 includes a controller (not shown) that sends signals to the one or more actuators to move the embroidery frame attached to the embroidery frame mount 108 and also that sends signals to the drive mechanism 416 to control the rotation of the rotating support 420 of the accessory 400 to rotate the rotating support 420—and, thus, the attached ribbon or cord guide 440, 460—in either a clockwise or counterclockwise direction so that the embroidery material openings 445, 466 of the ribbon and cord guides 440, 460, respectively, lead the needle opening 447, 467, respectively, along the sewing path of the embroidery pattern being sewn by the sewing machine 100. That is, the embroidery frame moves the workpiece relative to the needle 118 so that, while the needle 118 and the accessory 400 are stationary relative to the sewing machine 100, the needle 118 and accessory 400 are moving relative to the workpiece. Thus, relative to the workpiece, the needle 118 traces out a sewing path along the workpiece and the sewing guide 416 is rotated to be in front of the needle 118 along the path traced out by the needle 118. In other words, the rotating support 420 and the ribbon guide 440 or the cord guide 460 lead embroidery material to the workpiece and under the needle 118, while the embroidery frame mount is moved by the sewing machine 100 to ensure that the embroidery design is followed correctly. It should be noted that when the ribbon spool 450 and ribbon guide 440 are used, the rotating support 420 can be rotated in a clockwise or counter-clockwise direction, but the ribbon spool 450 only rotates in the dispensing direction as embroidery material is dispensed.

Referring now to FIGS. 66-75, an exemplary accessory 500 with interchangeable guides for use with a sewing machine, such as the sewing machine 100, is shown. The accessory 500 is similar in many ways to the accessory 400 described above; that is, the accessory 500 also includes interchangeable guides that can be removed from the rotating support to facilitate the embroidery of various materials, such as, for example, ribbon, cord, yarn, or strings of beads, pearls, or the like. The two guides described above—the ribbon guide 440 and the cord guide 460—can each be assembled to the accessory 500 in the same way that the ribbon and cord guides 440, 460 are assembled to the accessory 400. As with the accessory 400, while ribbon and cord guides are shown herein, the accessory 500 is capable of receiving a wide variety of guides and/or spools for dispensing lengths of material for embroidery onto a workpiece. Additionally, a wide variety of other devices can be attached to the accessory to facilitate rotation of the attached device in combination with the translation of a workpiece via an embroidery frame or other holder that is moved by the embroidery frame mount 108. For example, a holder for pens, markers, brushes, or other marking implements could be attached to the accessory to enable drawing or painting on paper or on fabric.

Figure 66:
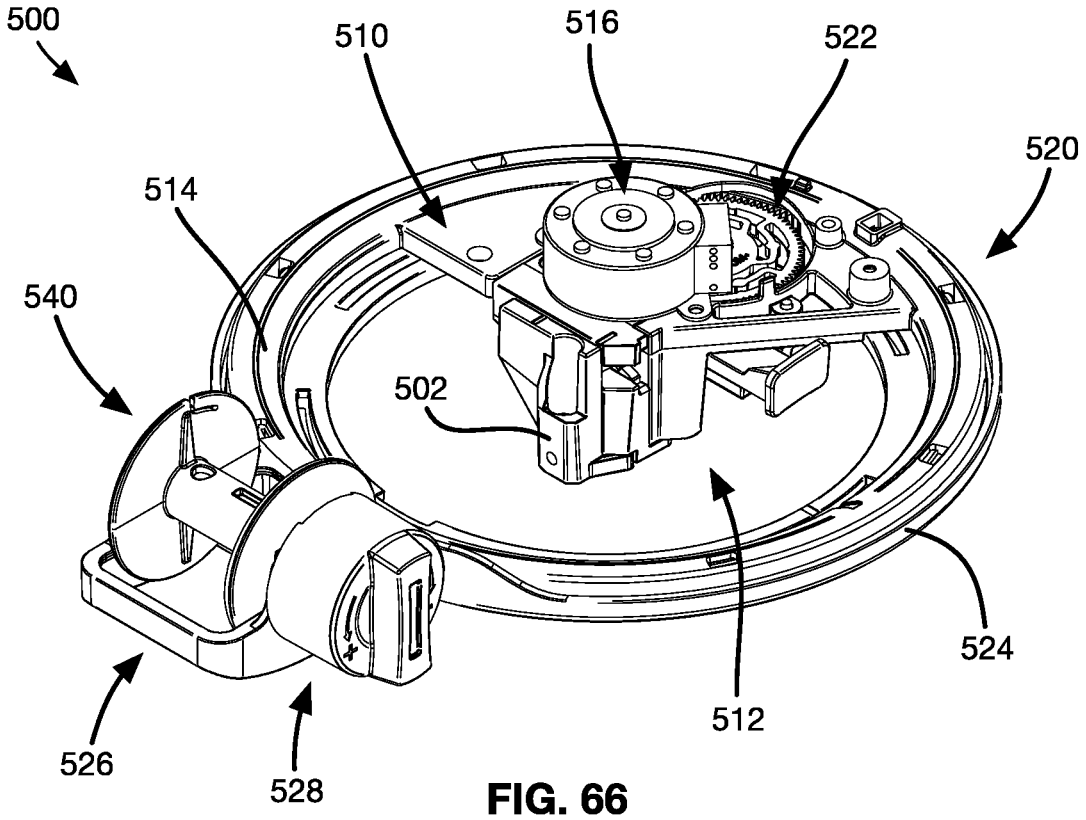
FIG. 66 is a top perspective view of an accessory of an exemplary embodiment of an accessory for a sewing machine.
Figure 67:
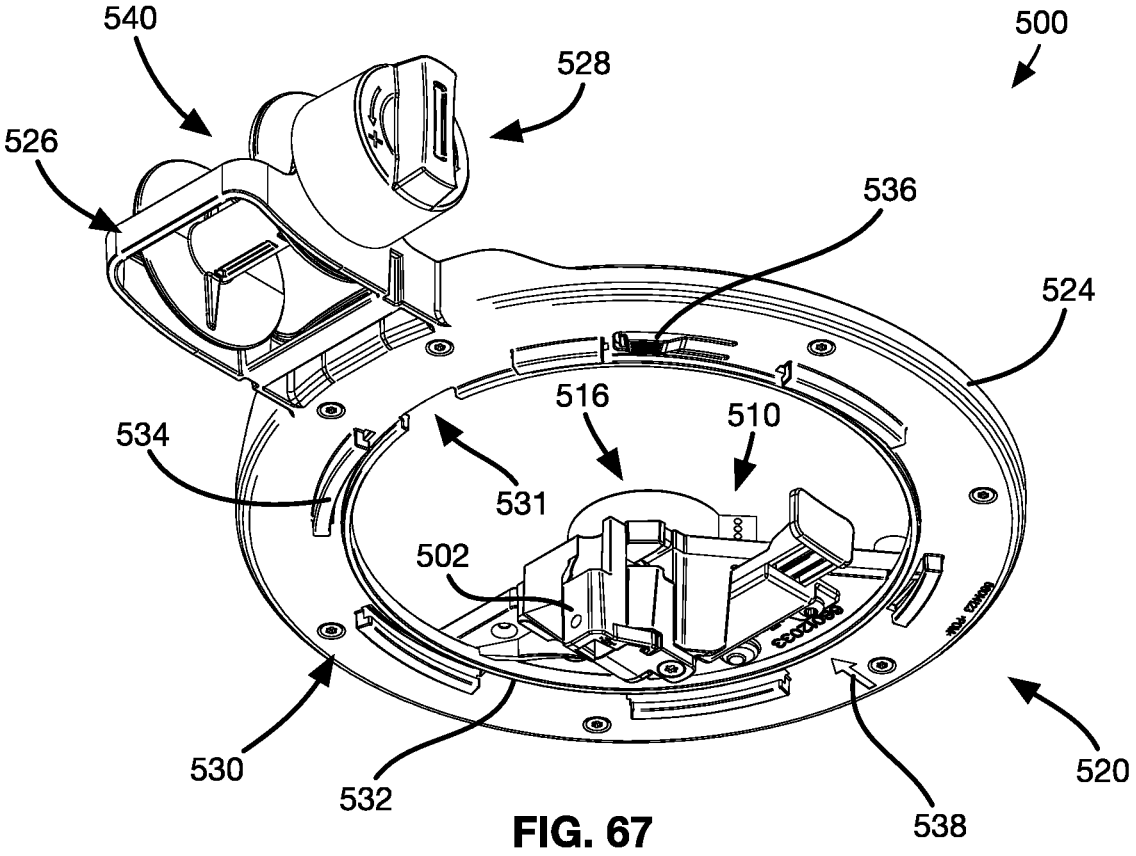
FIG. 67 is a bottom perspective view of the accessory of FIG. 66.
Figure 68:
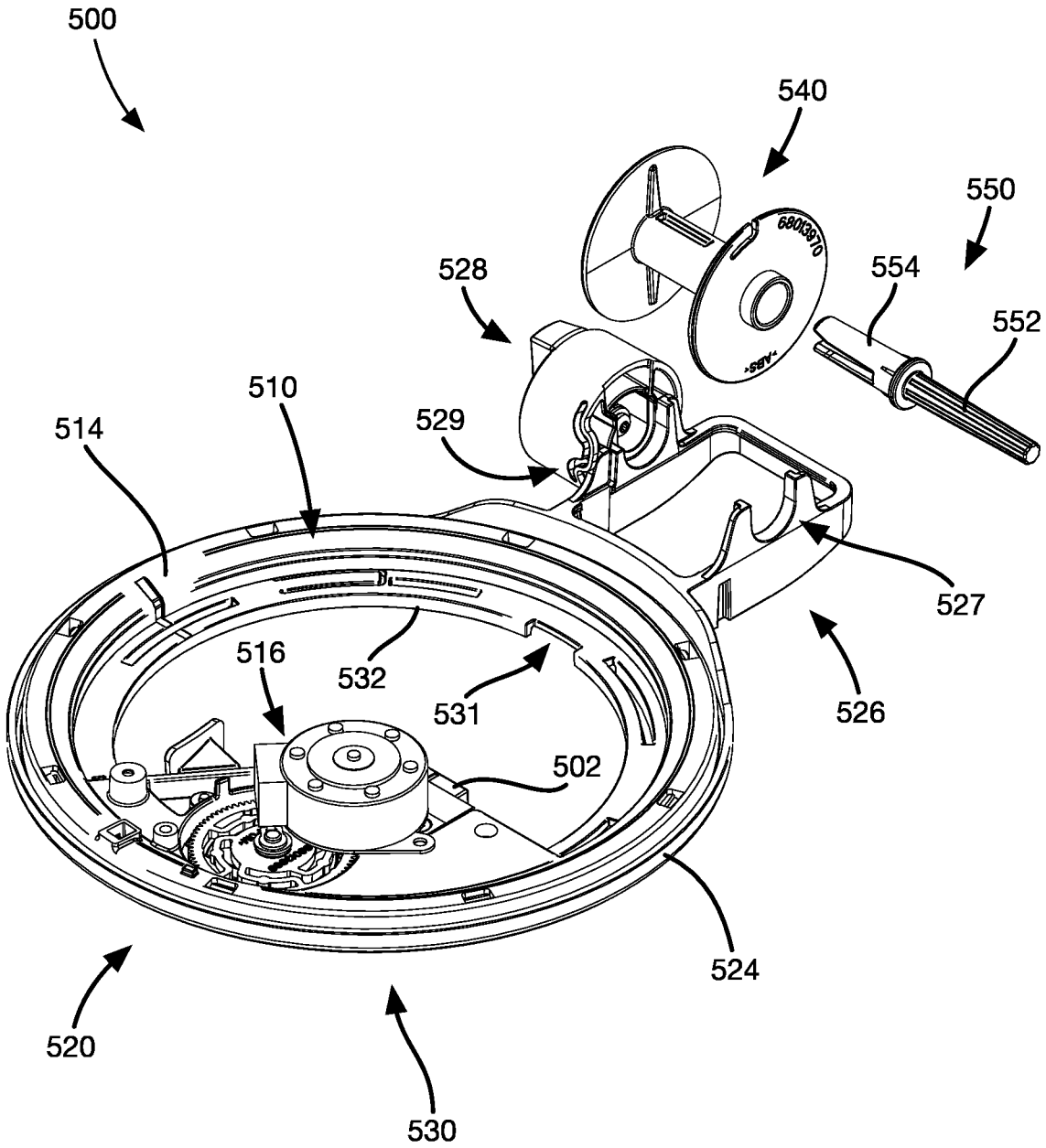
FIG. 68 is a top perspective view of the accessory of FIG. 66 with the spool disassembled from the spool holder.

Referring now to FIGS. 66-68, the accessory 500 capable of receiving various interchangeable guides is shown. The accessory 500 includes a stationary support 510 and a rotating support 520. The stationary support 510 attaches the accessory 500 to the accessory mount 122 of the sewing machine 100. The rotating support 520 includes an interface portion 530 for receiving and attaching to interchangeable guides, such as the ribbon guide 440 and a cord guide 460 described above. The rotating support 520 also includes a spool or bobbin holder 526 for holding a spool or bobbin 540 for dispensing lengths of ribbon and cord.

The stationary support 510 includes an attachment portion 512 that engages an attachment holder 502 that is attached to the accessory mount 122 of the sewing machine 100, like the attachment portion 238, 412 and attachment holder 240, 402 described above. The attachment portion 512 and attachment holder 502 are like the attachment portion 238, 412 and attachment holder 240, 402 described above and function in the same way to attach the accessory 500 to the sewing machine 100, respectively. For example, the attachment holder 502 can also include latch and release mechanisms that enable the accessory 500 to be tilted without releasing the accessory 500. Thus, the interaction of the attachment portion and holder 238, 240 shown in FIGS. 20-34 and described in greater detail above applies likewise for the attachment portion and holder 512, 502, respectively.

Like the accessories 200, 400, the accessory 500 fits within the minimum arm height 114, which can range from about 3 inches to about 6 inches. The accessory 500 provides sufficient room around the needle bar 116 and needle so that normal sewing functions of the sewing machine 100 are not disrupted by the accessory 500. For example, sufficient space is provided for a needle threader 120 to thread the needle attached to the needle bar 116 without removing the accessory 500.

The stationary support 510 also includes a perimeter portion 514 and a drive mechanism 516. The rotating support 520 is attached to the stationary support 510 at the perimeter portion 514 and the rotating support 520 is caused to rotate by the drive mechanism 516 around a guide axis of rotation 504. The drive mechanism 516 can include a motor and a transmission and is capable of rotating the rotating support 520 clockwise and counterclockwise. The transmission can include one or more gears, belts, or the like arranged to transfer rotational motion from a motor to the rotating support 520. For example, the transmission can include a gear that engages a transmission portion of the rotating support 520, such as a ring gear 522 (see, e.g., FIGS. 66, 72, and 74) attached to the rotating support 520. To save vertical space, the drive mechanism 516 is arranged in an interior of the stationary support 510 so that at least a portion of the mechanism is arranged between a top surface and a bottom surface of the stationary support 510.

The motor of the drive mechanism 516 receives power and control signals from the sewing machine via an electrical connection. The connection can be provided by a wire (not shown), like the wire 282 described above, that attaches between the accessory 500 and another portion of the sewing machine 100, such as the sewing arm 110. In some embodiments, power and data connections can be integrated into the attachment portion 502, attachment holder 512, and accessory mount 122 so that attaching the accessory 500 to the sewing machine 100 also provides an avenue for the transmission of power and control signals from the sewing machine 100 to the accessory 500.

The rotating support 520 includes the ring gear 522, a perimeter portion 524, a spool or bobbin holder 526 for holding a spool or bobbin 540, and a guide interface portion 530. The ring gear 522 is rotatably attached to the stationary support 510 and is configured to engage the transmission of the drive mechanism 516 to enable the drive mechanism to cause the rotatable support 520 to rotate. In particular, the rotating support 520 is suspended from the stationary support 510 by way of the engagement between the ring gear 522 and the stationary support 510.

The guide interface portion 530 is formed on the bottom surface of the rotating support 520 and is configured to receive the ribbon and cord guides 440, 460 that, when assembled to the rotating support 520, are suspended from the rotating support 520 and above the workpiece. The guide interface portion 530 surrounds a central opening of the rotating support 520, that is, the components of the interface portion 530 are arranged around the circumference of the central opening of the rotating support 520. The guide interface portion 530 can incorporate any suitable means for removably attaching the ribbon and cord guides 440, 460 to the rotating support 520, such as, for example, using threaded fasteners, quarter turn fasteners, magnets, re-usable adhesive, snaps, hook and loop fasteners, and the like.

The guide interface portion 530 includes an alignment portion 532, a plurality of retaining slots 534, a latch 536, and an alignment indicator 538. The alignment portion 532 is formed from a lip extending downward from and around the circumference of the central opening of the rotating guide 520. An opening 531 is provided in the alignment portion 532 to allow ribbon dispensed from the spool or bobbin 540 to pass through the interface portion 530 that forms the connection between the rotating support 520 and the ribbon and cord guides 440, 460. The retaining slots 534 receive corresponding tabs 442, 462 of the ribbon and cord guides 440, 460, respectively, and the latch 536 captures a locking tab 444, 464 of the ribbon and cord guides 440, 460, respectively, against one of the retaining slots 534 to prohibit the rotation of the ribbon guide 440 or cord guide 460 relative to the rotating support 520. The alignment indicator 538 has an arrow shape and identifies an initial assembly orientation of the ribbon and cord guides 440, 460 relative to the rotating support 520. The steps to attach the ribbon guide 440 or the cord guide 460 to the rotating support 520 are described in further detail above and are shown in FIGS. 48-50 and 55-57, respectively.

Figure 70:
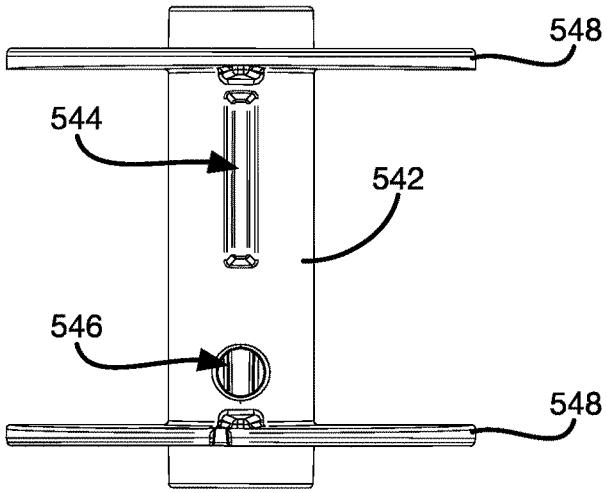
FIG. 70 is a top view of the spool of FIG. 68.
Figure 71:
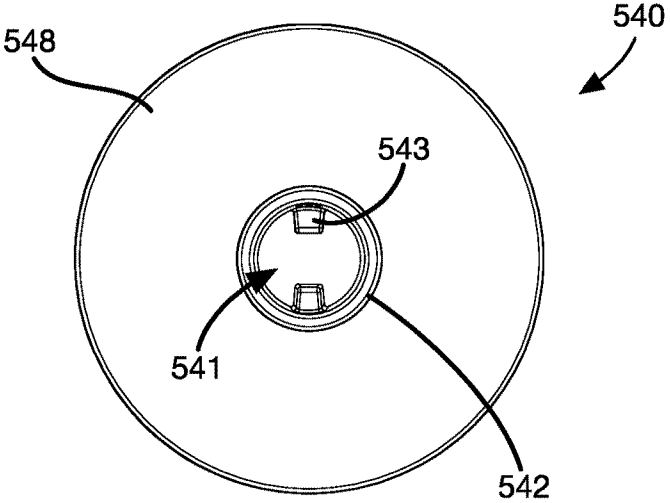
FIG. 71 is a side view of the spool of FIG. 68.
Figure 69:
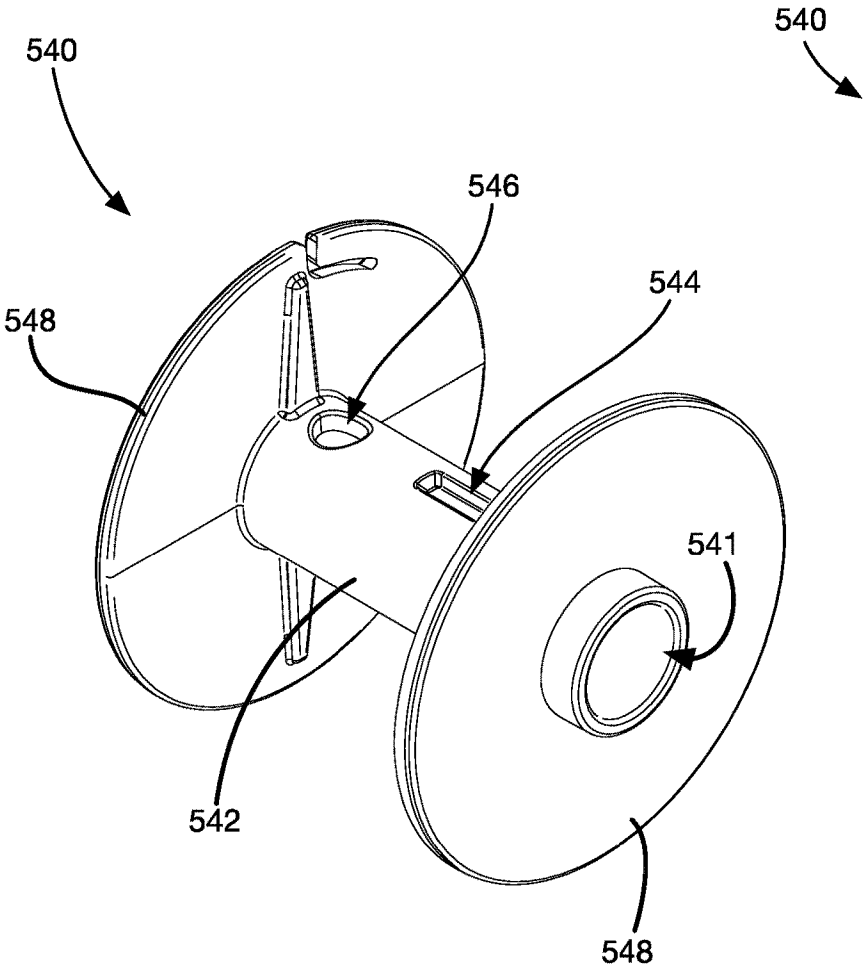
FIG. 69 is a top perspective view of the spool of the accessory of FIG. 66.

Referring now to FIGS. 69-71, various views of the spool 540 are shown. The spool 540 includes a core or hub 542 that extends between two flanges 548. Portions of the core 542 extend beyond the flanges 548 for mounting the spool 540 in a spool cradle 527 of the spool holder 526 (FIG. 68). The core 542 also includes a ribbon mounting slot 544 and a cord mounting hole 546 for receiving the length of ribbon or cord, respectively. The ribbon mounting slot 544 is elongated for receiving embroidery material that is generally flat, such as a length of ribbon. The cord mounting hole 546 is rounded for receiving embroidery material that is generally round, such as a length of yarn or string of beads or pearls. The different shaped mounting holes 544, 546 enable the same spool 540 to be used for a wide variety of embroidery materials. An end of the ribbon or cord is inserted in the ribbon mounting slot 544 or the cord mounting hole 546 and is then wound around the core 542 until the ribbon or cord fill the spool 540, i.e., until the embroidery material wrapped around the core 542 reaches the outer edge of the flanges 548.

Referring again to FIG. 68, an optional winding handle or pin 550 can be used to assist the user in winding a length of embroidery material onto the spool 540. The winding handle 550 includes a grip portion 552 that is held by the user and an engagement portion 554 that engages the spool 540 so that the spool 540 can be quickly and easily rotated by the user during the winding process. The engagement portion 554 can be inserted into an opening 541 in the core 542 of the spool 540 to engage protrusions or keys 543 extending from the interior of the opening 541 so that rotating the grip portion 552 causes the spool 540 to rotate as well.

As can be seen in FIG. 68, the spool holder 526 is integrally formed with and connected to the perimeter portion 524 and includes the spool cradle 527 for receiving and facilitating rotation of the spool 540. The spool 540 is free to rotate in the spool cradle 527 so that the embroidery material can be dispensed for sewing. Tension is maintained between the embroidery material that has already been sewn to the workpiece and the embroidery material remaining on the spool 540 by way of a tension knob 528 that resists the rotation of the spool 540 to reduce unwanted slack in the embroidery material that could lead to jams or other errors. The tension knob 528 includes a resilient tension member 529 that presses and flexes against the side of the spool 540. Turning the tension knob 528 causes the force applied by the tension member 529 to the spool 540 to increase and decrease. The tension knob 528 can be rotated in a counterclockwise direction—indicated with an arrow and a plus sign on the side of the tension knob 528—to increase the resistive forces applied to the spool 540 and can be rotated in a clockwise direction—indicated with an arrow and a minus sign on the side of the tension knob 528—to decrease the resistive forces applied to the spool 540. The tension required varies by the embroidery material used. That is, materials that experience greater amounts of friction during dispensing through the guide channel require less tension, and vice versa.

Figure 72:
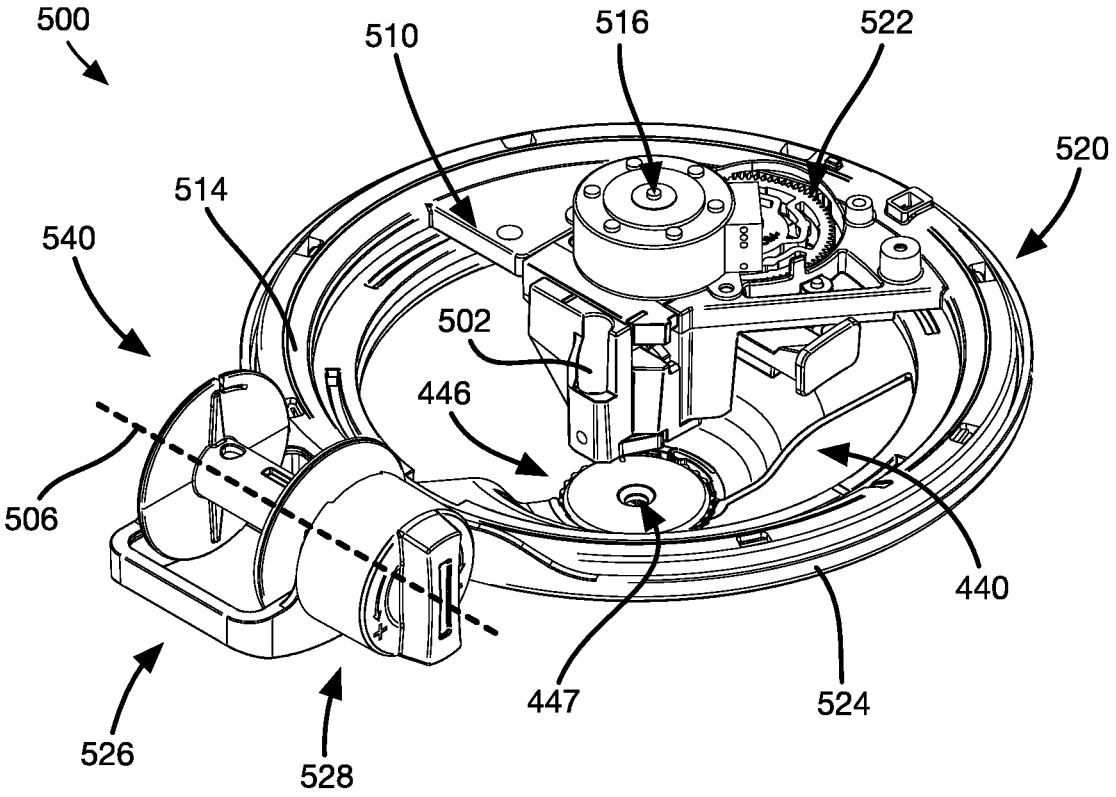
FIG. 72 is a top perspective view of a ribbon guide assembled with the accessory of FIG. 66.
Figure 73:
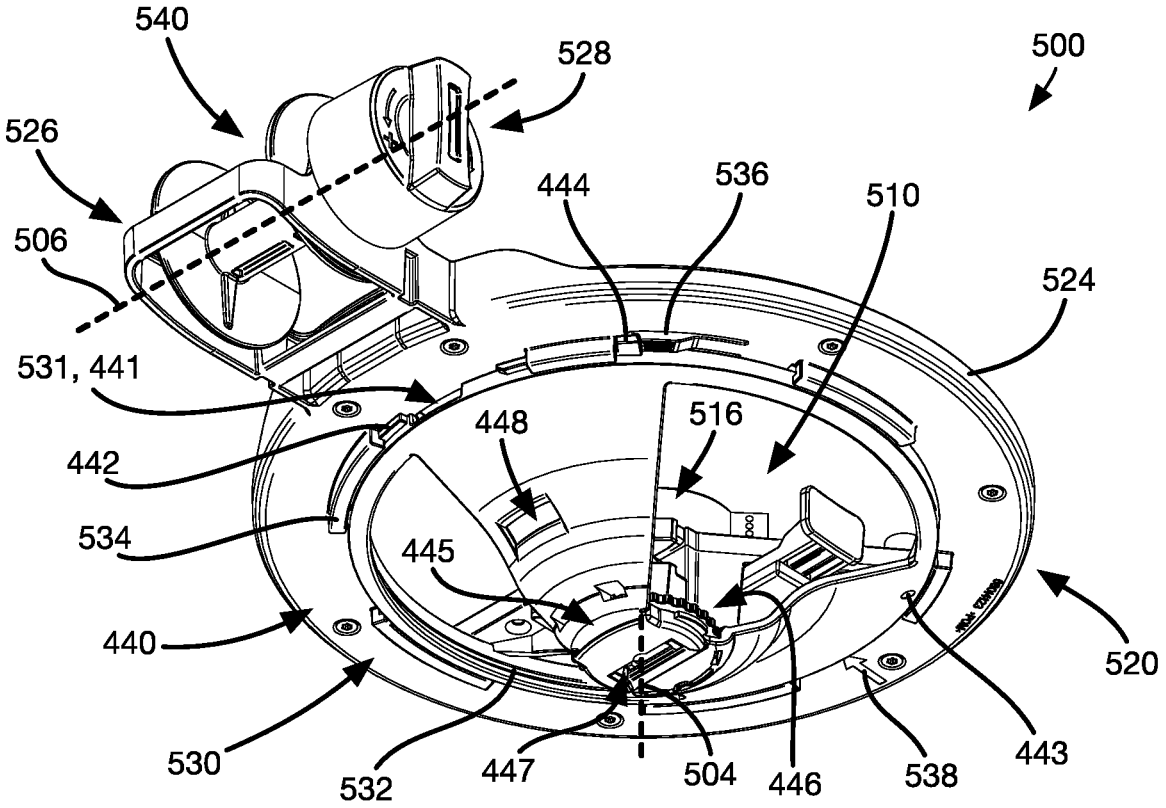
FIG. 73 is a bottom perspective view of the accessory of FIG. 72.

Referring now to FIGS. 72-73, the ribbon guide 440 is shown assembled with the accessory 500. When the ribbon guide 440 is assembled to the rotating support 520 the accessory 500 has similar features and operates in a similar manner as the accessory 200 shown in FIGS. 1-19 and described in detail above. That is, embroidery material, such as ribbon, can be loaded into the spool 540 for dispensing as the ribbon is attached to a workpiece via stitching performed by the needle 118. The spool 540 is rotatably installed in the rotating support 520 and is held in place by gravity and tension applied by the embroidery material being sewn to the workpiece so that the spool 540 is rotatable around a spool axis of rotation 506.

Loading ribbon from the spool 540 and through the ribbon guide 440 is also similar to the loading and routing of the spool 230 shown in FIGS. 8-13 and described in detail above. That is, once the full spool 540 has been installed in the accessory 500, the embroidery material or ribbon can be routed or threaded through the openings 531, 441, the auxiliary guide 448, and the sewing guide 446 to prepare the accessory 500 for use. The embroidery material or ribbon is first fed through the aligned openings 531, 441 in the guide interface portion 530 and the ribbon guide 440, respectively, any additional or auxiliary guides 448, and then through the sewing guide 446. In an embodiment with an adjustable sewing guide, the sewing guide 446 is also adjusted to match the width of the embroidery material or ribbon.

At least a portion of the embroidery material or ribbon extends along the outer surface of the ribbon guide 440 as the embroidery material is dispensed through the openings 531, 441 and the sewing guide 446. The embroidery material or ribbon is loaded on to the spool 540 so that an outer surface of the embroidery material on the spool becomes a bottom surface of the embroidery material when the embroidery material is sewn onto a workpiece.

Figure 74:
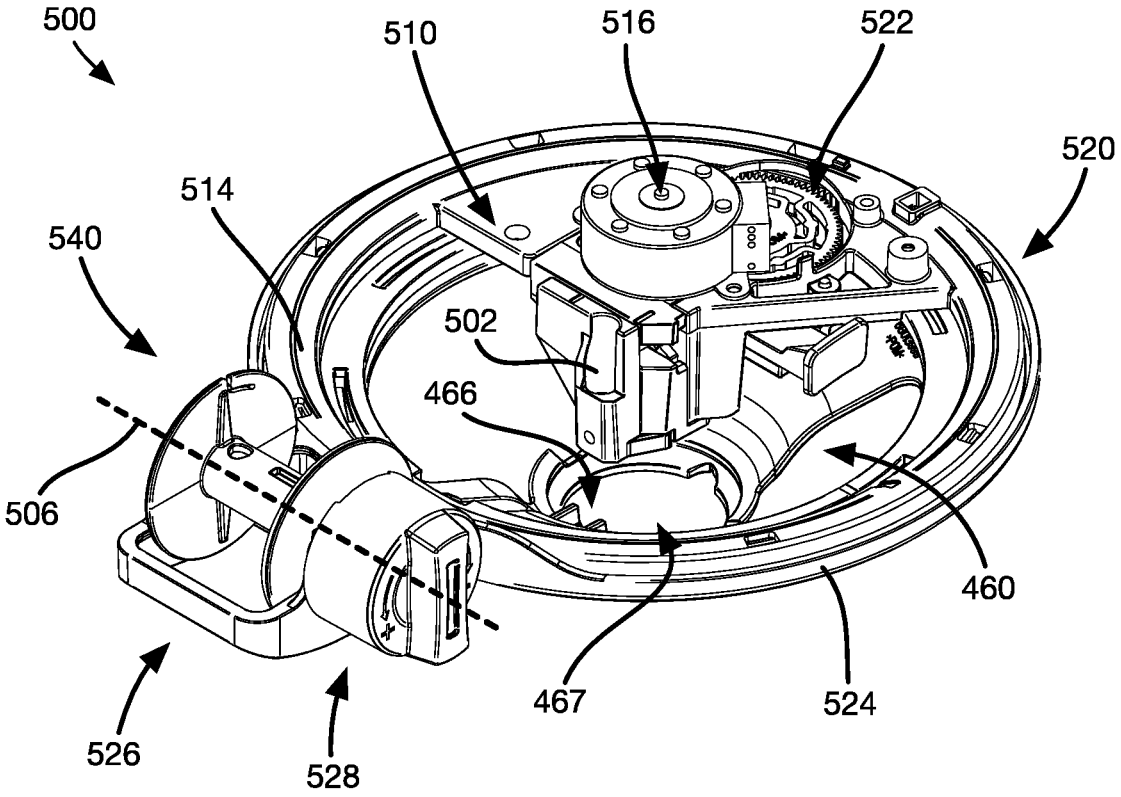
FIG. 74 is a t op perspective view of a cord guide assembled with the accessory of FIG. 66.
Figure 75:
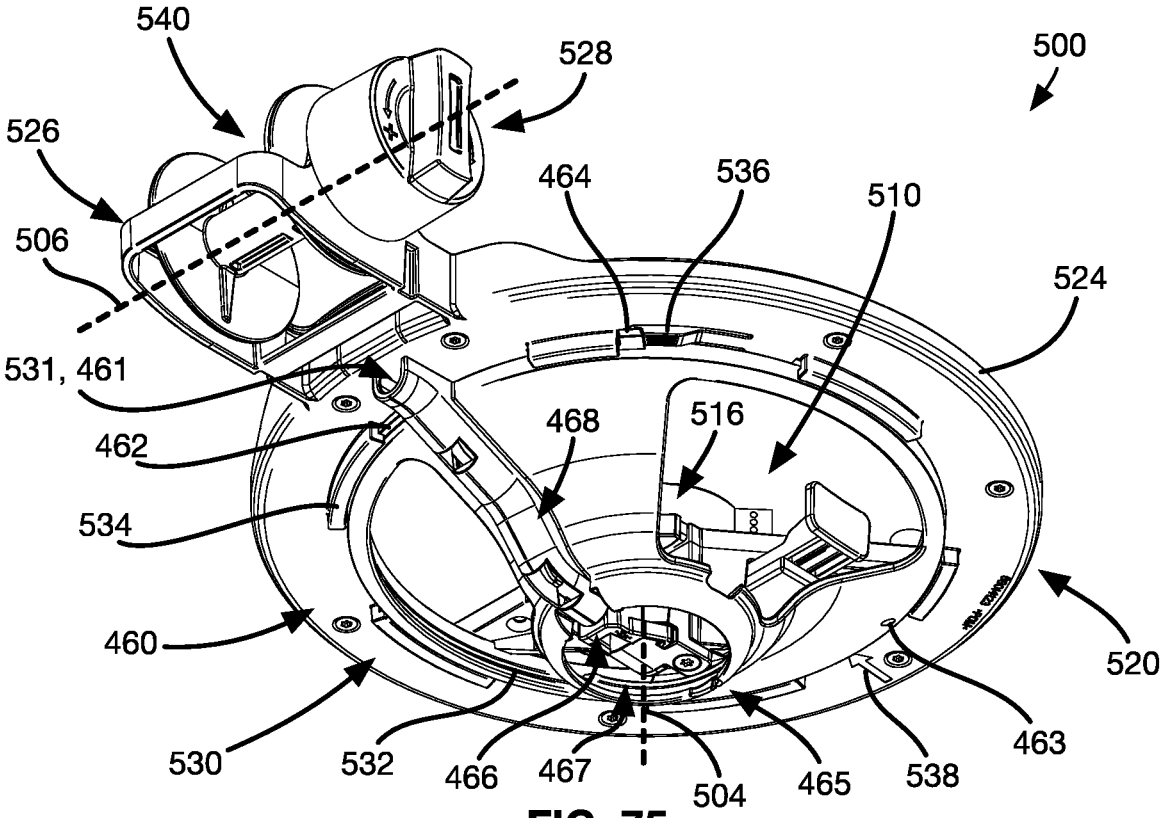
FIG. 75 is a bottom perspective view of the accessory of FIG. 74.

Referring now to FIGS. 74-75, the cord guide 460 is shown assembled with the accessory 500. When the cord guide 460 is assembled to the rotating support 520 the accessory 500 has similar features and operates in a similar manner as the accessory 400 shown in FIGS. 55-57 and 62-65 and described in detail above. That is, embroidery material, such as cord, can be loaded into the spool 540 for dispensing as the cord is attached to a workpiece via stitching performed by the needle 118. The spool 540 is rotatably installed in the rotating support 520 and is held in place by gravity and tension applied by the embroidery material being sewn to the workpiece so that the spool 540 is rotatable around a spool axis of rotation 506.

Loading cord from the spool 540 and through the cord guide 460 is also similar to the loading and routing of the spool 570 shown in FIGS. 55-63 and described in detail above. That is, once the full spool 540 has been installed in the accessory 500, the embroidery material or cord can be routed or threaded through the openings 531, 461, the guide channel 468, and the sewing guide 466 to prepare the accessory 500 for use. The embroidery material or cord is first fed through the aligned openings 531, 461 in the guide interface portion 530 and the cord guide 460, respectively, the guide channel 468, and then through the sewing guide 466.

During operation of the accessory 500, the ribbon or cord of embroidery material is supplied from the spool 540 that is supported by the rotating support 520. As is described above, the spool 540 can rotate freely to facilitate dispensing of the ribbon or cord of embroidery material. As the ribbon or cord of embroidery material is dispensed and sewn onto a sewing article tension between the embroidery material attached to the cloth workpiece and the embroidery material remaining in the spool 540 causes the spool 540 to rotate in a dispensing direction around a spool axis of rotation 506 to dispense more embroidery material for sewing. Because the spool 540 is supported by the rotating support 520, tension forces along the embroidery material are not transmitted to the stationary support 510 and therefore do not act against or in favor of the rotation of the rotating support 520 nor can these forces push the sewing guides 446, 466 out of alignment with the needle 118.

The sewing machine 100 includes a controller (not shown) that sends signals to the one or more actuators to move the embroidery frame attached to the embroidery frame mount 108 and also that sends signals to the drive mechanism 516 to control the rotation of the rotating support 520 of the accessory 500 to rotate the rotating support 520—and, thus, the attached ribbon or cord guide 440, 460—in either a clockwise or counterclockwise direction so that the embroidery material openings 445, 466 of the ribbon and cord guides 440, 460, respectively, lead the needle opening along the sewing path of the embroidery pattern being sewn by the sewing machine 100.

An exemplary method of operating the accessories 400, 500 for a sewing machine to attach a length of embroidery material to a workpiece includes the steps of: providing the sewing machine and accessory, moving the workpiece so that the needle of the sewing machine follows a predetermined sewing path, rotating the support so that the embroidery material opening leads the needle along the predetermined sewing path, dispensing at least a portion of the length of embroidery through an embroidery material opening of the guide, and sewing at least a portion of the length of the embroidery material to the workpiece with the needle. The accessory includes a rotating support that can be rotatably attached to the sewing machine via a stationary support, a guide removably attached to a guide interface portion of the rotating support, a spool supported by the rotating support, and a drive mechanism that rotates the rotating support relative to the stationary support. The drive mechanism can be controlled by the sewing machine. The guide includes a needle opening for a needle of the sewing machine to pass through and an embroidery material opening spaced apart from the needle opening.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. An accessory for a sewing machine, the accessory comprising:

a stationary support configured to be removably attached to a sewing machine;

a rotating support rotatably attached to the stationary support;

a drive mechanism fixedly attached to the stationary support, wherein the drive mechanism rotates the rotating support relative to the stationary support;

a spool for receiving and dispensing a length of embroidery material, wherein the spool is supported by the rotating support;

a removable guide removably attached to the rotating support, the removable guide comprising:

a sewing guide having a needle opening configured to receive a needle of the sewing machine; and at least one guide for guiding the length of embroidery material from the spool to the sewing guide.

2. The accessory of claim 1, wherein:

the rotating support comprises a guide interface portion; and the removable guide comprises a retaining portion for attaching the removable guide to the guide interface portion.

3. The accessory of claim 2, wherein:

the retaining portion comprises a plurality of retaining tabs; and the guide interface portion comprises a plurality of retaining slots for receiving the retaining tabs of the retaining portion.

4. The accessory of claim 2, wherein:

the retaining portion comprises a locking tab; and the guide interface portion comprises a latch.

5. The accessory of claim 2, wherein the guide interface portion comprises an alignment portion that is received within a portion of an upper end of the removable guide.

6. The accessory of claim 1, wherein the spool is rotatably attached to the rotating support.

7. The accessory of claim 1, wherein the drive mechanism comprises:

a motor mounted on the stationary support;

a ring gear attached to the rotating support; and a transmission that transmits rotary motion of the motor to the ring gear of the rotating support.

8. The accessory of claim 7, wherein at least a portion of the motor is arranged between a top surface and a bottom surface of the rotating support.

9. The accessory of claim 1, further comprising an attachment holder attached to an accessory mount of the sewing machine, wherein the stationary support of the accessory releasably attaches to the attachment holder.

10. The accessory of claim 9, wherein the accessory mount is a presser bar of the sewing machine.

11. The accessory of claim 1, wherein the at least one guide is a guide channel that extends from a top end to a bottom end of the removable guide.

12. The accessory of claim 1, wherein the at least one guide comprises an opening in a top end of the removable guide.

13. The accessory of claim 12, wherein the at least one guide further comprises an opening between the top end and a bottom end of the removable guide.

14. The accessory of claim 1, wherein the at least one guide comprises a channel extending from a first opening proximate a top end of the removable guide to a second opening proximate a bottom end of the removable guide.

15. The accessory of claim 1, wherein a spool support for supporting the spool is integrally formed with the rotating support.

16. The accessory of claim 1, wherein the spool includes a ribbon mounting slot for attaching a length of ribbon and a cord mounting hole for attaching a length of cord.

17. A sewing machine for attaching a length of embroidery material to a workpiece, the sewing machine comprising:

a bed;

an embroidery frame for holding the workpiece;

an actuator that movably attaches the embroidery frame to the bed;

an arm disposed above the bed, wherein a bottom surface of the arm is spaced apart from a top surface of the bed by an arm height;

a needle bar holding a needle and extending below the arm;

an accessory mount extending below the arm;

an accessory for dispensing the length of embroidery material to be sewn to the workpiece, the accessory comprising:

a stationary support removably attached to the accessory mount;

a rotating support rotatably attached to the stationary support;

a drive mechanism fixedly attached to the stationary support, wherein the drive mechanism rotates the rotating support relative to the stationary support;

a spool for receiving and dispensing the length of embroidery material, wherein the spool is supported by the rotating support;

a removable guide removably attached to the rotating support, the removable guide comprising:

a sewing guide having a needle opening configured to receive a needle of the sewing machine; and at least one guide for guiding the length of embroidery material from the spool to the sewing guide.

18. The sewing machine of claim 17, wherein:

the rotating support comprises a guide interface portion; and the removable guide comprises a retaining portion for attaching the removable guide to the guide interface portion.

19. The sewing machine of claim 18, wherein:

the retaining portion comprises a plurality of retaining tabs; and the guide interface portion comprises a plurality of retaining slots for receiving the retaining tabs of the retaining portion.

20. The sewing machine of claim 18, wherein:
the retaining portion comprises a locking tab; and
the guide interface portion comprises a latch.

21. The sewing machine of claim 18, wherein the guide interface portion comprises an alignment portion that is received within a portion of an upper end of the removable guide.

22. The sewing machine of claim 17, wherein the spool is rotatably attached to the rotating support.

23. The sewing machine of claim 17, wherein the drive mechanism comprises:
a motor mounted on the stationary support;
a ring gear attached to the rotating support; and
a transmission that transmits rotary motion of the motor to the ring gear of the rotating support.

24. The sewing machine of claim 23, wherein at least a portion of the motor is arranged between a top surface and a bottom surface of the rotating support.

25. The sewing machine of claim 17, further comprising an attachment holder attached to the accessory mount of the sewing machine, wherein the stationary support of the accessory releasably attaches to the attachment holder.

26. The sewing machine of claim 25, wherein the accessory mount is a presser bar of the sewing machine.

27. The sewing machine of claim 17, wherein the at least one guide is a guide channel that extends from a top end to a bottom end of the removable guide.

28. The sewing machine of claim 17, wherein the at least one guide comprises an opening in a top end of the removable guide.

29. The sewing machine of claim 28, wherein the at least one guide further comprises an opening between the top end and a bottom end of the removable guide.

30. The sewing machine of claim 17, wherein the at least one guide comprises a channel extending from a first opening proximate a top end of the removable guide to a second opening proximate a bottom end of the removable guide.

31. The sewing machine of claim 17, wherein a spool support for supporting the spool is integrally formed with the rotating support.

32. The sewing machine of claim 17, wherein the spool includes a ribbon mounting slot for attaching a length of ribbon and a cord mounting hole for attaching a length of cord.

33. A method of operating a sewing machine to attach a length of embroidery material to a workpiece, the method comprising:
providing the sewing machine and accessory, the accessory comprising:
a stationary support removably attached to the accessory mount;
a rotating support rotatably attached to the stationary support;
a drive mechanism fixedly attached to the stationary support, wherein the drive mechanism rotates the rotating support relative to the stationary support; and
a spool for receiving and dispensing the length of embroidery material, wherein the spool is supported by the rotating support;
selecting a removable guide based on the type of embroidery material, wherein the removable guide is one of a ribbon guide and a cord guide, the removable guide comprising:
a sewing guide having a needle opening configured to receive a needle of the sewing machine; and
at least one guide for guiding the length of embroidery material from the spool to the sewing guide;
removably attaching the selected removable guide to the rotating support;
moving the workpiece so that the needle of the sewing machine follows a predetermined sewing path;
rotating the rotating support so that the embroidery material opening leads the needle along the predetermined sewing path;
dispensing at least a portion of the length of embroidery through the embroidery material opening of the guide; and
sewing at least a portion of the length of the embroidery material to the workpiece with the needle.

34. The method of claim 33, wherein moving the workpiece causes dispensing of the length of embroidery material.

35. The method of claim 33, further comprising:
adjusting a tension knob of the spool based on the type of embroidery material.

36. The method of claim 33, wherein the step of rotating the rotating support further comprises:
rotating the rotating support so that the sewing guide of the removable guide crosses back-and-forth over the sewing path.

* * * * *